US012416152B2

(12) United States Patent
Kabatsi et al.

(10) Patent No.: US 12,416,152 B2
(45) Date of Patent: Sep. 16, 2025

(54) ARCHITECTURAL FIXTURE CONNECTION SYSTEM

(71) Applicant: Arktura LLC, Gardena, CA (US)

(72) Inventors: Chris Kabatsi, Venice, CA (US); Robert Kilian, Venice, CA (US); Kevin Kane, Los Angeles, CA (US); John Johnston, North Hollywood, CA (US); Moti Tavassoli, Culver City, CA (US); Alexander Gentes, Downey, CA (US)

(73) Assignee: Arktura LLC, Carson, CA (US)

( * ) Notice: Subject to any disclaimer, the term of this patent is extended or adjusted under 35 U.S.C. 154(b) by 361 days.

(21) Appl. No.: 17/982,774

(22) Filed: Nov. 8, 2022

(65) Prior Publication Data

US 2023/0151606 A1 May 18, 2023

Related U.S. Application Data

(60) Provisional application No. 63/278,583, filed on Nov. 12, 2021.

(51) Int. Cl.
*E04B 9/18* (2006.01)
*E04B 9/06* (2006.01)

(52) U.S. Cl.
CPC ..... *E04B 9/183* (2013.01); *E04B 9/064* (2013.01)

(58) Field of Classification Search
CPC ..... E04B 9/183; E04B 9/064
See application file for complete search history.

(56) References Cited

U.S. PATENT DOCUMENTS 2,557,412 A 6/1951 MacMillan
2,676,680 A * 4/1954 Kindorf ..... E04B 9/183 248/228.2
2,689,026 A 9/1954 Zingone
3,277,624 A * 10/1966 Cornell ..... E04B 9/005 52/506.06
3,321,877 A * 5/1967 Alexieff ..... E04B 9/0414 52/28
3,385,557 A * 5/1968 Rambelle ..... E04G 11/50 52/363
3,539,425 A * 11/1970 Marburg ..... A47B 88/9416 156/247
3,725,568 A * 4/1973 Stanley ..... H02G 3/281 52/39
3,797,192 A * 3/1974 DeJonge ..... E04B 9/345 52/506.06
3,890,415 A 6/1975 Hull
(Continued)

FOREIGN PATENT DOCUMENTS

EP 0210385 A2 4/1987
WO WO 2019/183250 A1 9/2019

*Primary Examiner* — Joshua K Ihezie
(74) *Attorney, Agent, or Firm* — Patrick Sheldrake

(57) ABSTRACT

An architectural fixture connection system offers acoustical and aesthetic benefits. This system utilizes modular construction, allowing interconnection of a variety of different beams to form an installation that may attach to a wall or ceiling of a building. This system may be formed of a series of sheets which are formed into beams using securing brackets and attachment brackets, then coupled to one another using a series of joiner brackets. Interconnection between adjacent beams need not be linear, allowing free-form shapes and angles.

20 Claims, 54 Drawing Sheets

(56) References Cited

U.S. PATENT DOCUMENTS 3,981,116 A * 9/1976 Reed ..... E04F 13/12 52/506.1
4,000,594 A * 1/1977 Kirk, Jr. ..... E04B 2/7409 52/745.12
4,034,534 A * 7/1977 Taylor ..... E04B 9/345 52/668
4,200,171 A 4/1980 Seymour
4,540,847 A * 9/1985 Gardner ..... E04B 9/127 174/491
4,625,470 A * 12/1986 Heritage ..... E04B 9/122 52/645
4,665,674 A * 5/1987 Brugman ..... E04B 9/127 52/506.06
4,718,213 A * 1/1988 Butterfield ..... E04B 9/005 D25/138
4,848,054 A * 7/1989 Blitzer ..... E04B 9/068 52/717.06
4,926,606 A * 5/1990 Hanson ..... E04B 9/065 52/506.07
5,253,462 A * 10/1993 Blitzer ..... E04B 9/30 52/762
5,316,165 A 5/1994 Moran, Jr.
5,555,989 A 9/1996 Moran, Jr.
6,098,353 A 8/2000 Stanfield
7,578,107 B2 8/2009 Platt
8,438,893 B2 * 5/2013 Durney ..... B65D 7/08 72/332
8,733,053 B2 5/2014 Kabatsi
8,782,987 B2 7/2014 Kabatsi
9,045,931 B2 * 6/2015 Damen ..... E06B 9/04
D767,816 S 9/2016 Kilian
9,441,373 B1 9/2016 Header
D777,349 S 1/2017 Kilian
D777,943 S 1/2017 Kilian
D777,944 S 1/2017 Kilian
D777,945 S 1/2017 Kilian
D777,946 S 1/2017 Kilian
9,663,949 B1 * 5/2017 Caste ..... E04B 9/0428
10,233,639 B2 * 3/2019 Underkofler ..... E04B 9/127
10,458,147 B2 * 10/2019 Garza Montemayor ..... E04H 17/1439
10,662,647 B2 * 5/2020 Kilian ..... E04B 9/225
10,808,402 B2 * 10/2020 Adams ..... E04B 9/001
11,313,543 B2 * 4/2022 Donnelly ..... F21V 21/112
11,634,906 B2 * 4/2023 Kabatsi ..... E04B 9/005 52/173.1
2012/0324821 A1 12/2012 Kordecki
2016/0281353 A1 * 9/2016 Gillette ..... E04B 1/8218
2018/0283004 A1 10/2018 Gillette
2019/0161966 A1 5/2019 Friez
2019/0249408 A1 * 8/2019 Wyllie ..... A47B 45/00
2020/0109560 A1 4/2020 Headley
2021/0148531 A1 * 5/2021 Donnelly ..... F21S 8/061
2021/0340761 A1 * 11/2021 Kabatsi ..... E04B 9/0457

* cited by examiner

ARCHITECTURAL FIXTURE CONNECTION SYSTEM

CROSS REFERENCE TO RELATED APPLICATIONS

The present application claims the benefit of U.S. Provisional Patent Application Ser. No. 63/278,583, filed Nov. 12, 2021, the entireties of which are incorporated herein by reference.

FIELD OF THE INVENTION

The present invention relates generally to the field of ceiling and wall fixtures. More particularly, the present invention relates to an architectural fixture connection system.

BACKGROUND

Fixtures have conventionally provided only horizontally oriented surfaces or vertically oriented planar segments.

Co-owned U.S. Pat. No. 8,733,053 discloses systems and methods for supported architectural designs. Co-owned U.S. Pat. No. 8,782,987 discloses supported architectural structures.

There is a need for new types of acoustical ceiling and wall architectural fixtures. There is a further need for an improved architectural fixture providing sound-absorption. There is an additional need for an improved architectural fixture that provides a modular construction. There is also a need for an improved architectural fixture that provides improved connection between components of the fixture. There is a need for an improved architectural fixture that provides for various configurations of the fixture. There is a further need for an improved architectural fixture that provides routing and/or support for various objects. There is an additional need for a holder that is easier to manufacture, assemble, adjust, and maintain. The present invention satisfies these needs and provides other related advantages.

SUMMARY

An architectural fixture described herein provides sound-absorption. An architectural fixture described herein provides a modular construction. An architectural fixture described herein provides improved connection between components of the fixture. An architectural fixture described herein provides for various configurations of the fixture. An architectural fixture described herein provides easier manufacture, assembly, adjustment, and maintenance.

In one implementation, the invention is an architectural fixture assembly having a beam extending along a longitudinal axis. The beam has a bottom side, a first sidewall extending from the bottom side to a distal end, and a second sidewall that extends from the bottom side to a distal end. A cavity is formed by inner surfaces of the bottom side, the first sidewall, and the second sidewall. A first elongated channel is formed into the inner surface of the first sidewall. A second elongated channel is formed into the inner surface of the second sidewall. A third fastener extends through the first elongated channel. A second fastener extends through the second elongated channel. A first securing element extends from the first elongated channel to the second elongated channel. The first securing element engages the first fastener and the second fastener.

In another implementation, the invention is an architectural fixture assembly having a first beam extending along a longitudinal axis and a second beam extending along the longitudinal axis. The first beam has a bottom side, a first sidewall extending from the bottom side to a distal end, and a second sidewall that extends from the bottom side to a distal end. A cavity is formed by inner surfaces of the bottom side, the first sidewall, and the second sidewall. A first notch is formed into the inner surface of the first sidewall at a first end of the first sidewall. The second beam has a bottom side, a first sidewall extending from the bottom side to a distal end, and a second sidewall that extends from the bottom side to a distal end. A cavity is formed by inner surfaces of the bottom side, the first sidewall, and the second sidewall. A second notch is formed into the inner surface of the first sidewall at a second end of the first sidewall. A first joiner bracket engages the first notch of the first beam and the second notch of the second beam, the joiner bracket securing the first end of the first sidewall of the first beam to the second end of the first sidewall of the second beam.

In yet another implementation, the invention is an architectural fixture assembly having a first beam extending along a first longitudinal axis and a second beam extending along a second longitudinal axis. The first beam has a bottom side, a first sidewall extending from the bottom side to a distal end, and a second sidewall that extends from the bottom side to a distal end. A cavity is formed by inner surfaces of the bottom side, the first sidewall, and the second sidewall. The second beam has a bottom side, a first sidewall extending from the bottom side to a distal end, and a second sidewall that extends from the bottom side to a distal end. A cavity is formed by inner surfaces of the bottom side, the first sidewall, and the second sidewall. The bottom side, the first sidewall, and the second sidewall of both of the first and second beams are formed from a monolithic, unitary, sheet.

In still another implementation, the invention is an architectural fixture assembly having a first beam extending along a first longitudinal axis and a second beam extending along a second longitudinal axis, the second longitudinal axis oriented at an angle to the first longitudinal axis. The first beam has a bottom side, a first sidewall extending from the bottom side to a distal end, and a second sidewall that extends from the bottom side to a distal end. A cavity is formed by inner surfaces of the bottom side, the first sidewall, and the second sidewall. First and second elongated slots are formed into the first sidewall, the first and second elongated slots extend from the distal end toward the bottom side. The second beam has a bottom side, a first sidewall extending from the bottom side to a distal end, and a second sidewall that extends from the bottom side to a distal end. A cavity is formed by inner surfaces of the bottom side, the first sidewall, and the second sidewall. A first elongated slot is formed into the first sidewall and extends upward from the bottom side. A second elongated slot is formed into the second sidewall and extends upward from the bottom side. The second beam is assembled to the first beam such that the first and second elongated slots of the first beam engage the first and second sidewalls of the second beam.

In another implementation, the invention is an architectural fixture assembly having a first beam extending along a first longitudinal axis, a second beam extending along a second longitudinal axis, the second longitudinal axis oriented at a first angle to the first longitudinal axis, and a third beam extending at a third longitudinal axis, the third longitudinal axis at a second angle to the first longitudinal axis. The first beam has a bottom side, a first sidewall extending from the bottom side to a distal end, and a second sidewall that extends from the bottom side to a distal end. A cavity is formed by inner surfaces of the bottom side, the first sidewall, and the second sidewall. First, second, and third elongated slots are formed into the first sidewall, the first, second, and third elongated slots extending from the distal end toward the bottom side. The second beam has a bottom side, a first sidewall extending from the bottom side to a distal end, and a second sidewall that extends from the bottom side to a distal end. A cavity is formed by inner surfaces of the bottom side, the first sidewall, and the second sidewall. A first elongated slot is formed into the first sidewall and extends upward from the bottom side. A second elongated slot is formed into the second sidewall and extends upward from the bottom side. The third beam has a bottom side, a first sidewall extending from the bottom side to a distal end, and a second sidewall that extends from the bottom side to a distal end. A cavity is formed by inner surfaces of the bottom side, the first sidewall, and the second sidewall. A first elongated slot is formed into the first sidewall and extends upward from the bottom side. A second elongated slot is formed into the first sidewall and extends downward from the distal end. A third elongated slot is formed into the second sidewall and extends downward from the distal end. The second beam is assembled to the first beam such that 1) the first elongated slot of the first beam engages the first sidewall of the second beam, 2) the second elongated slot of the first beam engages the second sidewall of the second beam and the first sidewall of the third beam, and 3) the third elongated slot of the first beam engages the second sidewall of the third beam.

In yet another implementation, the invention is an architectural fixture assembly having a first beam extending along a first longitudinal axis and a second beam extending along a second longitudinal axis. The first beam has a bottom side extending along a first plane, a first sidewall extending from the bottom side to a distal end, and a second sidewall that extends from the bottom side to a distal end. A cavity is formed by inner surfaces of the bottom side, the first sidewall, and the second sidewall. The second beam has a bottom side extending along a second plane, a first sidewall extending from the bottom side to a distal end, and a second sidewall that extends from the bottom side to a distal end. A cavity is formed by inner surfaces of the bottom side, the first sidewall, and the second sidewall. The second plane is oriented at an acute angle with respect to the first plane.

In a further implementation, the invention is an architectural fixture assembly having a first beam extending along a first longitudinal axis, a second beam extending along a second longitudinal axis, and a third beam extending at a third longitudinal axis. The first beam has a bottom side, a first sidewall extending from the bottom side to a distal end, and a second sidewall that extends from the bottom side to a distal end. A cavity is formed by inner surfaces of the bottom side, the first sidewall, and the second sidewall. The second beam has a bottom side, a first sidewall extending from the bottom side to a distal end, and a second sidewall that extends from the bottom side to a distal end. A cavity is formed by inner surfaces of the bottom side, the first sidewall, and the second sidewall. The third beam has a bottom side, a first sidewall extending from the bottom side to a distal end, and a second sidewall that extends from the bottom side to a distal end. A cavity is formed by inner surfaces of the bottom side, the first sidewall, and the second sidewall. A first joiner bracket engages the first sidewall of the first beam and the second sidewall of the second beam. A second joiner bracket engages the first sidewall of the second beam and the second sidewall of the third beam.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The various present embodiments now will be discussed in detail with an emphasis on highlighting the advantageous features with reference to the drawings of various embodiments. The illustrated embodiments are intended to illustrate, but not to limit the invention. The drawings are not to be construed as drawn to scale.

DETAILED DESCRIPTION

Figure 1:
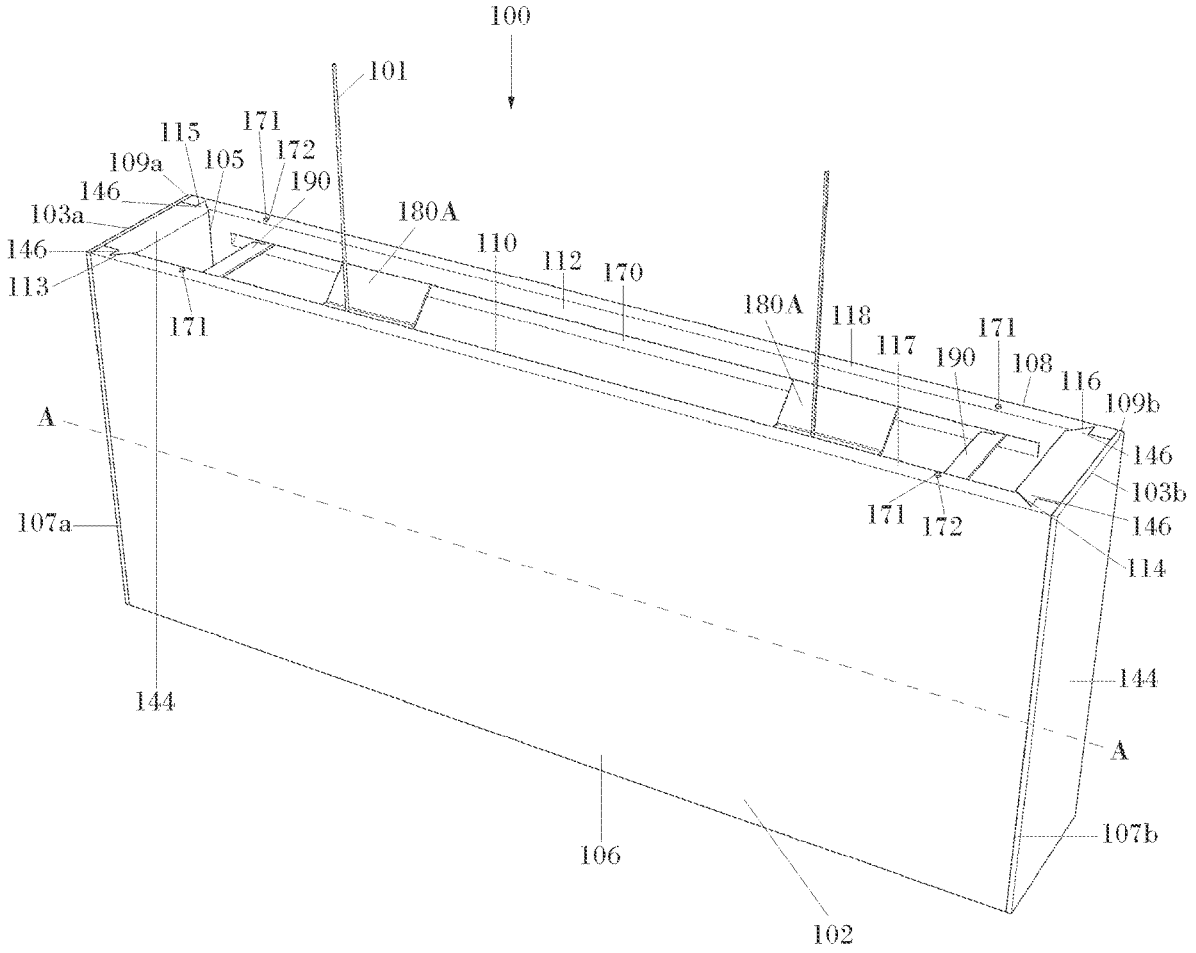
FIG. 1 is a top, front, right perspective view of an architectural fixture embodying the invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Co-owned U.S. patent application Ser. No. 16/863,949, filed Apr. 30, 2020, and published as US2021/0340761 on Nov. 4, 2021, discloses an architectural fixture connection system. The present application is directed, at least in part, to updates, additions, and/or modifications to the architectural fixture connection system described in U.S. patent application Ser. No. 16/863,949. US2021/0340761 is incorporated herein by reference.

Referring first to FIGS. 1-12, an architectural fixture assembly 100 is illustrated in accordance with an embodiment of the present invention. The architectural fixture assembly 100 is a generally U-shaped beam 102 that is formed by folding a flat elongated sheet of material. Optionally, a plurality of V-cuts, grooves, or other features may be formed to facilitate bending of the sheet. Once folded, the U-shaped beam 102 comprises a bottom side 104, a first sidewall 106 that extends from the bottom side 104 to a distal end 117, and a second sidewall 108 that extends from the bottom side 104 to a distal end 118. The bottom side 104 and the first and second sidewalls 106, 108 collectively define a cavity 105. A longitudinal axis A-A extends along the beam 102, extending parallel to the bottom side 104 and the first and second sidewalls 106, 108. The beam 102 extends from a first end 103*a* to a second end 103*b* along the longitudinal axis A-A.

The cavity 105 may be open or closed at opposing ends. That is, the first sidewall 106 extends from a first end 107*a* to a second end 107*b* and the second sidewall 108 extends from a first end 109*a* to a second end 109*b*. The cavity 105 is bounded by connection keys 144 at each of the first and second ends 107*a*, 107*b*, 109*a*, 109*b* of the first and second sidewalls 106, 108. Optionally, the cavity 105 may be open at one or both of the first and second ends 107*a*, 107*b*, 109*a*, 109*b* of the first and second sidewalls 106, 108. The use of connection keys 144 is optional as will be described in greater detail below.

The first sidewall 106 has an inner surface 110 that faces the cavity 105 and the second sidewall 108 has an inner surface 112 that faces the cavity 105. The first sidewall 106 has a first notch 113 formed into its inner surface 110 located adjacent to the first end 107*a* and a second notch 114 formed into its inner surface 110 located adjacent to the second end 107*b*. The second sidewall 108 has a first notch 115 formed into its inner surface 112 located adjacent to the first end 109*a* and a second notch 116 formed into its inner surface 112 located adjacent to the second end 109*b*.

Referring to FIGS. 1 and 9-12, the architectural fixture 100 comprises a pair of connection keys 144 that are coupled to the U-shaped beam 102 to close the openings at the first and second opposing ends of the first and second sidewalls 106, 108. Each of the connection keys 144 comprises a pair of protuberances 146 that nest within the notches 113-116 in the inner surfaces 110, 112 of the first and second sidewalls 106, 108. Thus, the connection keys 144 can be positioned with the protuberances 146 aligned with the notches 113-116 and then the connection keys 114 can be slid relative to the beam 102 to couple the connection keys 144 to the beam 102. The connection key 144 may comprise a plate portion 147 and a connection portion 148, or may be formed as a single, integrally formed, monolithic, unitary, component. Optionally, the connection keys 144 may bound the cavity 105

The architectural fixture 100 is elongated along the longitudinal axis A-A. Furthermore, there is an elongated channel 170 formed into each of the inner surfaces 110, 112 of the first and second sidewalls 106, 108. The elongated channel 170 is only visible in the inner surface 112 of the second sidewall 108 in the figures provided, but it should be appreciated that an identical elongated channel exists in the inner surface 110 of the first sidewall 106. The elongated channels 170 are elongated in the direction of the longitudinal axis A-A. In other implementations, the elongated channels 170 may be formed as two separate elongated channels 170 formed in the inner surface 110 of the first sidewall 106 and two separate elongated channels 170 formed in the inner surface 112 of the second sidewall 108. Each of these individual elongated channels 170 may be formed immediately adjacent the connection keys 144 at the first and second ends 107*a*, 107*b*, 109*a*, 109*b* of the first and second sidewalls 106, 108. In yet other implementations, there may be more than two elongated channels 170 on each of the first and second sidewall.

In the exemplified embodiment, the elongated channels 170 are spaced inwardly of the first and second ends 107*a*, 107*b*, 109*a*, 109*b* of the first and second sidewalls 106, 108, but the elongated channels 170 could extend to the various ends of the first and second sidewalls 106, 108 in other embodiments. More specifically, in the exemplified embodiment when the connection keys 144 are coupled to the beam 102, the ends of the elongated channels 170 are spaced from the connection keys 144. The elongated channels 170 do not extend through the full thickness of the first and second sidewalls 106, 108 in the exemplified embodiment, although they may in other embodiments.

Figure 2:
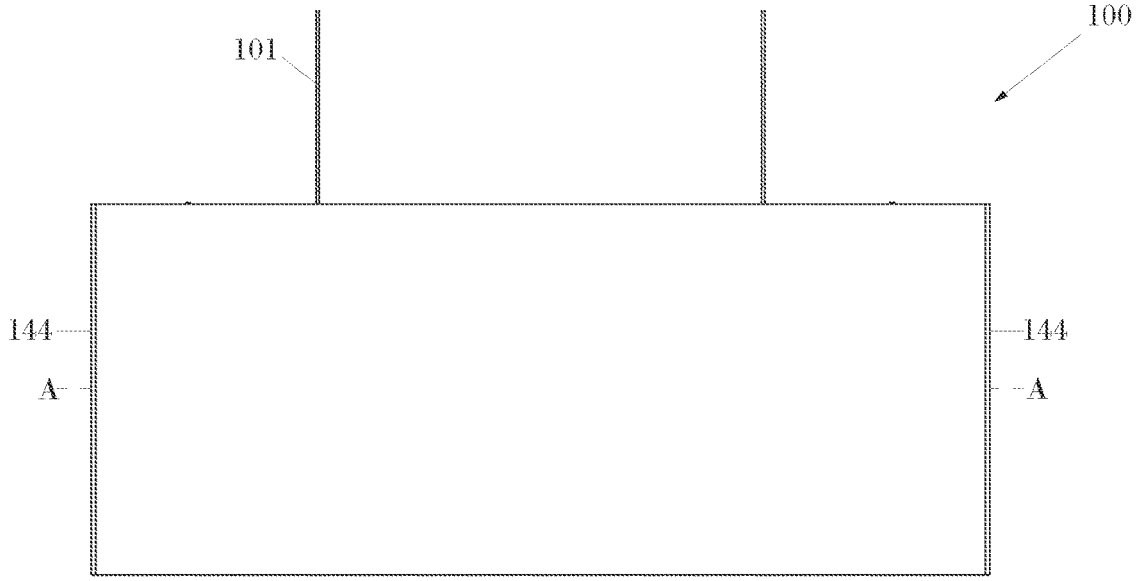
FIG. 2 is a front side elevation view of the beam of FIG. 1.
Figure 3:
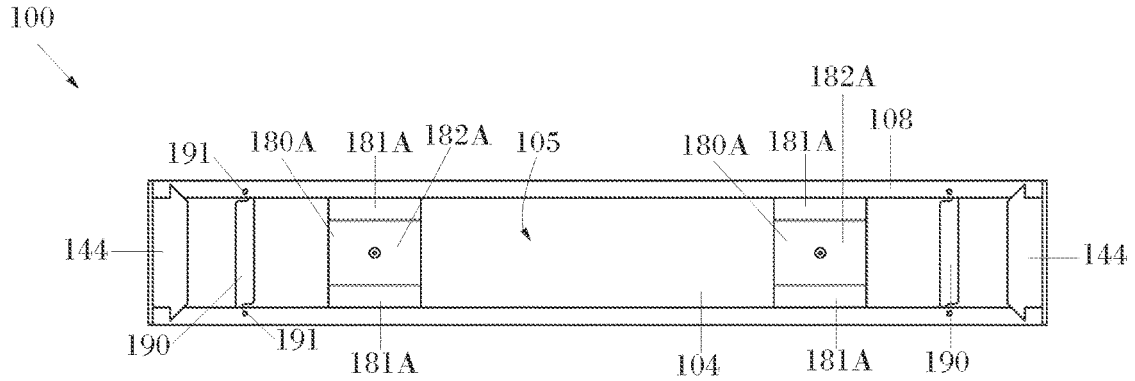
FIG. 3 is a top plan view of the beam of FIG. 1.

The architectural fixture 100 further comprises a pair of attachment brackets 180A, 180B. FIGS. 1-3 illustrate the architectural fixture 100 with the attachment brackets 180A and FIGS. 5-8A illustrate the architectural fixture 100 with the attachment brackets 180B. The architectural fixture 100 is configured to receive either of the different types of attachment brackets 180A, 180B. Referring to FIGS. 1-3, the attachment brackets 180A are a ceiling hanging bracket that comprises arm portions 181A that nest within the elongated channels 170 in the first and second sidewalls 106, 108 and a central portion 182A that extends between the arm portions 181A. The body portion 182A comprises an aperture or through-hole within which a connection feature of a rod or cable 101 may be attached to the attachment bracket 180A. The rod or cable 101 is affixed to the ceiling (either directly or indirectly) and then is attached to the attachment bracket 180A, which is in turn attached to the architectural fixture 100 by nesting the arm portions 181A of the attachment bracket 180A within the elongated channels 170 of the beam 102. The attachment brackets 180A may be configured to slide in the direction of the longitudinal axis A-A while remaining coupled to the beam 102.

Figure 4:
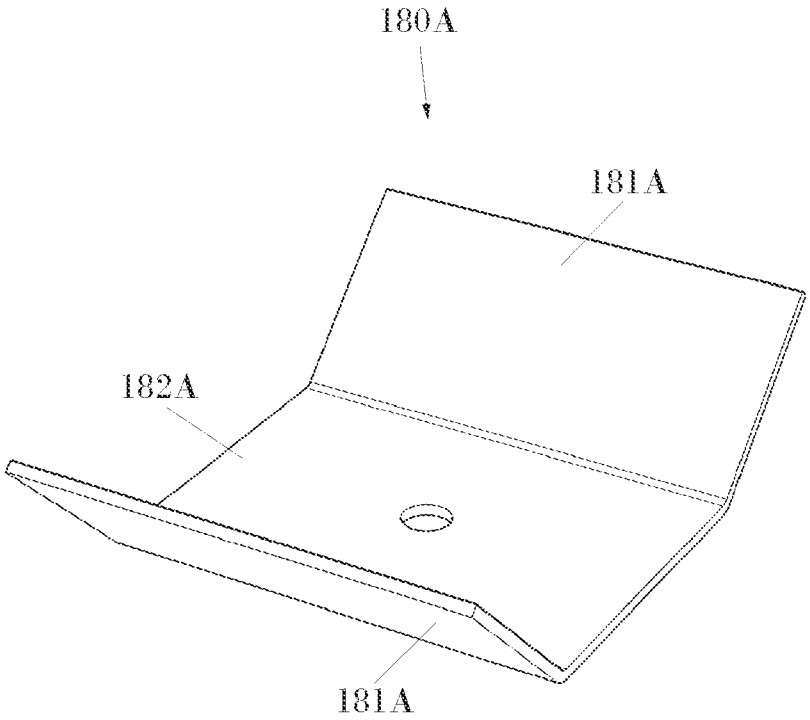
FIG. 4 is a perspective view of an attachment bracket as may be utilized in the beam of FIG. 1.
Figure 5:
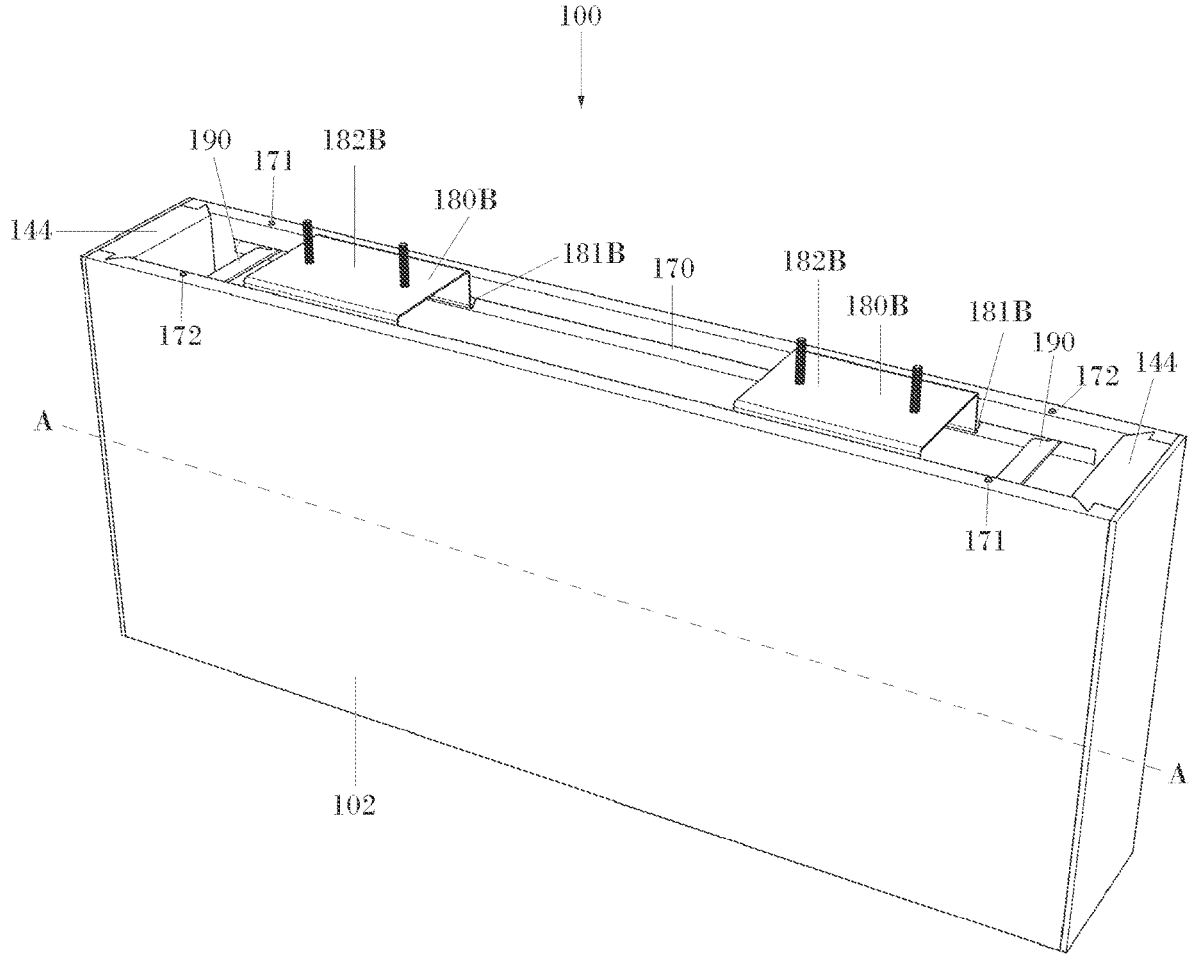
FIG. 5 is a top, front, right perspective view of an additional architectural fixture embodying the invention.
Figure 6:
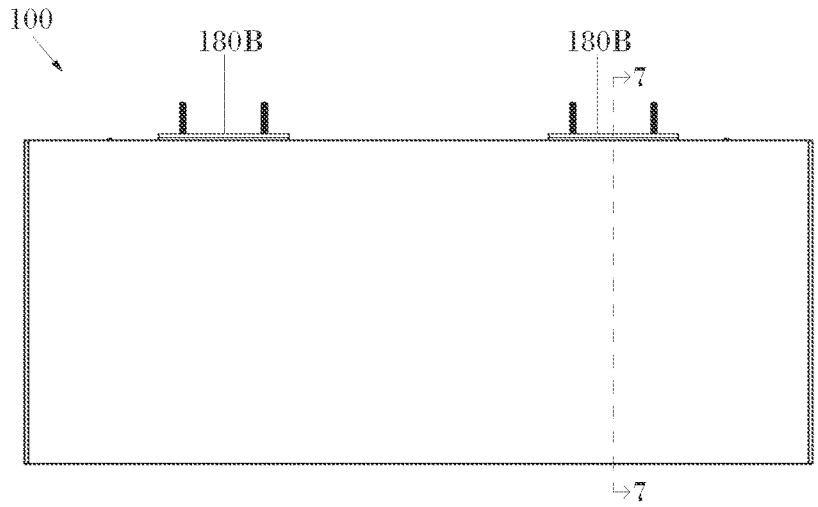
FIG. 6 is a front side elevation view of the beam of FIG. 5.
Figure 7:
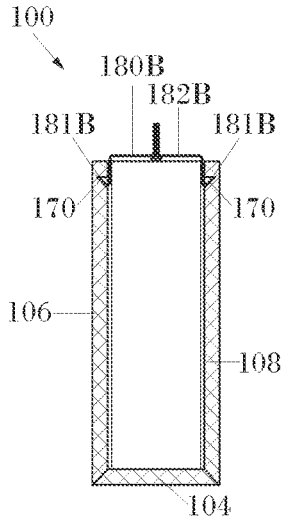
FIG. 7 is a cross-sectional view of the beam of FIG. 5.

FIG. 4 illustrates one of the attachment brackets 180A. As can be seen, the attachment bracket 180A has a central portion 182A and arm portions 181A extending upwardly from the central portion 182A. The central portion 182A incorporates an aperture or hole which receives a cable, rod, or other attachment device. The cable, rod, or other attachment device allows suspending the beam 102 from a roof or ceiling, the beam 102 being spaced from the roof or ceiling. When the beam 102 is mounted, the central portion 182 is approximately horizontal, while the arm portions 181A engage the elongated channels 170. The upward extension of the arm portions 181A allow the attachment brackets 180A to be snapped into position and engage the elongated channels 170 without the need for disassembly of the beam 102.

Still referring to FIGS. 1-3, there is also a pair of securing elements 190 (i.e., a hook bracket) mounted to the U-shaped beam 102 within the elongated channels 170. FIG. 8B also illustrates one of the securing element 190 in greater detail. The securing elements 190 are coupled to the U-shaped beam 102 along opposing ends of the elongated channels 170 in the exemplified embodiment. The securing elements 190 have a main body 192 and a pair of hooks 191, each hook 191 extending from opposite ends of the main body 192. The hooks 191 nest within the elongated channels 170 and hold the U-shaped beam 102 in its folded U-shaped configuration. Thus, the U-shaped beam 102 may be capable of maintaining its U-shape without the use of glue or other fasteners, simply with the use of the securing elements 190.

The hooks 191 engage fasteners 171 which are fitted into holes 172 formed in the first and second sidewalls 106, 108. Optionally, the fasteners 171 may be pins, screws, bolts, or any other device configured to receive the hooks 191 of the securing element. The holes 172 intersect the elongated channels 170 and the fasteners extend through the elongated channels 170. The securing elements 190 extend transverse to the longitudinal axis A-A. Optionally, the attachment brackets 180A may engage different elongated channels 170 from the elongated channels 170 engaged by the securing elements 190.

Referring to FIGS. 5-8A, the architectural fixture 100 is illustrated with the second type of attachment bracket 180B. FIGS. 5-8A are identical to FIGS. 1-3 except that the attachment brackets 180B are used instead of the attachment brackets 180A. The attachment brackets 180B are configured for direct mounting. Thus, the attachment brackets 180B comprise arm portions 181B that nest within the elongated channels 170 and a central portion 182B that extends between the arm portions 181B. The arm portions 181B comprise hooks which aid in engagement with the elongated channels 170. There are apertures in the central portion 182B through which fasteners such as screws, bolts, or the like may extend for purposes of directly coupling the attachment bracket 180B to a support structure (a ceiling, wall, T-grid, Unistrut, threaded-rod cable, or the like). Optionally, the attachment brackets 180B may engage different elongated channels 170 from the elongated channels 170 engaged by the securing elements 190.

Figure 8:
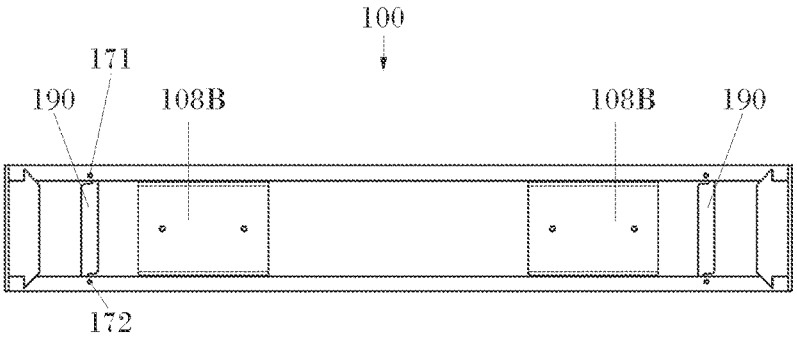
FIG. 8 is a top plan view of the beam of FIG. 5.
Figure 8A:
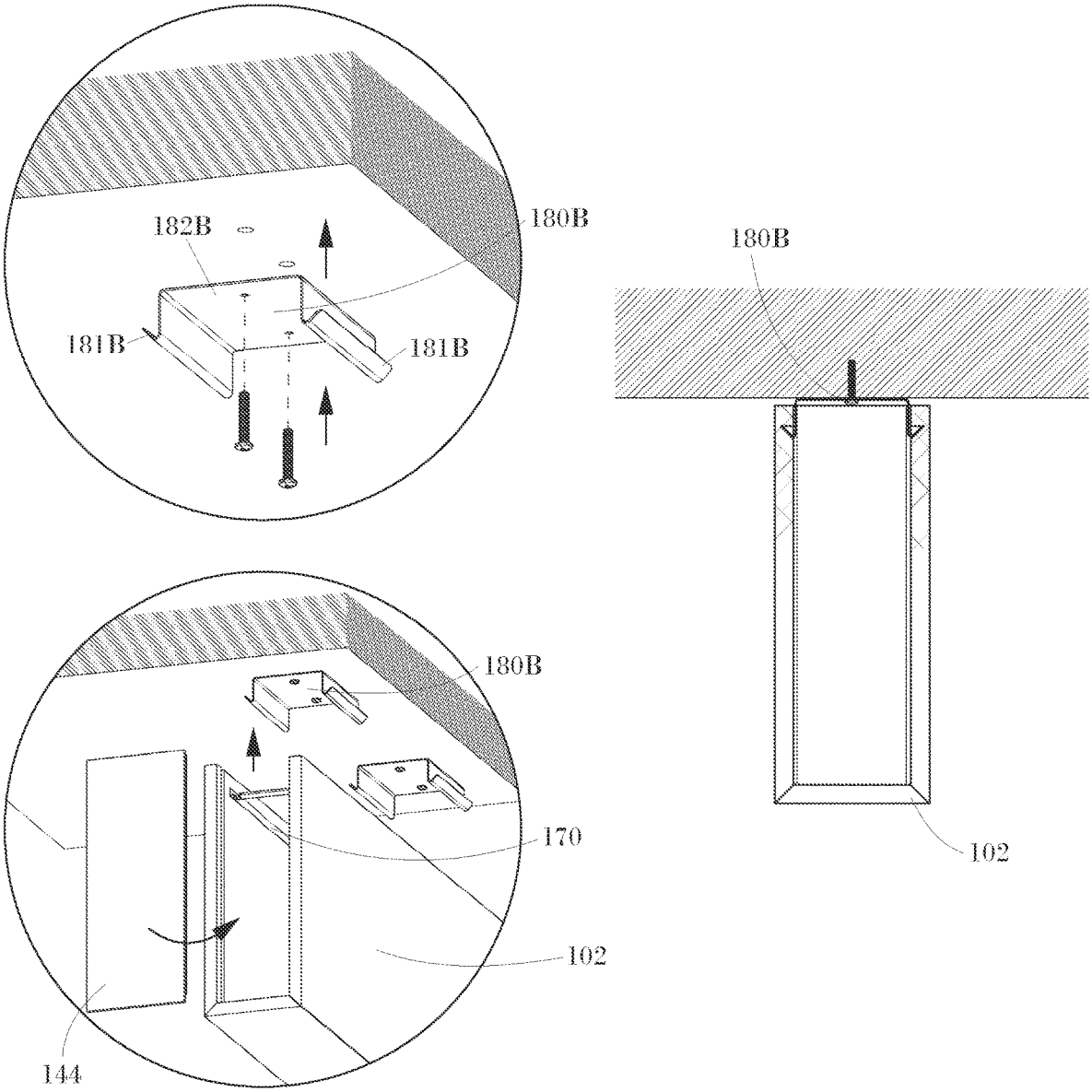
FIG. 8A illustrates an manner of attaching the architectural fixture of FIG. 5 to a support structure.
Figure 8B:
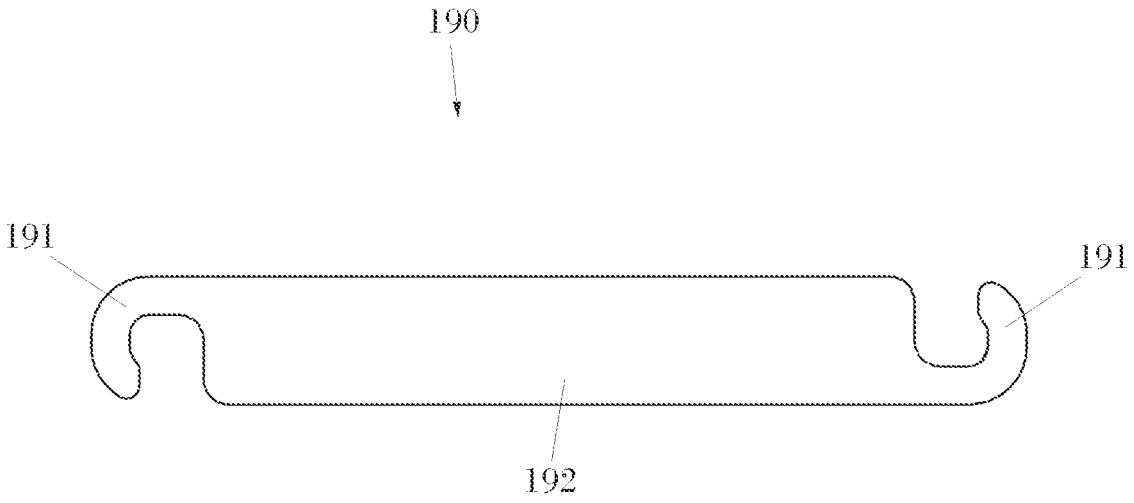
FIG. 8B illustrates a top view of a securing element as may be used in the beam of FIGS. 1 and 5.
Figure 9:
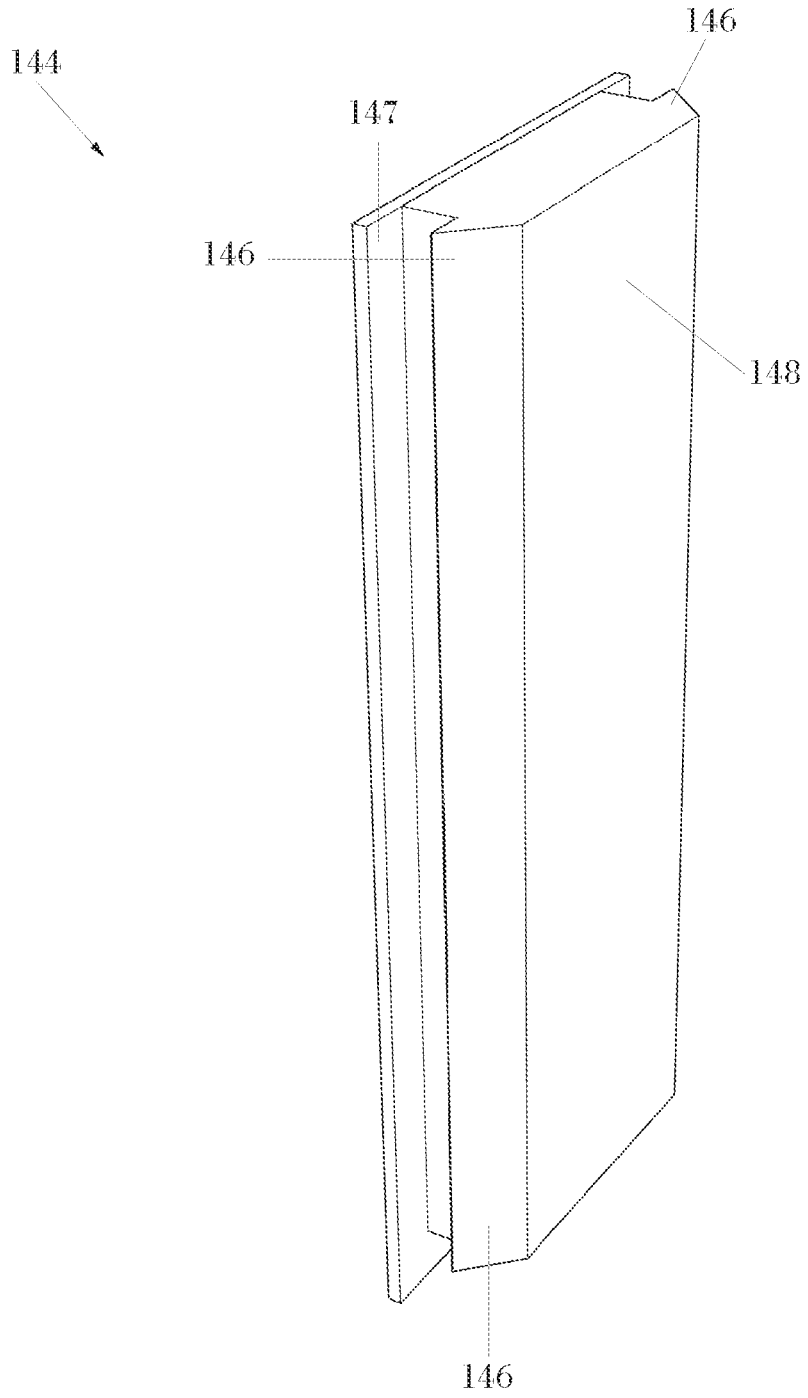
FIG. 9 is a top, front, left perspective view of a connection key with and end cover embodying the invention.
Figure 10:
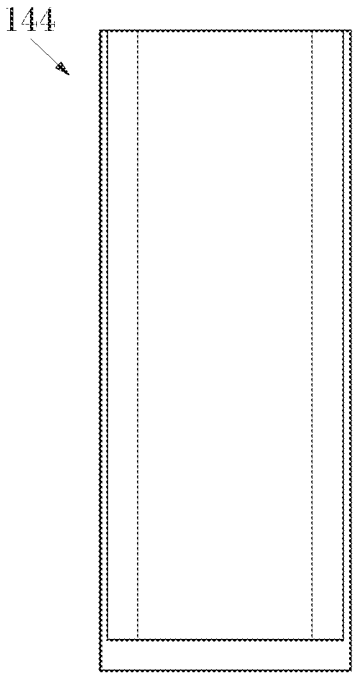
FIG. 10 is a front side elevation view of the connection key with and end cover of FIG. 9.
Figure 11:
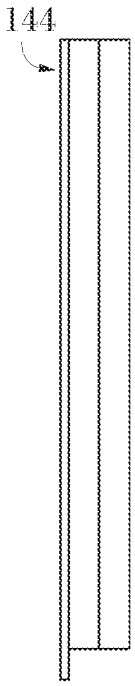
FIG. 11 is a left side elevation view of the connection key with and end cover of FIG. 9.
Figure 12:
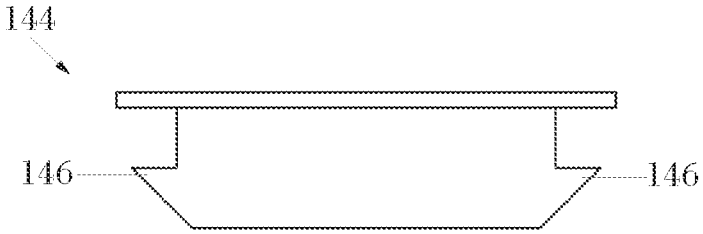
FIG. 12 is a top plan view of the connection key with and end cover of FIG. 9.

FIG. 8A illustrates the architectural fixture 100 of FIGS. 5-8A being attached to a support structure in greater detail. Specifically, first the attachment brackets 180B are attached to the support structure. The support structure may be a horizontal surface such as a ceiling or a vertical surface such as a wall. Next, the U-shaped beam 102 is slidably attached to the attachment brackets 180B while the arm portions 181B of the attachment brackets 180B nest within the elongated channels 170. Finally, the connection keys 144 are attached to the ends of the U-shaped beam 102. In other implementations, the connection keys 144 are attached prior to coupling of the beam 102 to the attachment brackets 180B.

Figure 13:
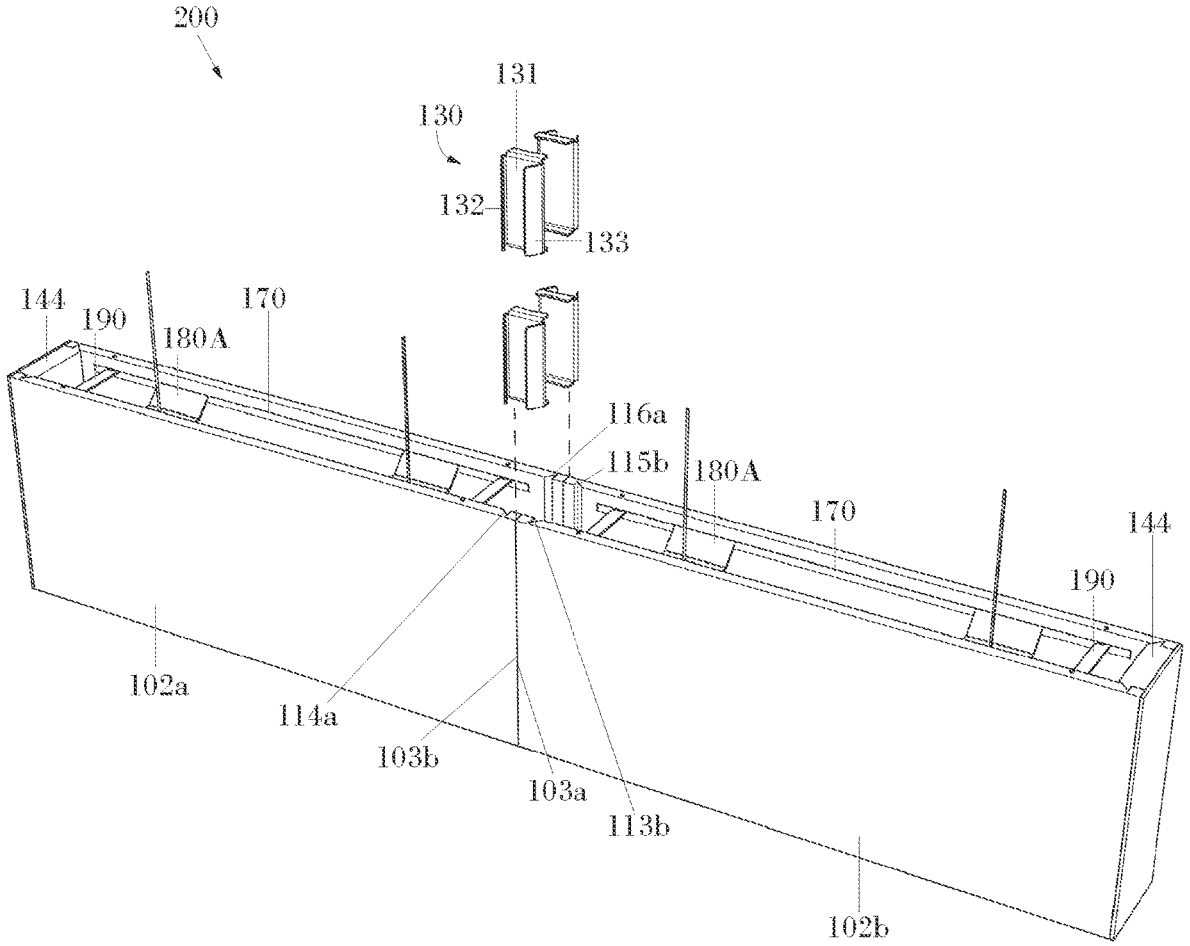
FIG. 13 is a top, front, right perspective view of an additional architectural fixture shown in engagement with a second beam embodying the invention.
Figure 14:
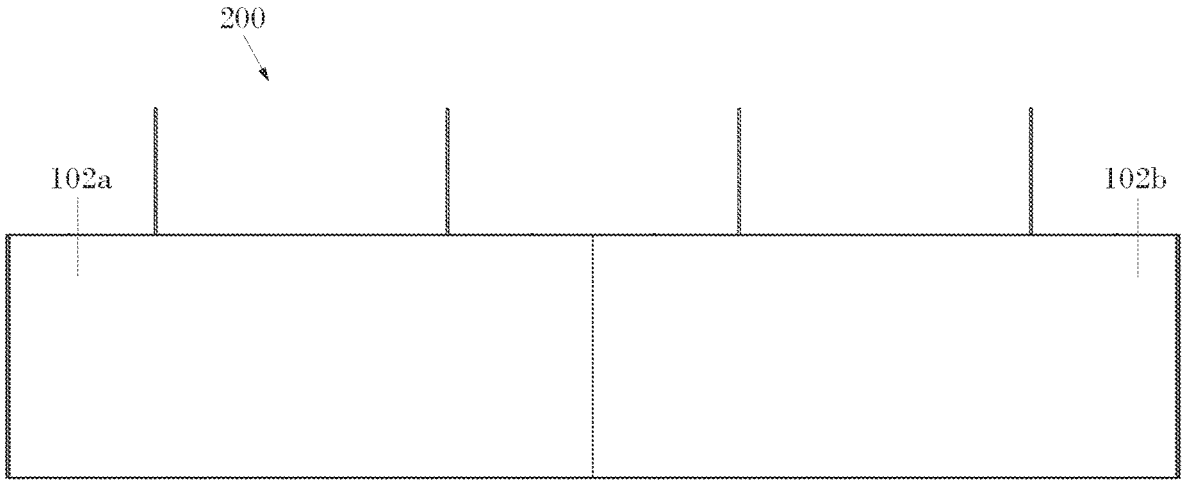
FIG. 14 is a front side elevation view of an architectural fixture shown in engagement with a second beam of FIG. 13.
Figure 15:
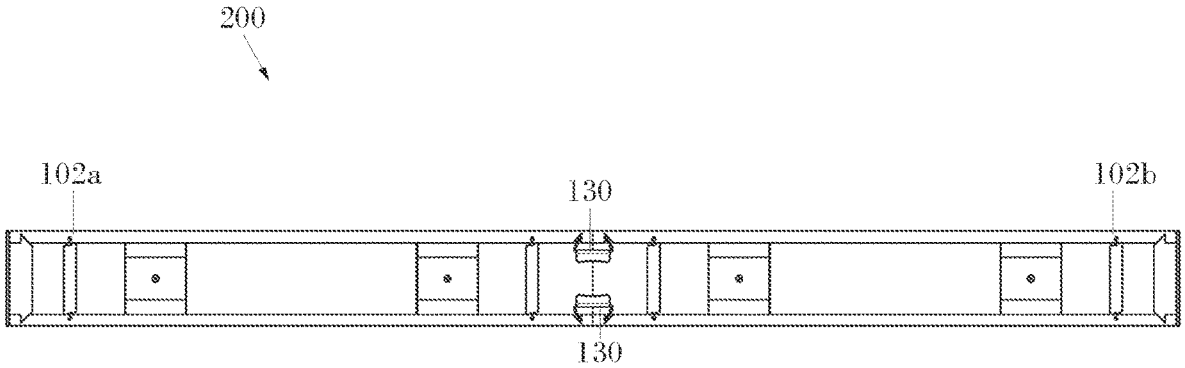
FIG. 15 is a top plan view of an architectural fixture shown in engagement with a second beam of FIG. 13.
Figure 16A:
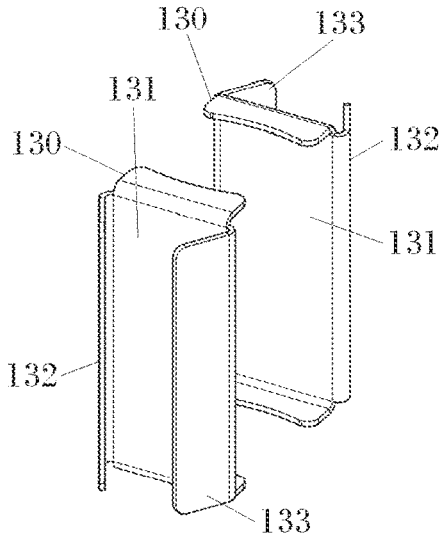
FIG. 16A is a perspective view of two joiner brackets as may be used in the architectural fixture of FIG. 13.
Figure 16B:
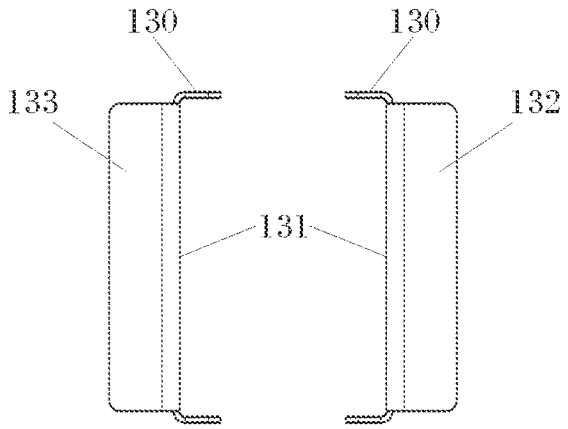
FIG. 16B is a right side view of the two joiner brackets of FIG. 16A.
Figure 16C:
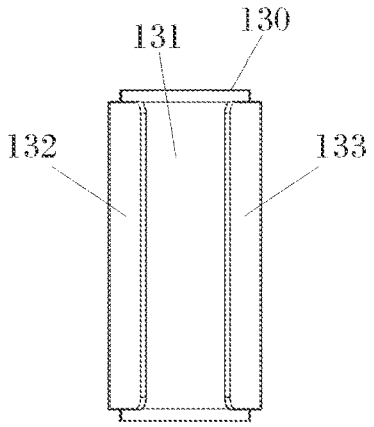
FIG. 16C is a front side view of the two joiner brackets of FIG. 16A.
Figure 16D:
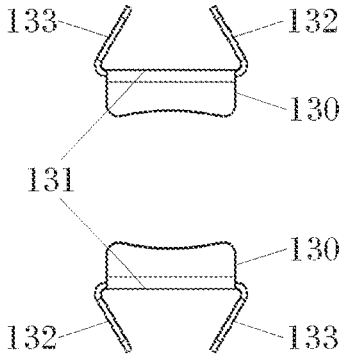
FIG. 16D is a top plan view of the two joiner brackets of FIG. 16A.

Referring to FIGS. 13-15, another embodiment of an architectural fixture 200 is illustrated. The architectural fixture 200 comprises two U-shaped beams 102*a*, 102*b* coupled together in a side-by-side manner. The two U-shaped beams 102*a*, 102*b* are identical to the U-shaped beams of FIGS. 1-12, utilizing the attachment bracket 180A of FIGS. 1-3. In this embodiment, the two U-shaped beams 102*a*, 102*b* are attached together with a pair of joiner brackets 130. In particular, the first U-shaped beam 102*a* comprises a first end 103*a* and the second U-shaped beam 102*b* comprises a second end 103*b*. In this variation, the connection keys 144 are not positioned at the first end 103*a* of the first U-shaped beam 102*a* or at the second end 103*b* of the second U-shaped beam 102*b*. Thus, the cavities 105 of each of the beams 102*a*, 102*b* are only bounded on one end of each of the beams 102*a*, 102*b*.

Figure 13A:
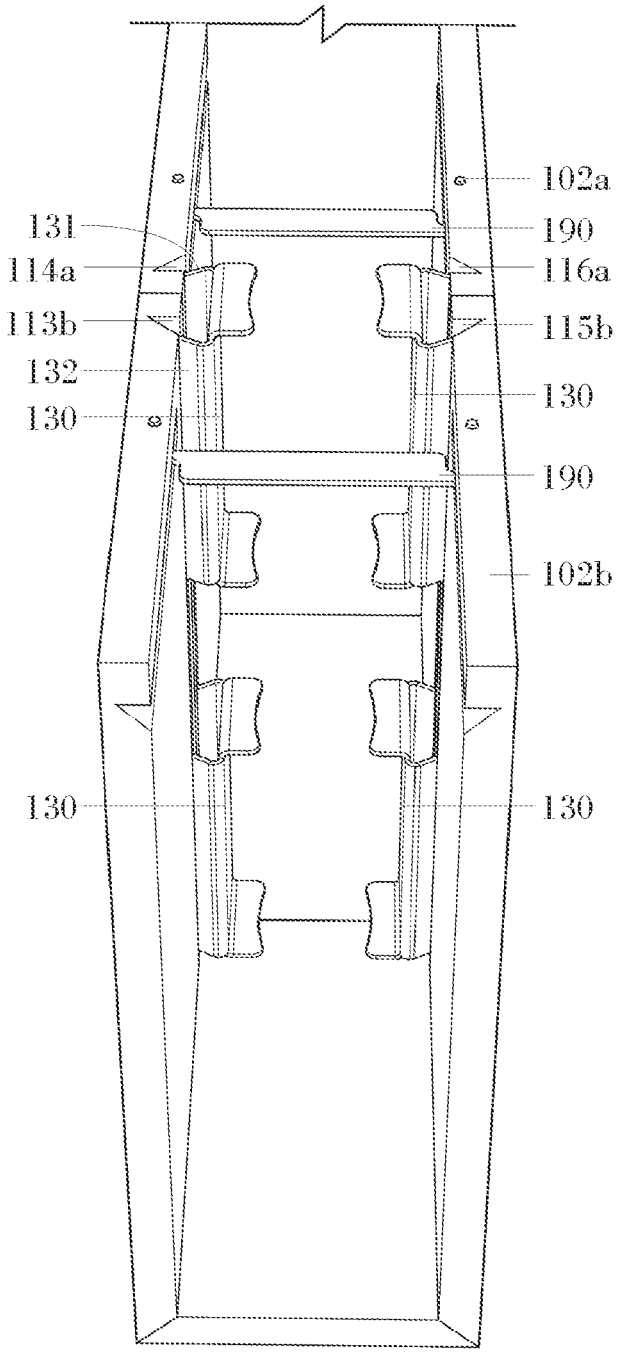
FIG. 13A illustrates the architectural fixture of FIG. 13 whereby the two beams are coupled together by joiner brackets.

As illustrated in FIGS. 16A-D, the joiner brackets 130 each comprise a body portion 131, a first flange 132 located along a first edge of the body portion 131, and a second flange 133 located along a second edge of the body portion 131. The first and second flanges 132, 133 are elongated in a vertical direction. The joiner brackets 130 are coupled to the two U-shaped beams 102*a*, 102*b* within the notches 114*a*, 116*a*, 113*b*, 115*b* that were previously described as being used for coupling the connection keys 144. That is, a first one of the joiner brackets 130 is positioned so that the first flange 132 nests within the notch 114*a* of the first U-shaped beam 102*a* and the second flange 133 nests within the notch 113*b* of the second U-shaped beam 102*b*. Similarly, a second one of the joiner brackets 130 is positioned so that the first flange 132 nests within the notch 116*a* of the first U-shaped beam 102*a* and the second flange 133 nests within the notch 115*b* of the second U-shaped beam 102*b*. In this way, the joiner brackets 130 hold the first and second U-shaped beams 102*a*, 102*b* into the adjacent side-to-side position due to their engagement with the various notches as described herein. The joiner brackets 130 apply pressure onto the notches 113-116 to hold the two U-shaped beams 102 together. As shown in FIG. 13A, there may be four of the joiner brackets 130 used to attach to the two U-shaped beams 102*a*, 102*b* in some embodiments. Alternatively, the joiner brackets 130 may be made longer to achieve a more secure attachment between the two U-shaped beams. Greater or fewer joiner brackets 130 may be used to couple beams 102 as desired.

Figure 17:
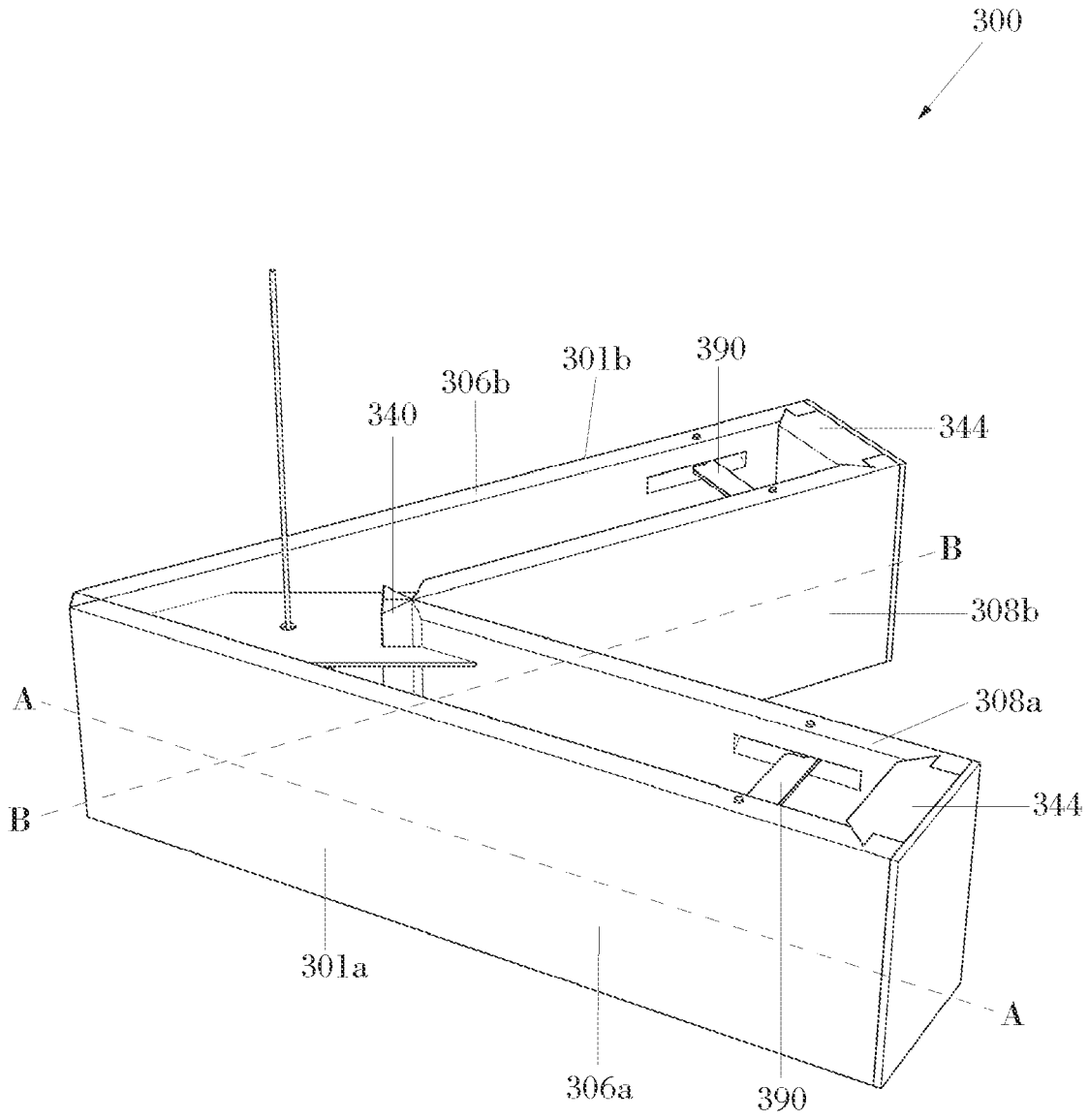
FIG. 17 is a top, front, right perspective view of an additional architectural fixture embodying the invention wherein two beams meet at an angle.
Figure 17A:
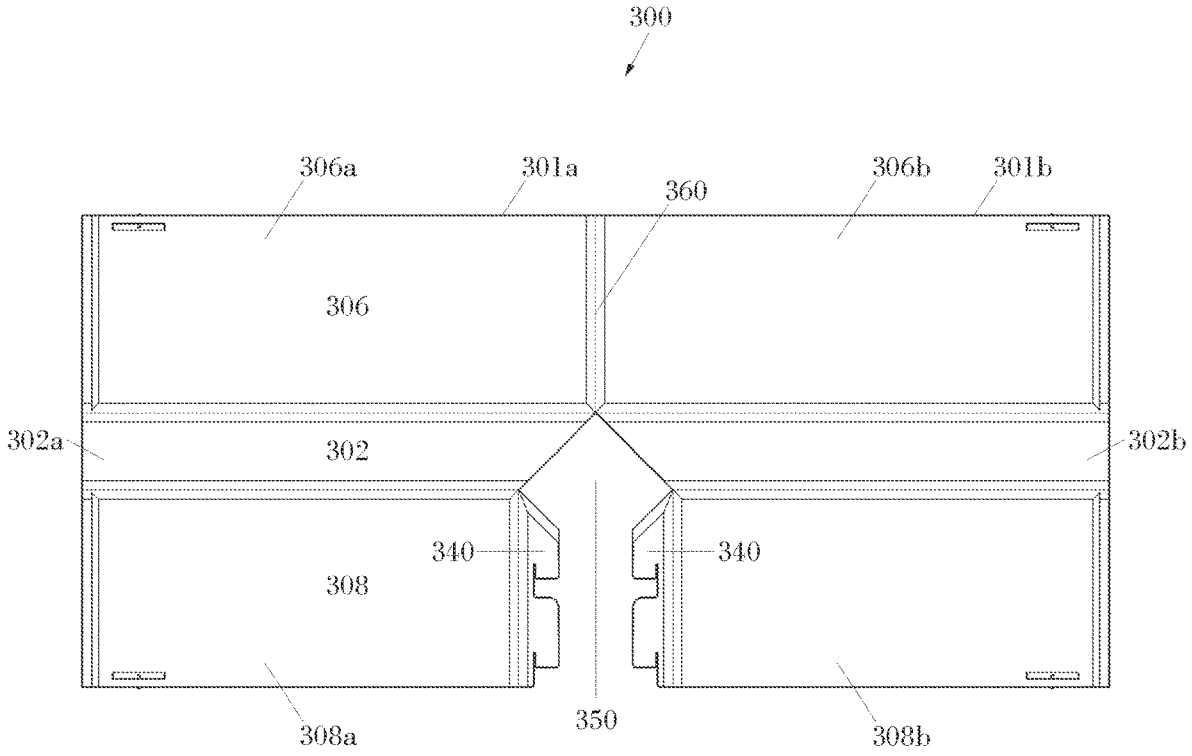
FIG. 17A is a top plan view of the beams of FIG. 17 in an unfolded state.

Referring to FIGS. 17-21D, an architectural fixture 300 is illustrated in accordance with another embodiment. The architectural fixture 300 comprises a first beam 301*a* and a second beam 301*b*. The fixture 300 is alterable from an unfolded configuration as shown in FIG. 17A to a folded configuration as shown in FIG. 17. Thus, the beams 301*a*, 301*b* of the architectural fixture 300 are not formed by coupling multiple components together, but are instead a monolithic structure formed by folding a flat panel. The beams 301*a*, 301*b* are formed as a single, integrally formed, unitary, monolithic sheet. Thus, the beams 301*a*, 301*b* are formed of a single piece of material. The architectural fixture 300 is formed as two beams 301*a*, 301*b* that intersect at an angle. A first longitudinal axis A-A extends along the beam 301*a*, while a second longitudinal axis B-B extends along the beam 301*b*. The angle between the two beams 301*a*, 301*b* is an angle defined by the internal corner formed by the intersection of the two beams 301*a*, 301*b*. The angle may be acute or obtuse, and may be substantially any angle. For instance, the angle may be 60 degrees or less. Alternately, the angle may be 90 degrees or may be 137 degrees or greater. Various exemplary angles are illustrated in FIG. 21C.

Referring to FIG. 17A, when unfolded the architectural fixture 300 comprises a bottom wall portion 302 which comprises a first bottom wall 302*a* and a second bottom wall 302*b* that are separated by a V-shaped recess 350. A first sidewall 306 extends from a first end of the bottom wall portion 302 and a second sidewall 308 extending from a second end of the bottom wall portion 302. The first sidewall 306 is divided into two portions 306*a*, 306*b* by a folding line 360. The first portion 306*a* of the first sidewall 306 is connected to the first bottom wall 302*a* and the second portion 306*b* of the first sidewall 306*b* is connected to the second bottom wall 302*b*. The second sidewall 308 comprises a first portion 308*a* and a second portion 308*b* that are separated from one another.

Figure 17B:
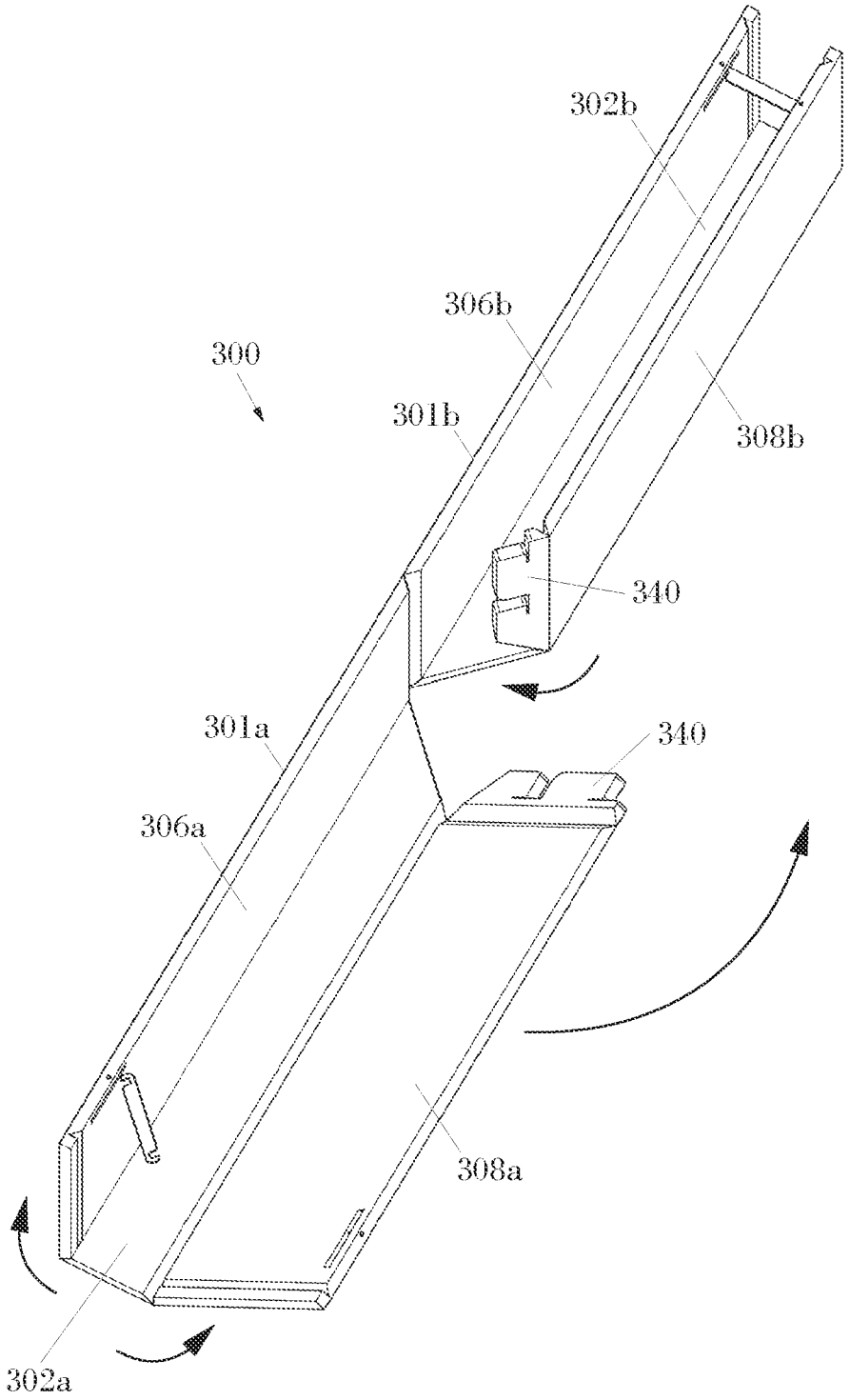
FIG. 17B is perspective view of the beams of FIG. 17 in a partially folded state.
Figure 18:
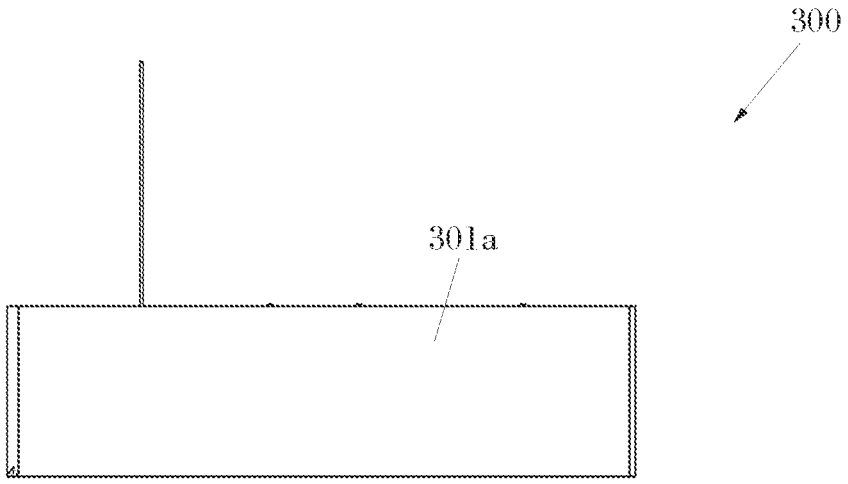
FIG. 18 is a front side elevation view of the beams of FIG. 17.
Figure 19:
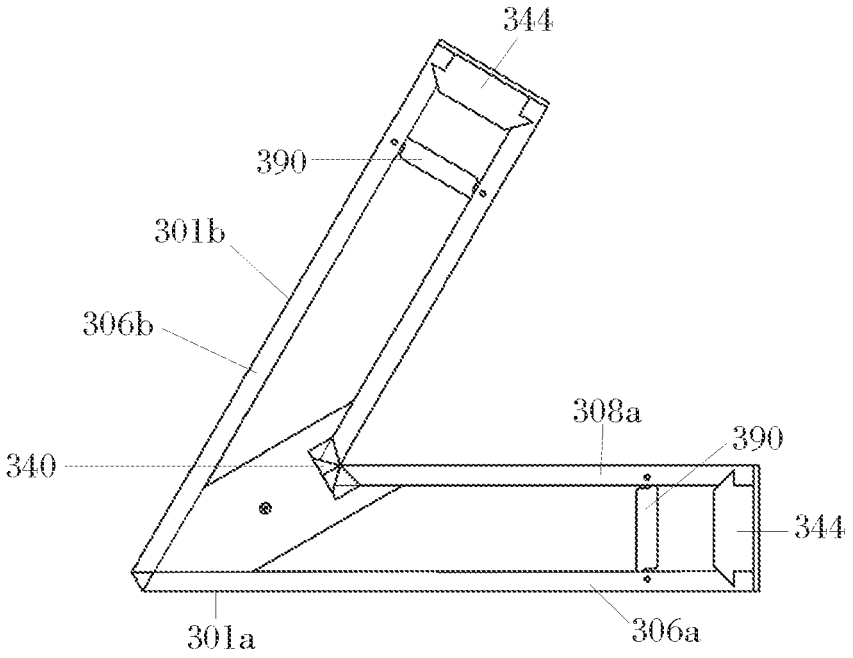
FIG. 19 is a top plan view of the beams of FIG. 17.

The first and second portions 308*a*, 308*b* of the second sidewall 308 comprise tabs 340 on their ends which face each other. FIG. 17B illustrates the fixture 300 in a partially folded state between the unfolded state of FIG. 17A to the folded state of FIG. 17. The first and second portions 306*a*, 306*b* of the first sidewall 306 are folded about the fold line that exists between the first sidewall 306 and the bottom wall portion 302. The first and second portions 308*a*, 308*b* of the second sidewall 308 are folded relative to the bottom wall portion 302. Next, the first sidewall 306 is folded about the folding line 360 which closes the V-shaped recess and brings the tabs 340 along the ends of the first and second portions 308*a*, 308*b* of the second sidewall 308 near to each other so that they can be coupled together. Securing elements 390 that are the same as the securing elements 190 can then be used to maintain the architectural fixture 300 in the folded configuration. The architectural fixture includes notches that allow for coupling of connection keys 344 (which are identical to the connection keys 144 described above)

Figure 20:
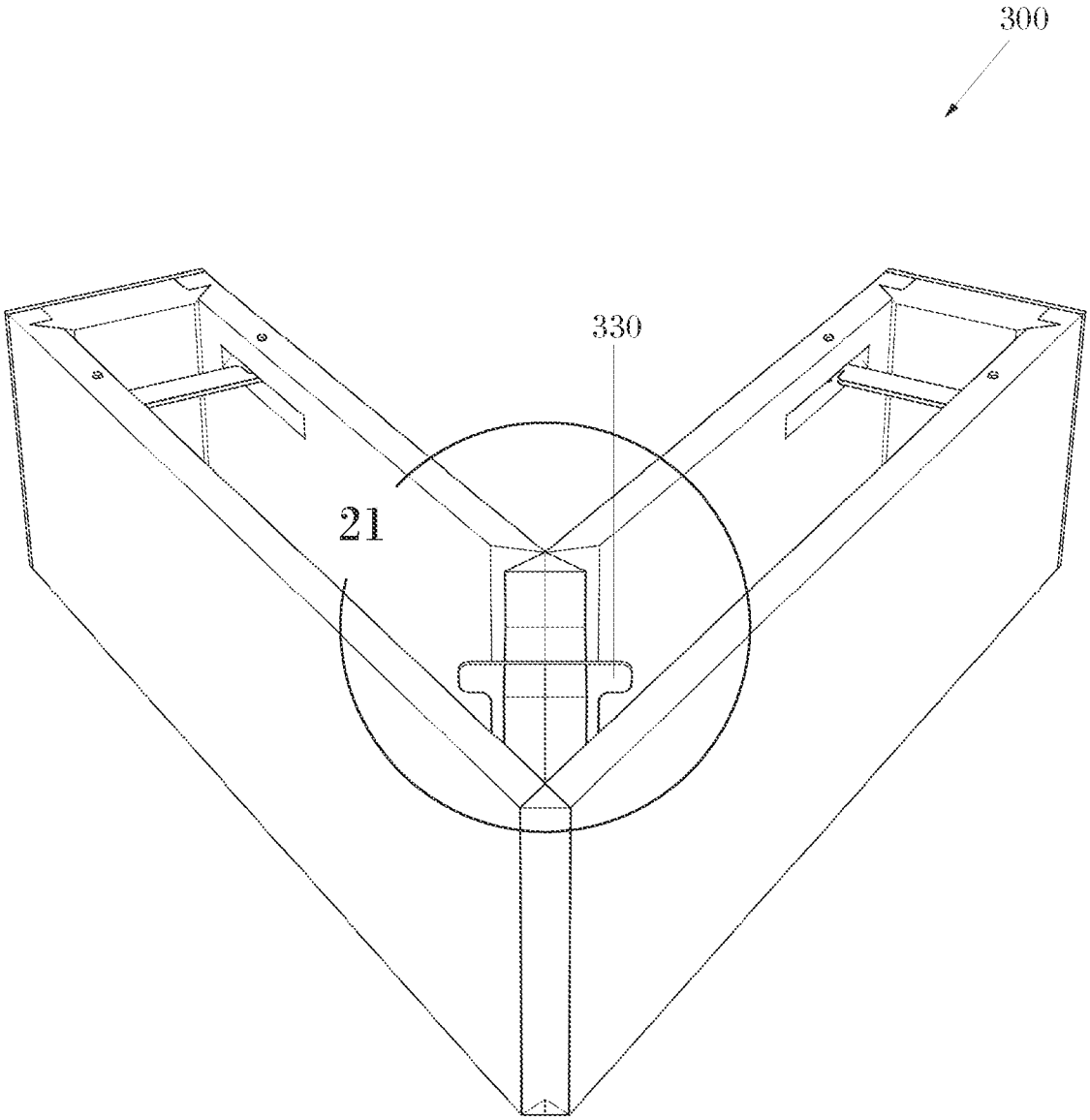
FIG. 20 is a perspective view of the beams of FIG. 17 showing the meeting of the two beams.
Figure 21:
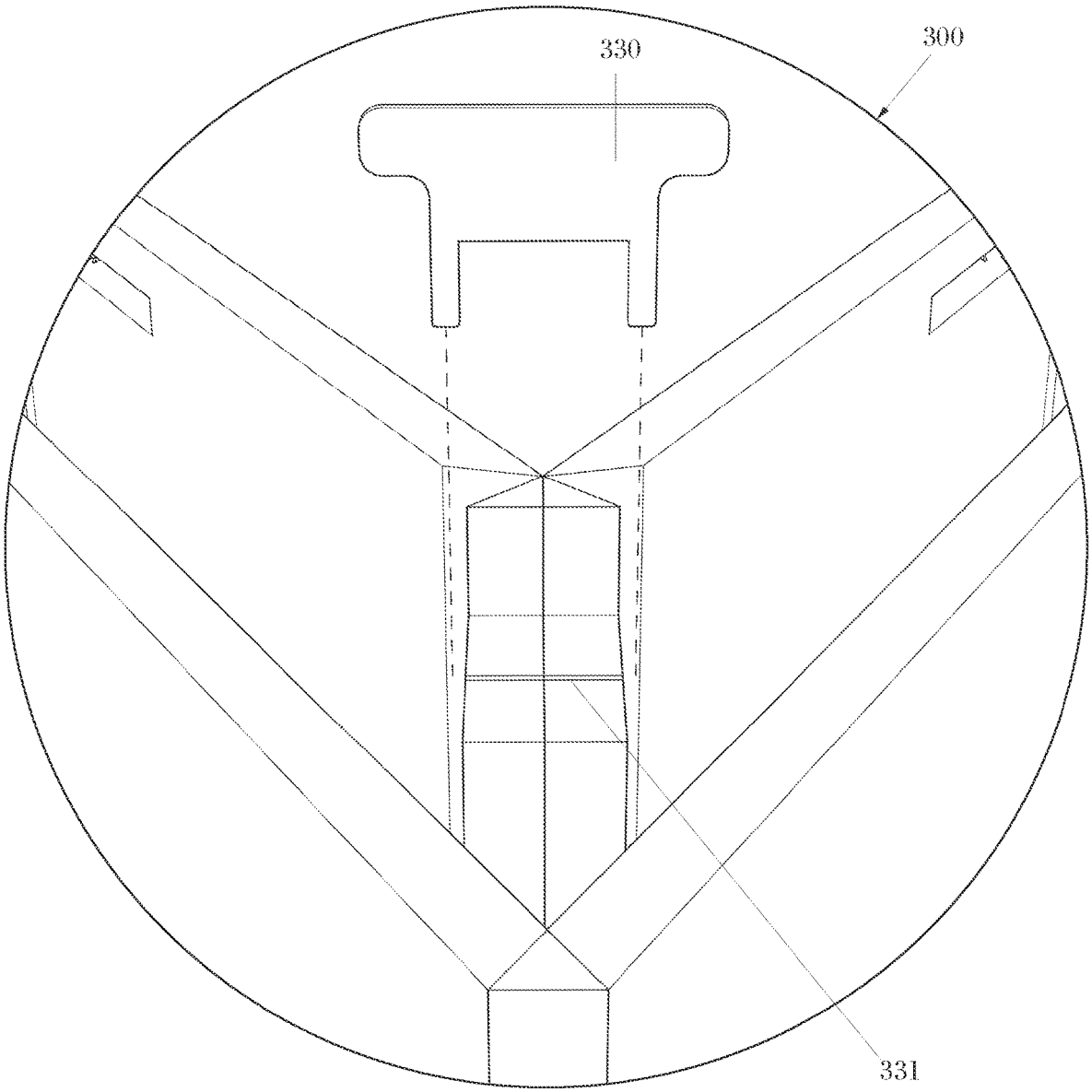
FIG. 21 is a detail view showing a securing element for assembling the two beams.
Figure 21B:
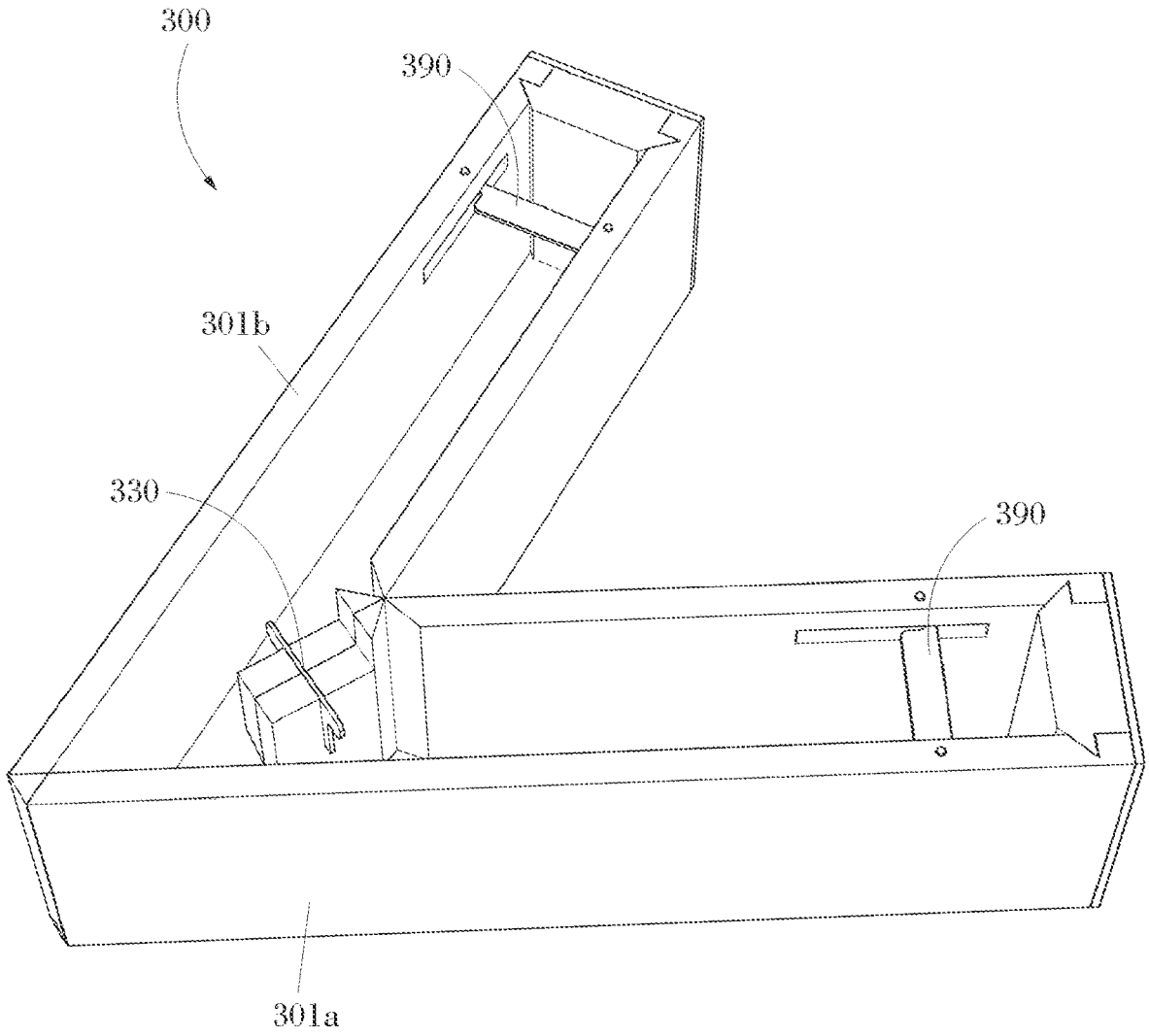
FIG. 21B is a top perspective view of the beams of FIG. 17.
Figure 21C:
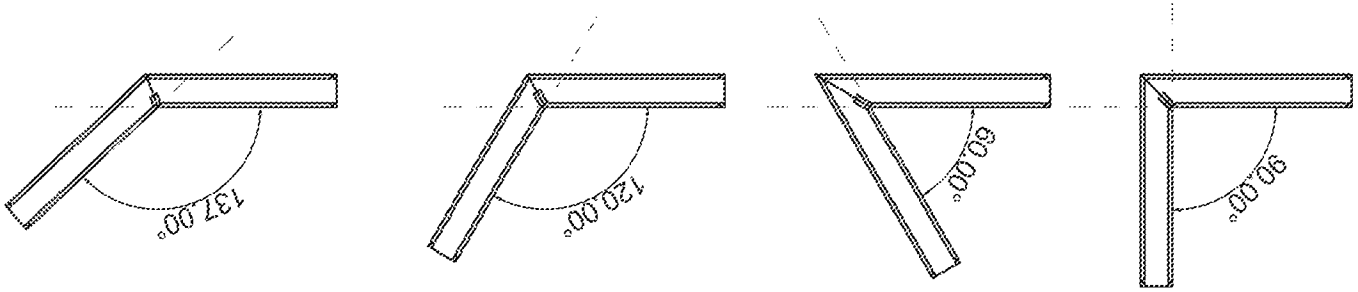
FIG. 21C is an illustration showing different angled configurations for the architectural fixture of FIG. 17.
Figure 21D:
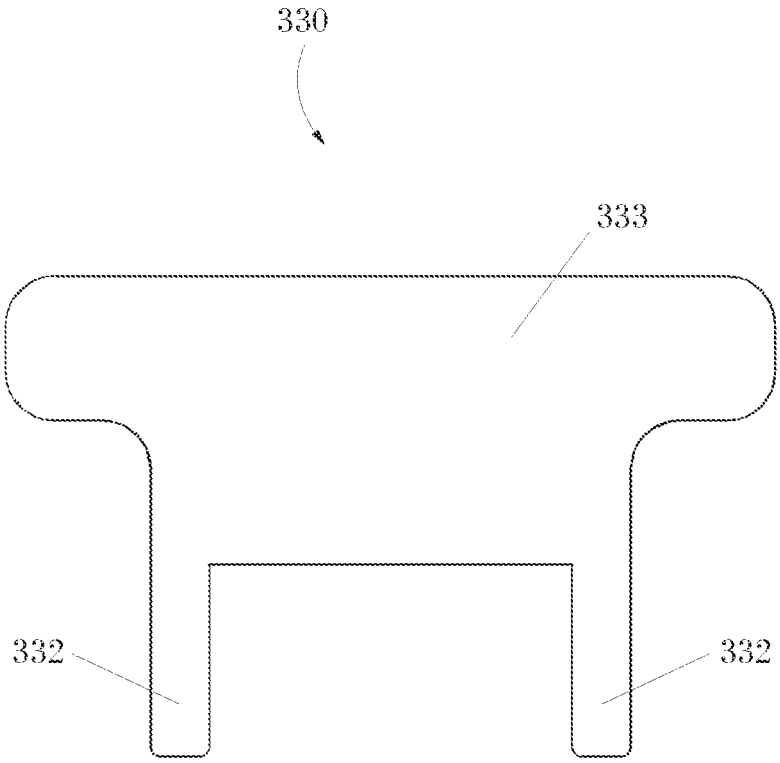
FIG. 21D is a side view showing the securing element of the architectural fixture of FIG. 17.

FIGS. 20, 21, and 21D illustrate an additional securing element 330 which may be used with the architectural fixture 300. The securing element 330 is a plate that slides into a notch 331 between the tabs/flaps 340 to hold or maintain the angle of the architectural fixture 300. FIG. 21B is a view of the architectural fixture 300 with the securing element 330 and the securing elements 190 helping to hold the architectural fixture 300 in the folded configuration. FIG. 21C illustrates different configurations to which the architectural fixture 300 may be folded in different embodiments. FIG. 21D illustrates the securing element 330. The securing element 330 has a base portion 333 and two fingers 332. The base portion 333 is configured for grasping by a user and fits within the notch 331, while the fingers 332 extend beyond the notch 331 and engage the tabs 340 to prevent separation of the tabs 340. As can be seen, each of the tabs 340 has two notches 331 but greater or fewer notches 331 may be formed and all notches 331 need not receive a securing element 330.

Figure 22:
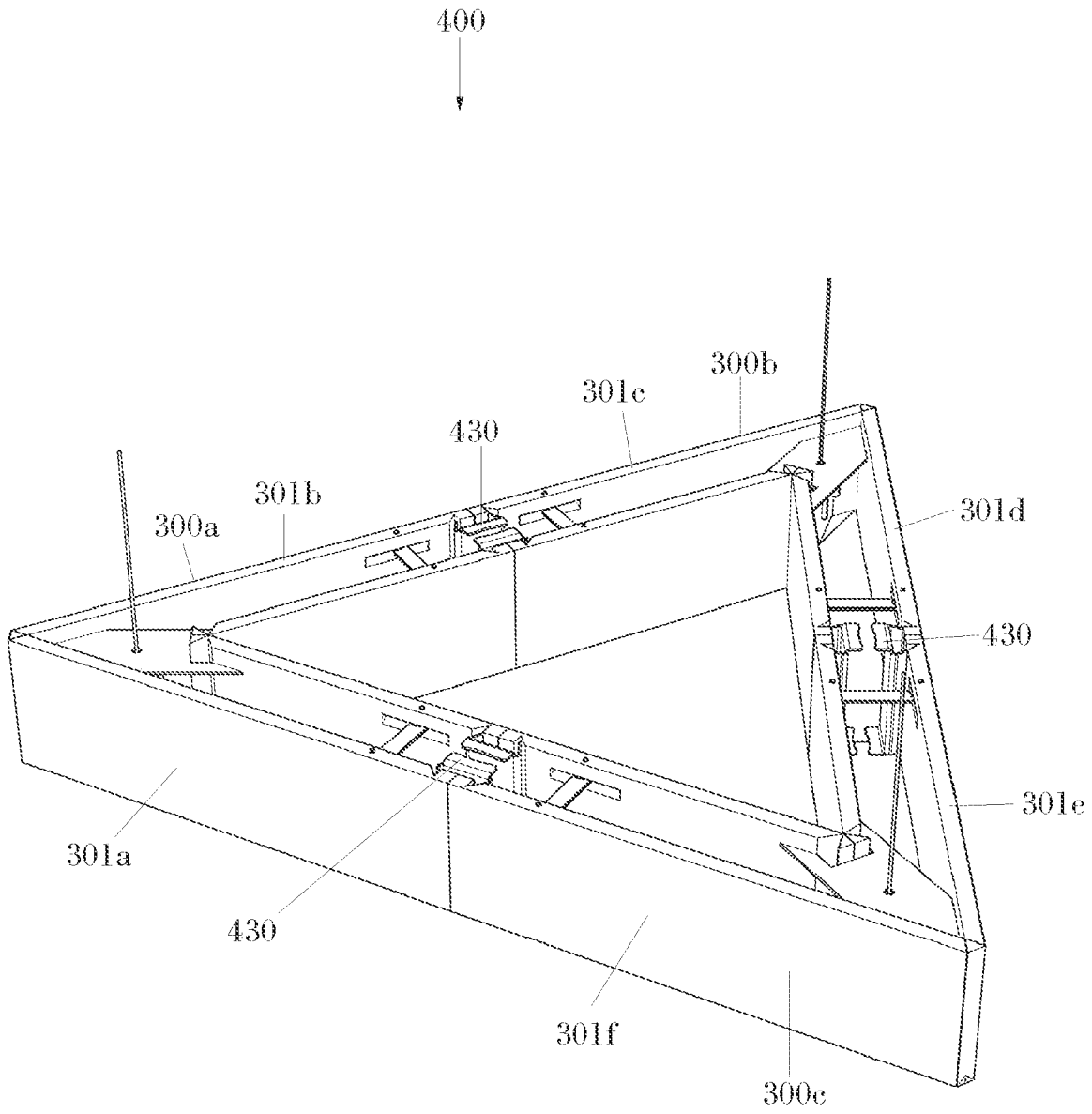
FIG. 22 is a top, front, right perspective view of an additional architectural fixture embodying the invention wherein the beams are configured to form a triangle-like shape.
Figure 23:
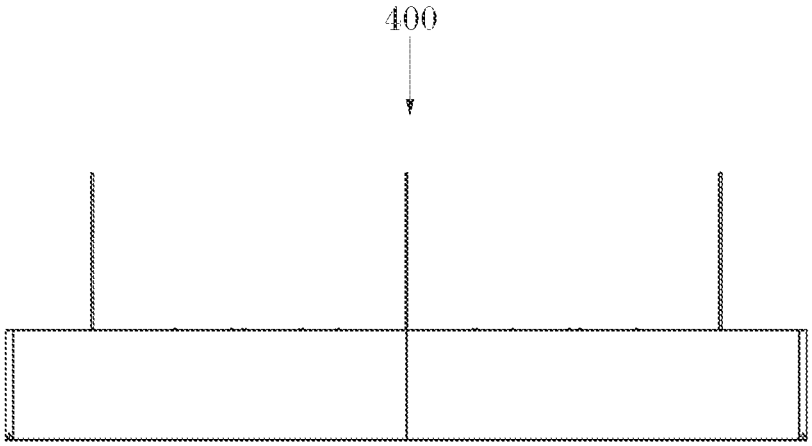
FIG. 23 is a front side elevation view of the beams of FIG. 22.
Figure 24:
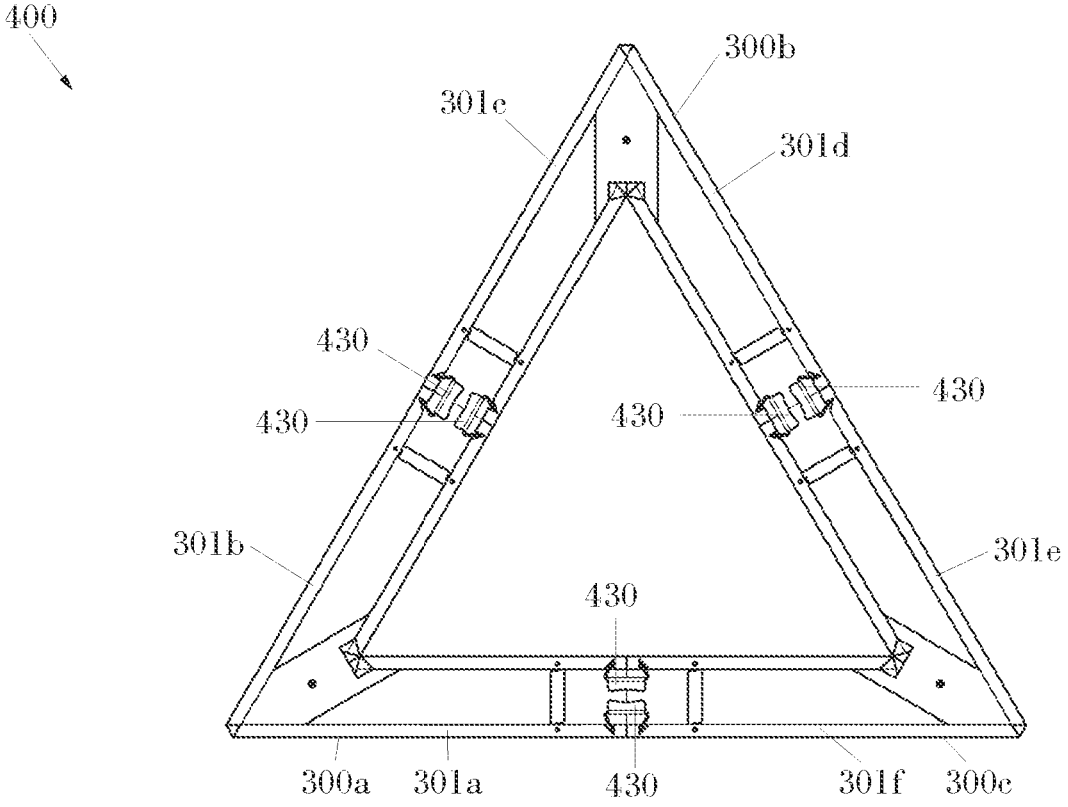
FIG. 24 is a top plan view of the beams of FIG. 22.

Referring to FIGS. 22-24, an architectural fixture 400 is illustrated in accordance with another embodiment of the present invention. The architectural fixture 400 comprises three separate architectural fixtures 300, with architectural fixtures 300*a-c* attached together to form the architectural fixture 400. The architectural fixtures 300*a-c* are identical to the architectural fixture 300 described above with reference to FIGS. 17-21D. For the architectural fixture 400, beams 301*a-f* are attached together at their ends with joiner brackets 430. The joiner brackets 430 are identical to the joiner brackets 130 described above. That is, the beams 301*a-f* comprise notches that interact with flanges of the joiner brackets 430 to facilitate the coupling of the beams 301*a-f* together. Remaining features of the architectural fixture 400 are the same as features previously described and therefore they are not described herein in the interest of brevity. However, the similar features can be readily identified by viewing and comparing the figures.

Figure 25:
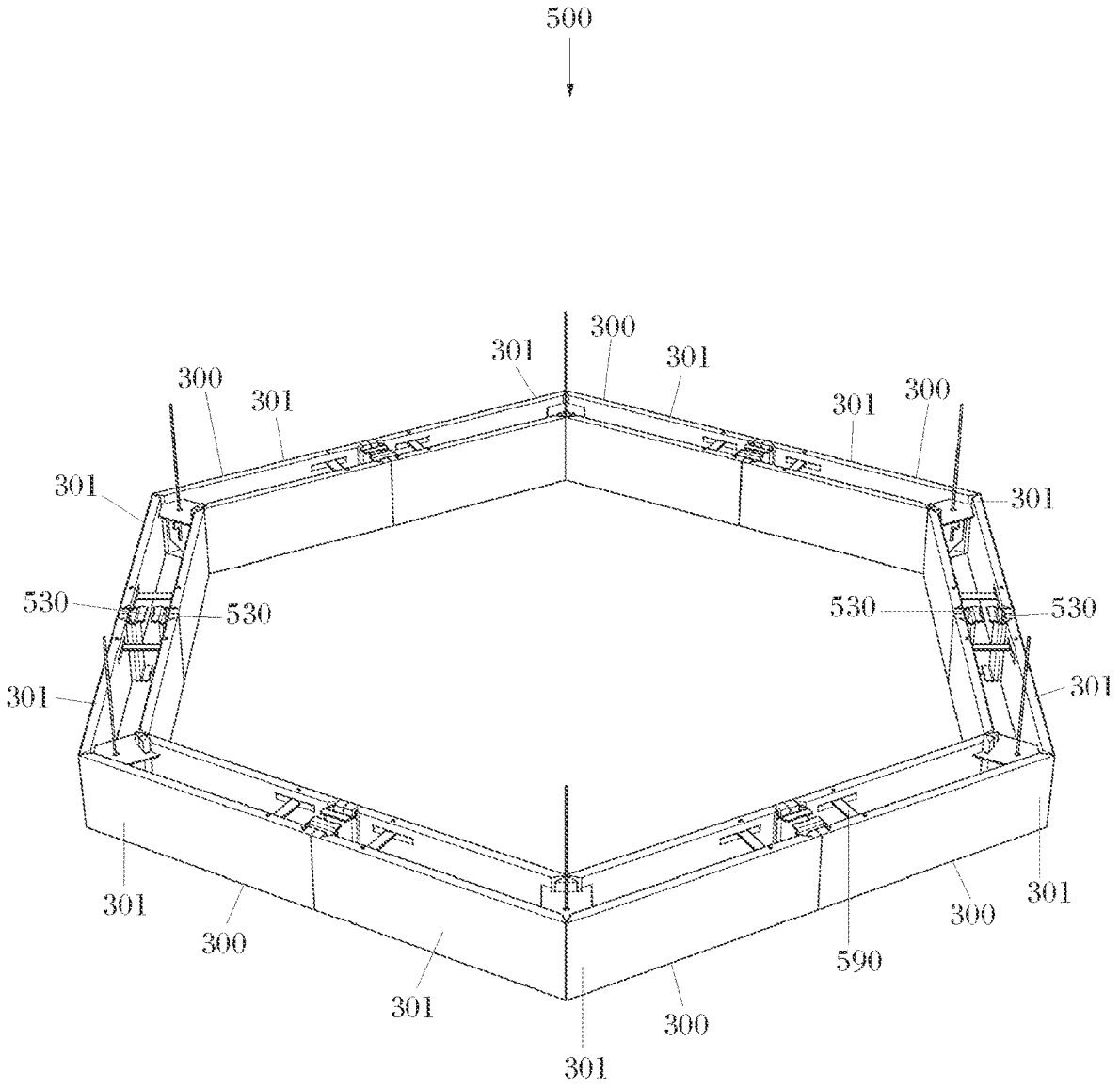
FIG. 25 is a top, front, right perspective view of an additional architectural fixture embodying the invention wherein the beams are configured to form a hexagon-like shape.
Figure 26:
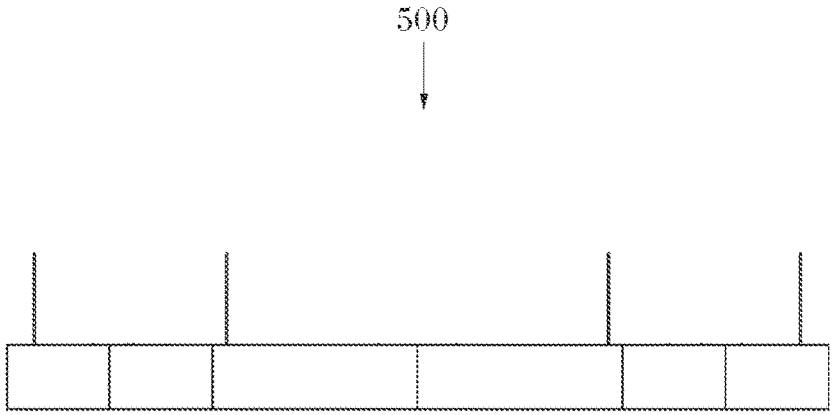
FIG. 26 is a front side elevation view of the beams of FIG. 25.
Figure 27:
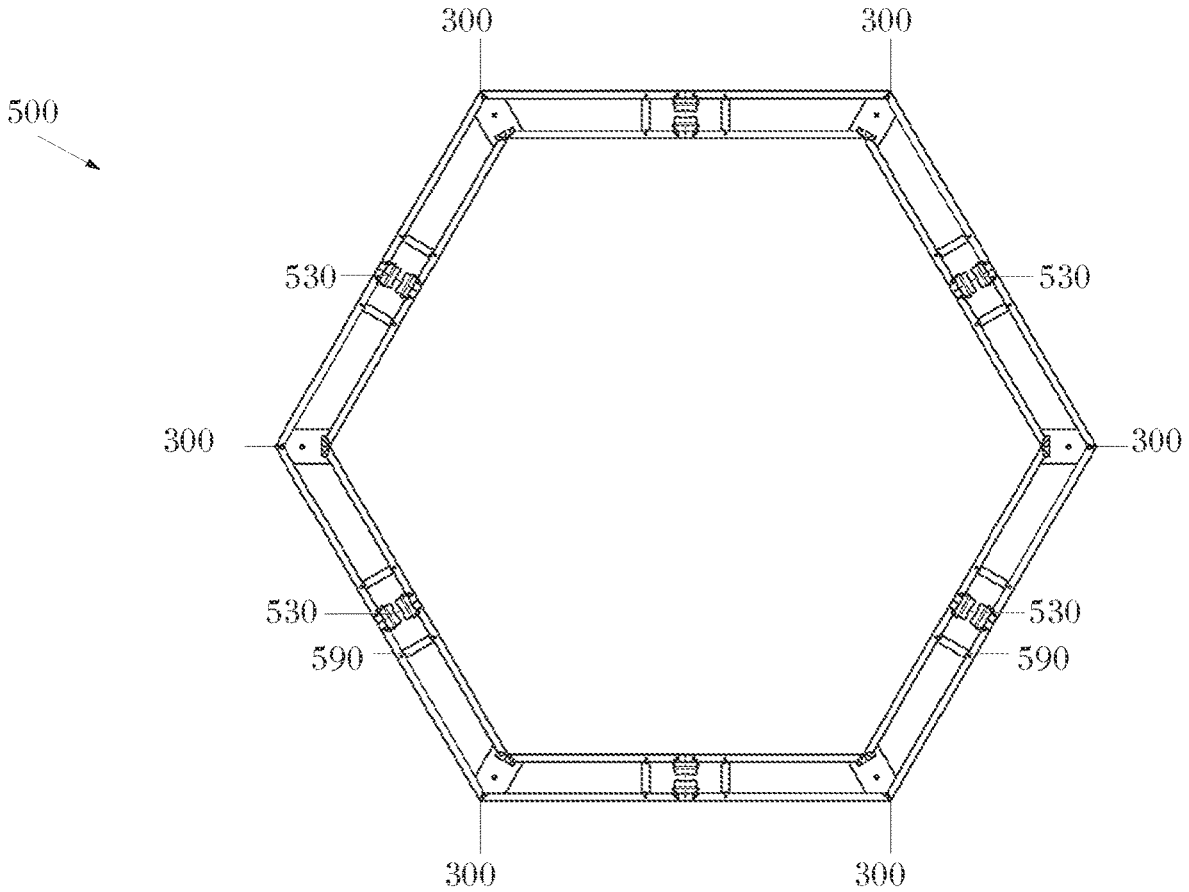
FIG. 27 is a top plan view of the beams of FIG. 25.

Referring to FIGS. 25-27, an architectural fixture 500 is illustrated in accordance with yet another embodiment of the present invention. The architectural fixture 500 comprises six of the architectural fixtures 300 described above with reference to FIGS. 17-21D. However, the beams 301 have a different beam angle than the beams 301*a*, 301*b* described above with reference to FIGS. 17-21D. As noted and shown in FIG. 21C, the beams 301*a*, 301*b* may be bent at various different angles. Depending on the angle of the beams 301, a specific number of them may be arranged in a loop and coupled together to form an architectural fixture, such as the architectural fixture 500. Again, joiner brackets 530 (identical to the joiner brackets 130 previously described) and securing elements 590 (identical to the securing elements 190 previously described) may be used in the manner described above to maintain each of the beams 301 in their folded configuration and to facilitate the coupling of the adjacent beams 301 to one another.

Figure 28:
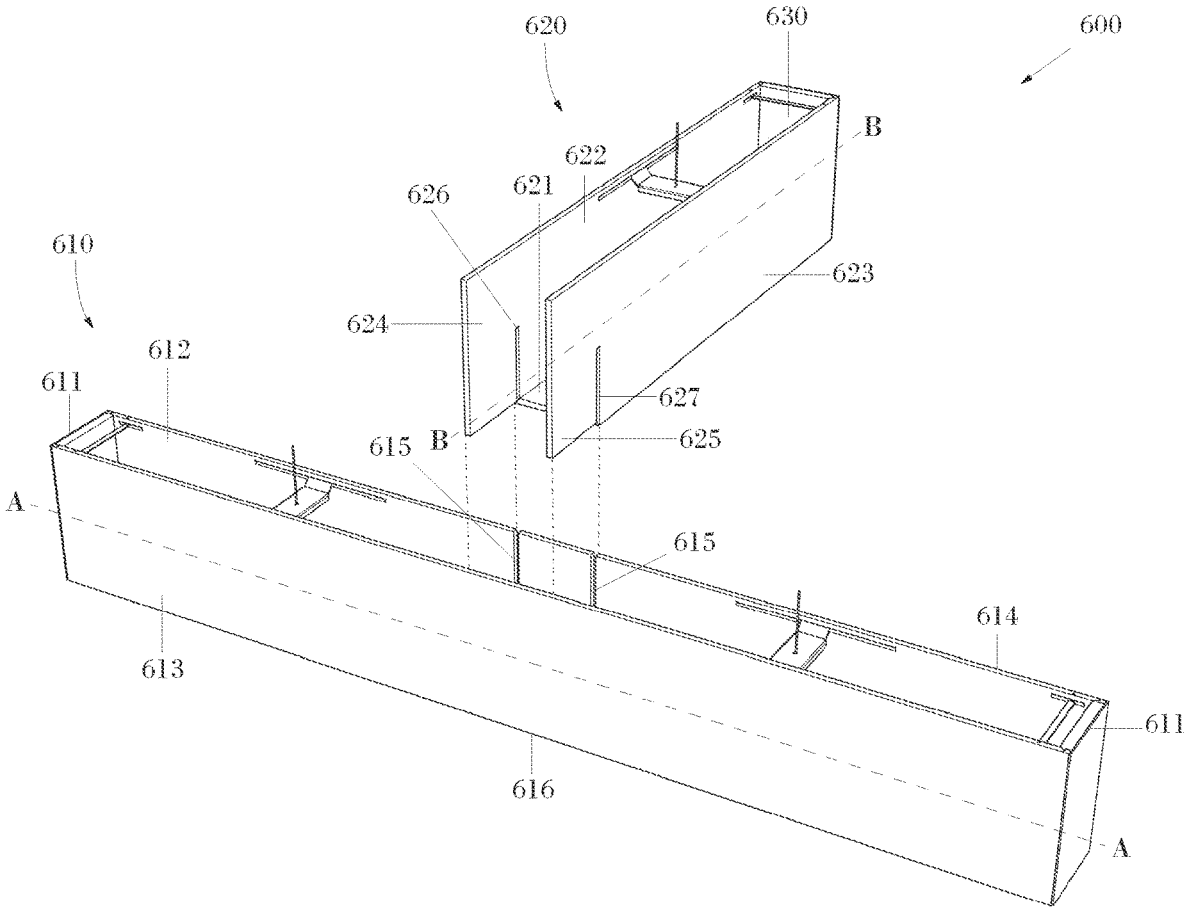
FIG. 28 is an exploded top, front, right perspective view of an additional architectural fixture embodying the invention wherein two beams are shown in engagement.
Figure 29:
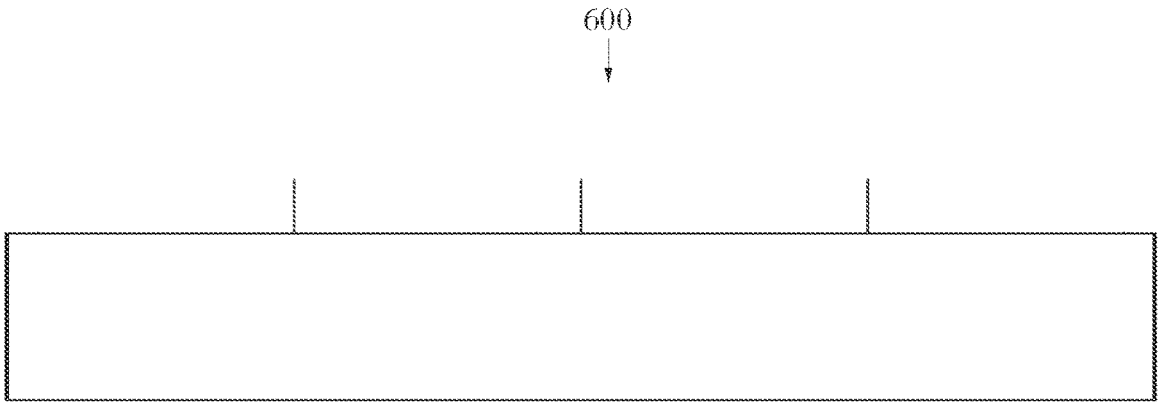
FIG. 29 is a front side elevation view of the beams of FIG. 28.
Figure 30:
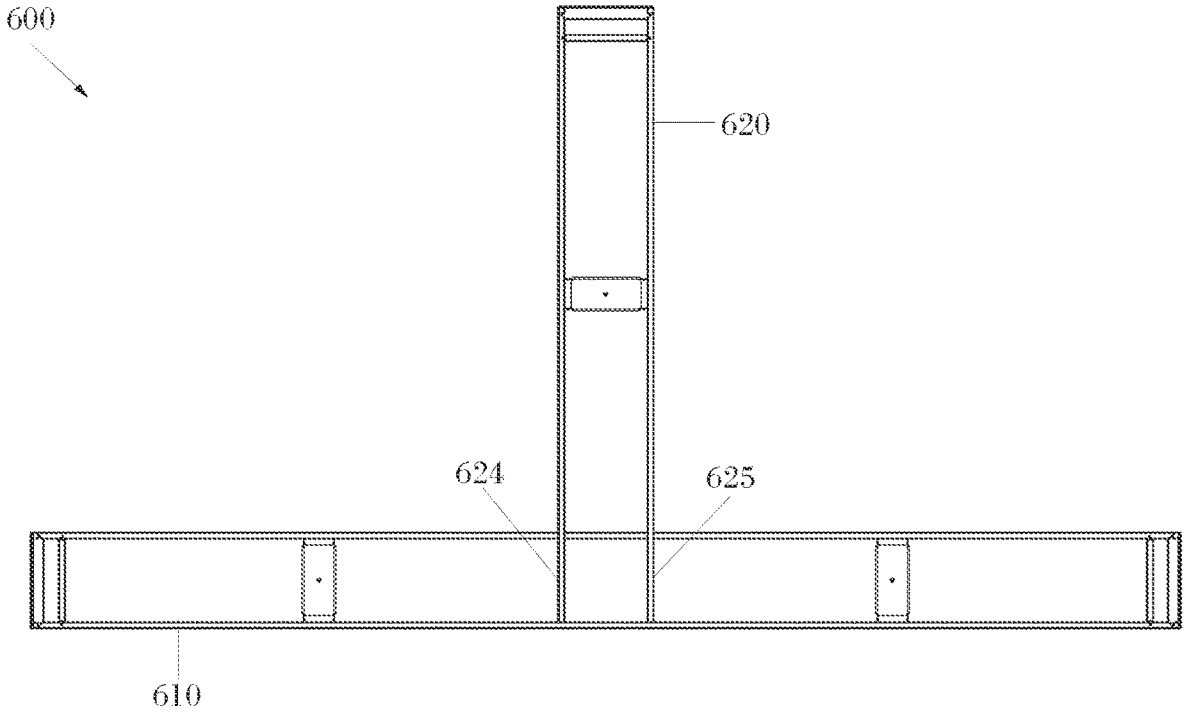
FIG. 30 is a top plan view of the beams of FIG. 28.
Figure 31:
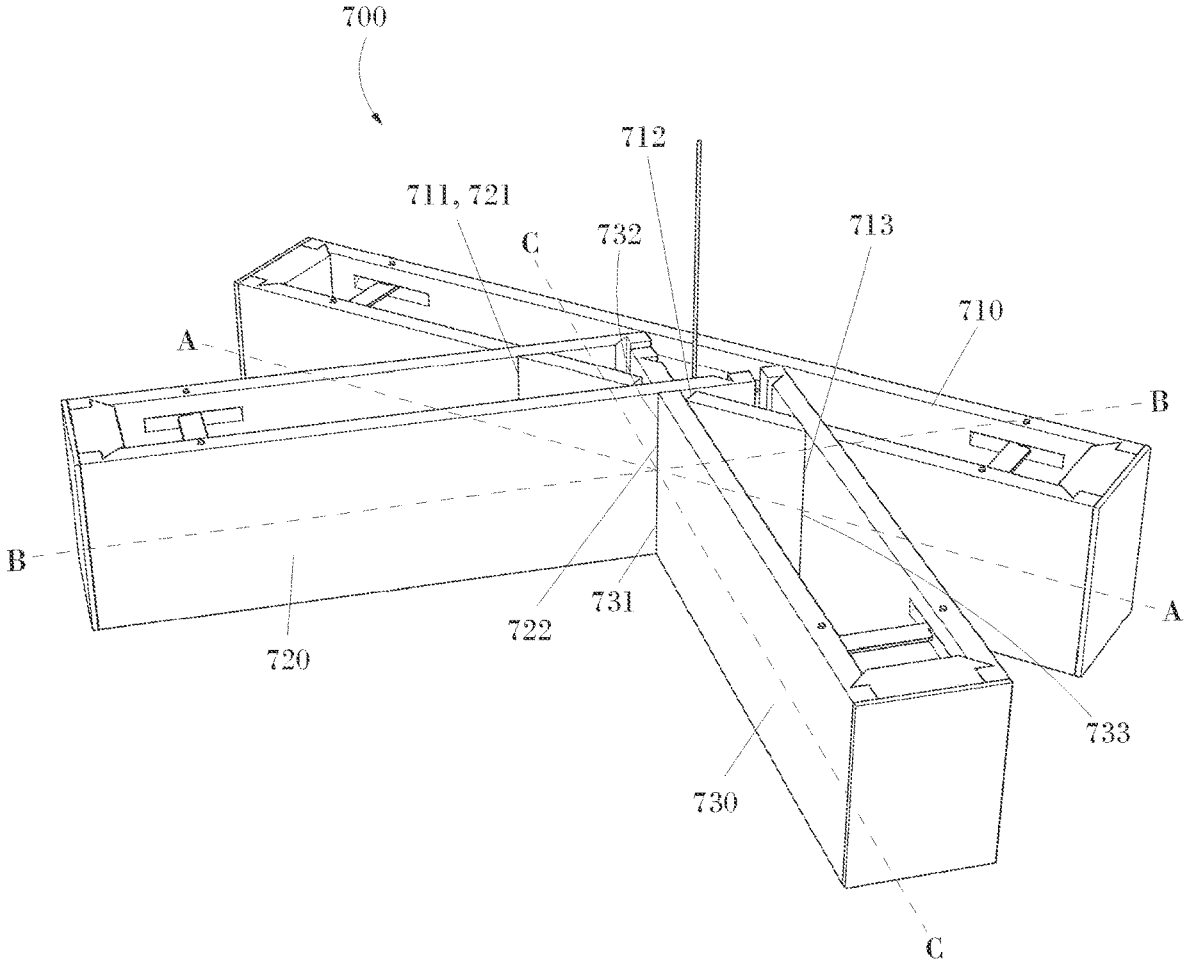
FIG. 31 is a top, front, right perspective view of an additional architectural fixture embodying the invention wherein three beams are shown in engagement.
Figure 31A:
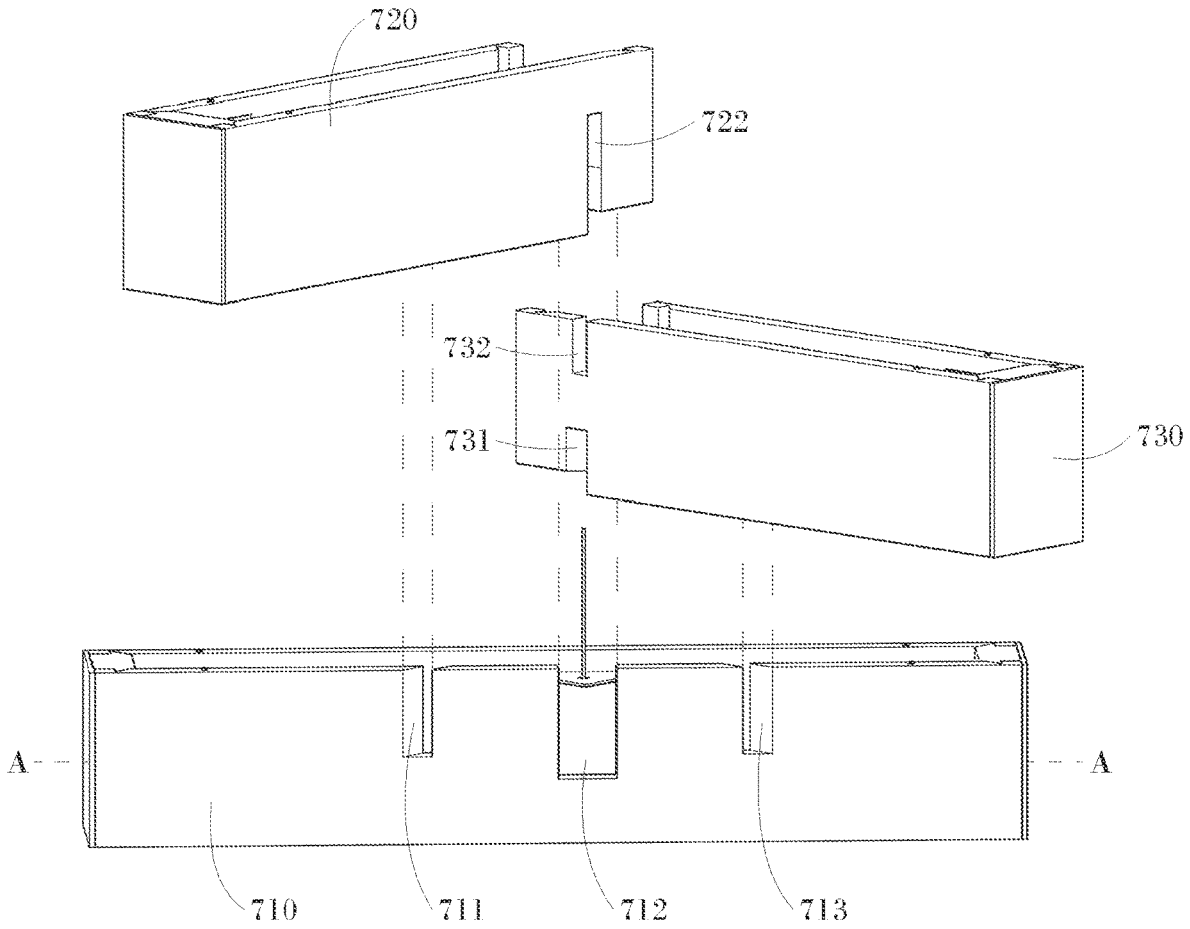
FIG. 31A is an exploded view of the architectural fixture of FIG. 31.
Figure 31B:
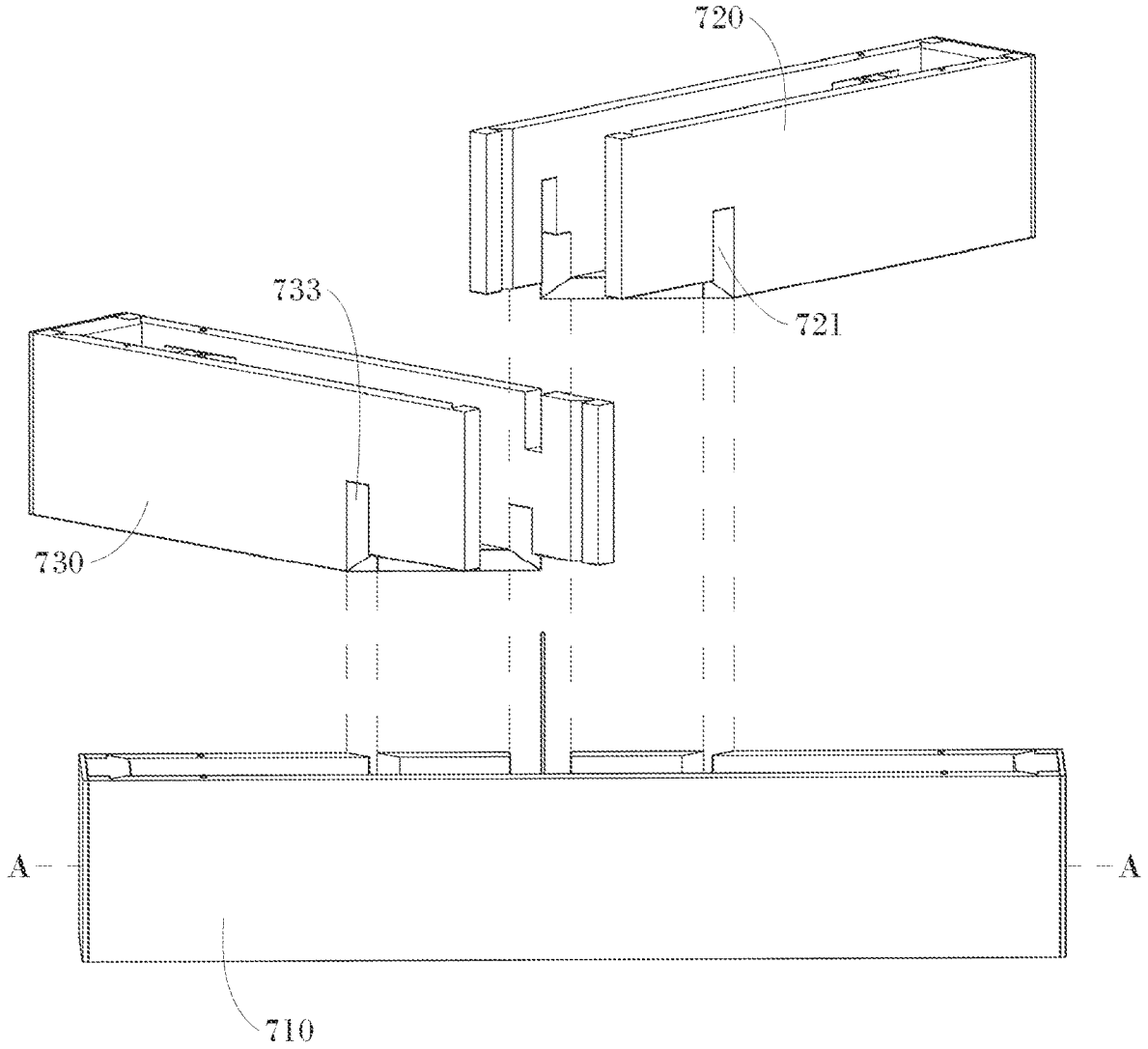
FIG. 31B is a second exploded view of the architectural fixture of FIG. 31.
Figure 32:
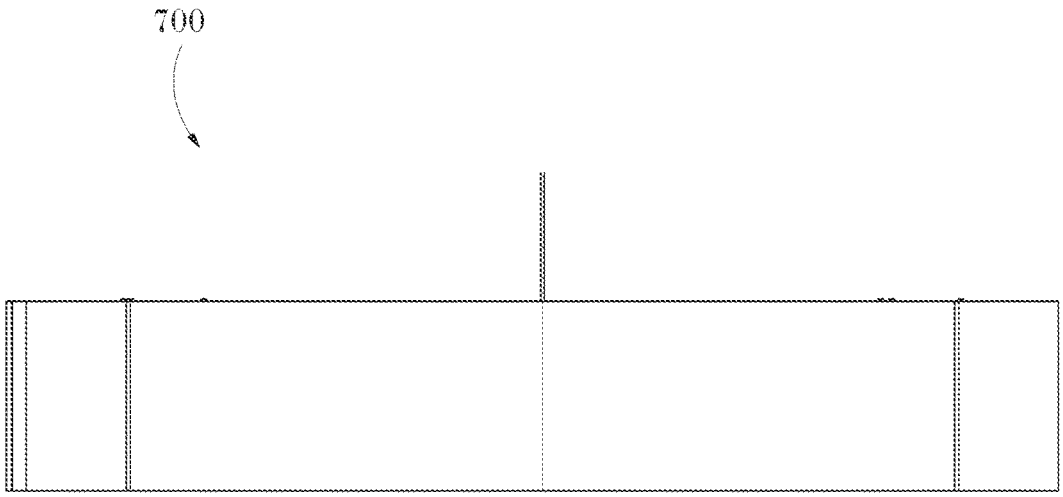
FIG. 32 is a front side elevation view of the beams of FIG. 31.

Referring to FIGS. 28-30, an architectural fixture 600 is illustrated in accordance with another embodiment of the present invention. The architectural fixture 600 comprises a first beam 610 and a second beam 620 that are configured to be coupled together in a T-shape. The first and second beams 610, 620 are both linearly elongated beams in the exemplified embodiment. The first beam 610 extends along a first longitudinal axis A-A while the second beam 620 extends along a second longitudinal axis B-B. The first beam 610 is much like the beam 102 shown in FIG. 1, and both of its ends are closed by a connection key 611. The first beam 610 comprises a first sidewall 612 and a second sidewall 613 that extend upwardly from a bottom wall portion 616. The first sidewall 612 terminates in a distal end 614. Furthermore, the first sidewall 612 comprises two elongated slots 615 that extend downwardly from the distal end 614 of the first sidewall 612 in a direction towards the floor portion. The two elongated slots 615 are spaced apart from one another by a predetermined distance.

The second beam 620 comprises a bottom wall portion 621, a first sidewall 622, and a second sidewall 623. The second beam 620 is closed at one end by an end wall 630, but remains open at the opposite end. The first sidewall 622 comprises an extension portion 624 that protrudes beyond the bottom wall portion 621 and the second sidewall 623 comprises an extension portion 625 that protrudes beyond the bottom wall portion 621. The extension portions 624, 625 are cantilevered from the bottom wall portion 621. A first elongated slot 626 is formed into the first extension portion 624 adjacent to where the first extension portion 624 meets the bottom wall portion 621. A second elongated slot 627 is formed into the second extension portion 625 adjacent to where the second extension portion 625 meets the bottom wall portion 621. Each of the first and second elongated slots 626, 627 extends upwardly from a lower edge of the first and second extension portions 625, 626, respectively. The first and second beams 610, 620 may be coupled together by mating the elongated slots 614, 615 of the first beam 610 with the elongated slots 626, 627 of the second beam 620, as indicated by the dashed line in FIG. 26. Thus, the first and second beams 610, 620 may be held together using friction only, or additional fasteners or brackets could be included to create a more secure attachment between the first and second beams 610, 620.

Referring to FIGS. 31-33A, an architectural fixture 700 is illustrated in accordance with an embodiment of the present invention. The architectural fixture 700 comprises three beams 710, 720, 730. The beam 710 comprises three elongated slots 711, 712, 713 along one of its sidewalls, each of the elongated slots 711, 712, 713 extending downwardly from a distal end of the sidewall. The elongated slots 711, 713 extend through the sidewall of the beam 710 at an oblique angle relative to a longitudinal axis A-A of the beam 710. The slot 712 is larger in width than the slots 711, 713 to receive parts of both of the beams 720 and 730.

The beam 730 extends along a longitudinal axis C-C and has three elongated slots 731, 732, 733. The elongated slot 731 extends from a lower edge of the beam 730 upwardly for less than half of the length of the beam 730. The slot 732 is aligned with the slot 731, but extends downwardly from an upper edge of the beam 730 for less than half of the length of the beam 730. Thus, the slots 731, 732 are aligned, but spaced apart. The slot 733 extends upwardly from the lower edge of the beam 730 along the other sidewall of the beam 730. The beam 730 is connected to the beam 710 by slidable mating between the slot 731 of the beam 730 and the slot 712 of the beam 710 and slidable mating between the slot 733 of the beam 730 and the slot 713 of the beam 710.

The beam 720 extends along a longitudinal axis B-B and comprises two elongated slots 721, 722. After the beams 710, 730 are coupled together, the beam 720 is connected to the beams 710, 730 by slidable mating between the slot 721 of the beam 720 and the slot 711 of the beam 710 and slidable mating between the slot 722 of the beam 720 and the slot 732 of the beam 730. The slot 722 of the beam 720 also nests within the slot 712 of the beam 710.

Figure 33:
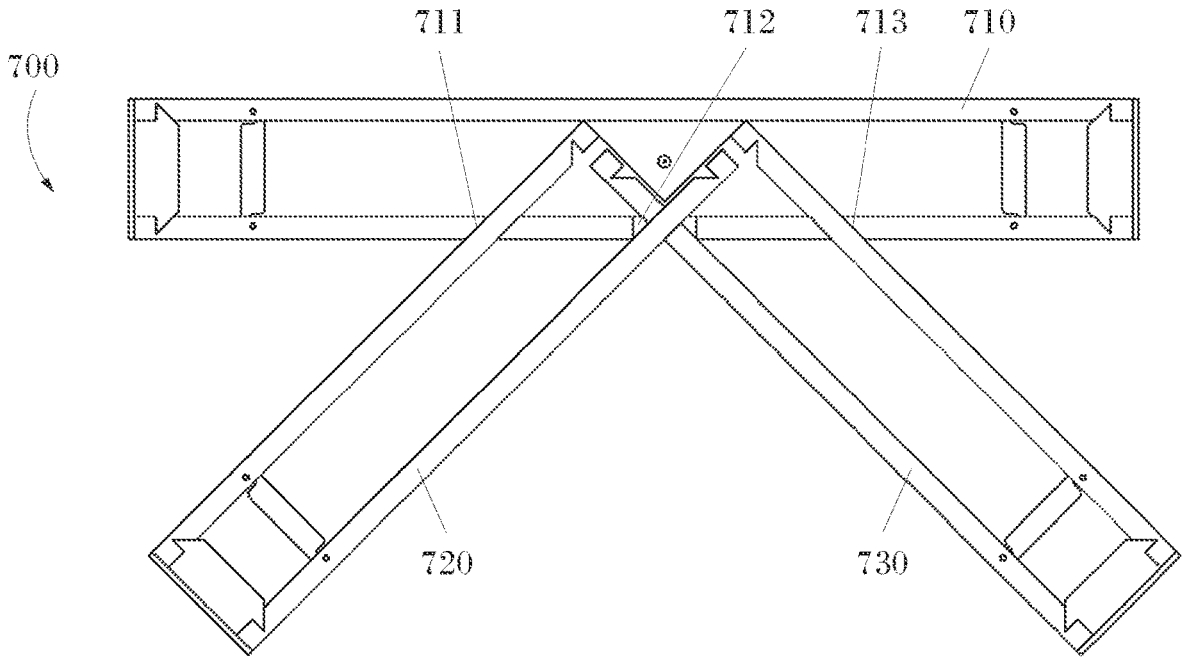
FIG. 33 is a top plan view of the beams of FIG. 31.
Figure 33A:
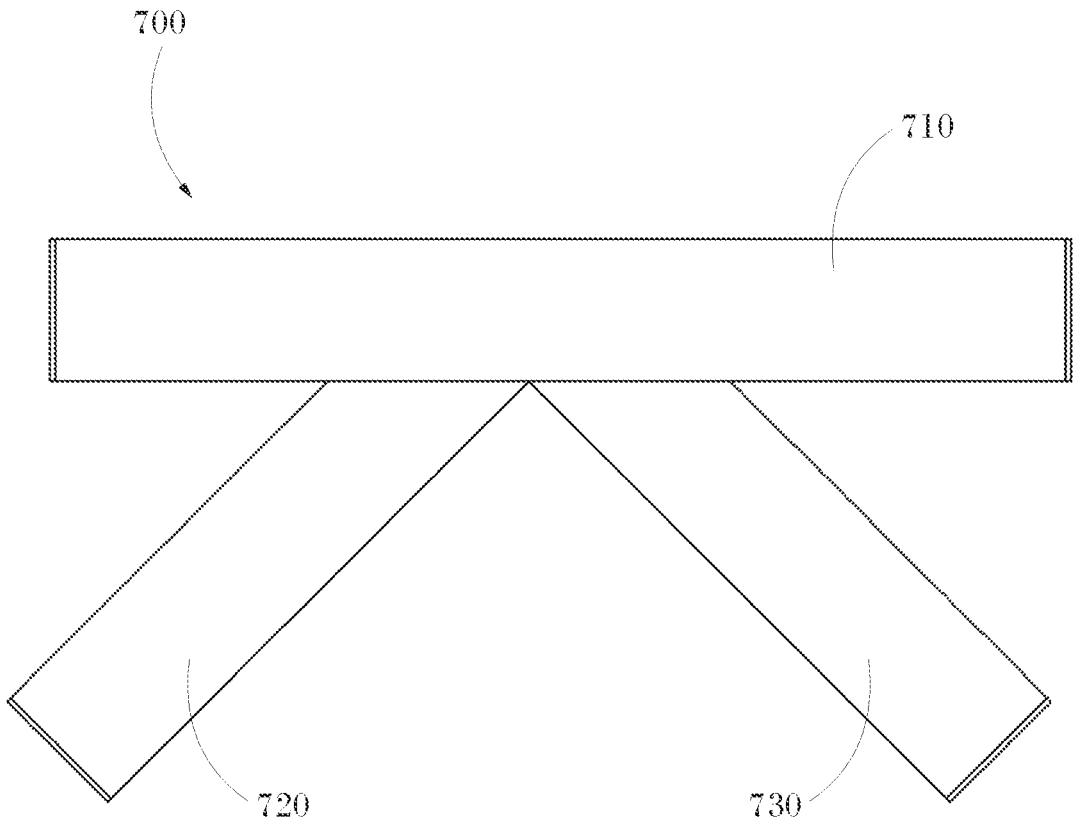
FIG. 33A is a bottom plan view of the architectural fixture of FIG. 31.

The various elongated slots may be shaped, sized, and otherwise configured and angled to enable parts of the other beams to be received therein. Thus, for example, the slot 712 of the beam 710 is somewhat larger than the other slots because parts of each of the beams 720, 730 are received in the slot 712. Moreover, the edges of the slots may be angled relative to the longitudinal axis of the beam in which the slot is formed to allow the nesting arrangement as shown in FIGS. 31-33A. FIG. 33A illustrates the end result from a bottom plan view, which is the view that would be available to a person inside of a room in which the architectural fixture 700 is hanging.

Figure 34:
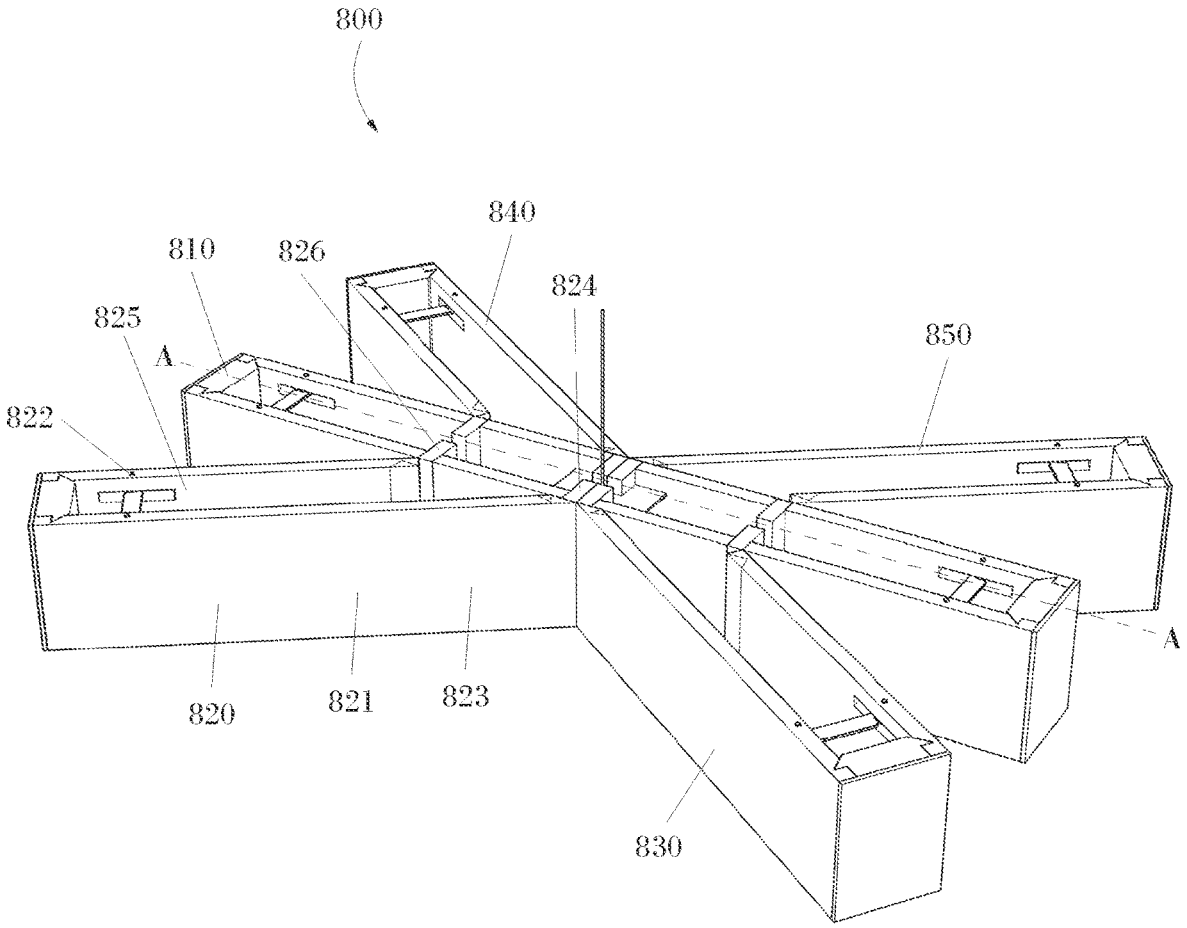
FIG. 34 is a top, front, right perspective view of an additional architectural fixture embodying the invention wherein six beams are shown in engagement.
Figure 35:
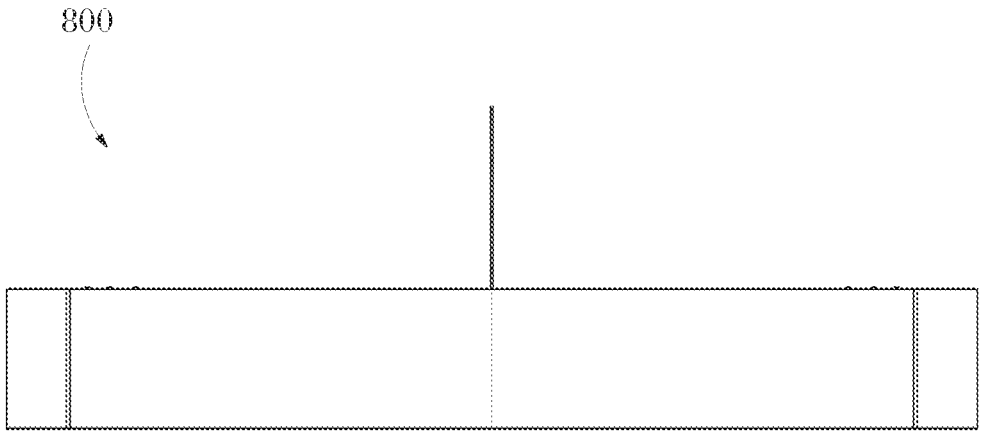
FIG. 35 is a front side elevation view of the beams of FIG. 34.
Figure 36:
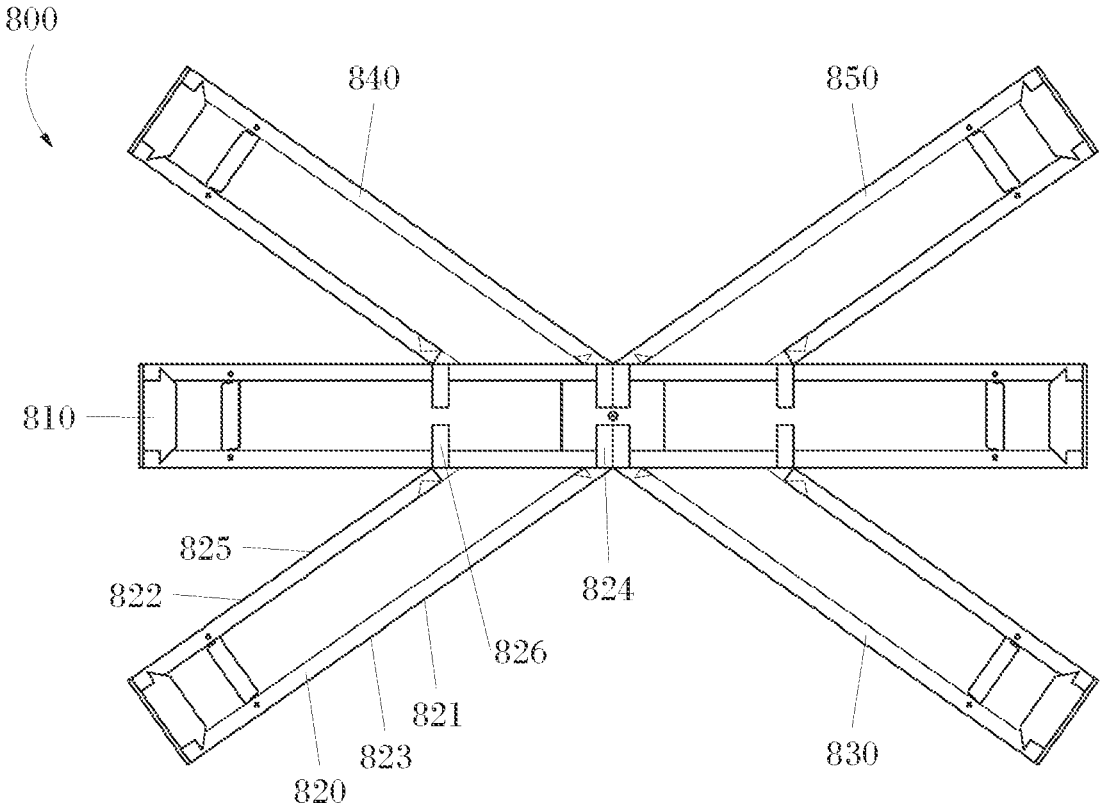
FIG. 36 is a top plan view of the beams of FIG. 34.

FIGS. 34-36 illustrate an architectural fixture 800 in accordance with an embodiment of the present invention. The architectural fixture 800 uses much of the same technology as described above for the architectural fixture 700, except that more beams and slots are used. In particular, in the architectural fixture 800, there are five beams 810, 820, 830, 840, 850 each with a variety of slots to enable them to be coupled together similar to the manner described above with reference to the architectural fixture 700.

One difference in the architectural fixture 800 as compared to the architectural fixture 700 is that the slots in the main beam 810 are oriented perpendicular to the longitudinal axis A-A of the main beam 810. In the architectural fixture 700, the slots 711, 713 in the main beam 710 are oriented at an angle relative to the longitudinal axis A-A of the beam 710. Thus, in this embodiment each of the beams 820, 830, 840, 850 comprises (numbering provided for the beam 820 only, but it is the same for the other beams) first and second sidewalls 821, 822. The first sidewall 821 comprises a main portion 823 and a connection portion 824 that is coupled to the main portion 823 with a living hinge. The second sidewall 822 also comprises a main portion 825 and a connection portion 826 that is coupled to the main portion 825 with a living hinge. Thus, the connection portions 824, 826 can bend or flex or pivot relative to the main portions 823, 825. Furthermore, the connection portions 824, 826 are the portions that are engaged with the main beam 810 for purposes of coupling the beams 810, 820 together. This allows the slots in the main beam 810 to be oriented perpendicular to the longitudinal axis of the main beam 810 while still forming the double "K" shape structure as the architectural fixture 800 because the connection portions 824, 826 can pivot to facilitate slidable mating with the slots of the main beam 810. Although the invention is described with the main and connection portions attached with a living hinge, in other embodiments there may not be a living hinge, but the connection portions may be bent/angled relative to the main portions to facilitate their insertion into the slots that are oriented perpendicular to the longitudinal axis of the main beam.

Figure 37:
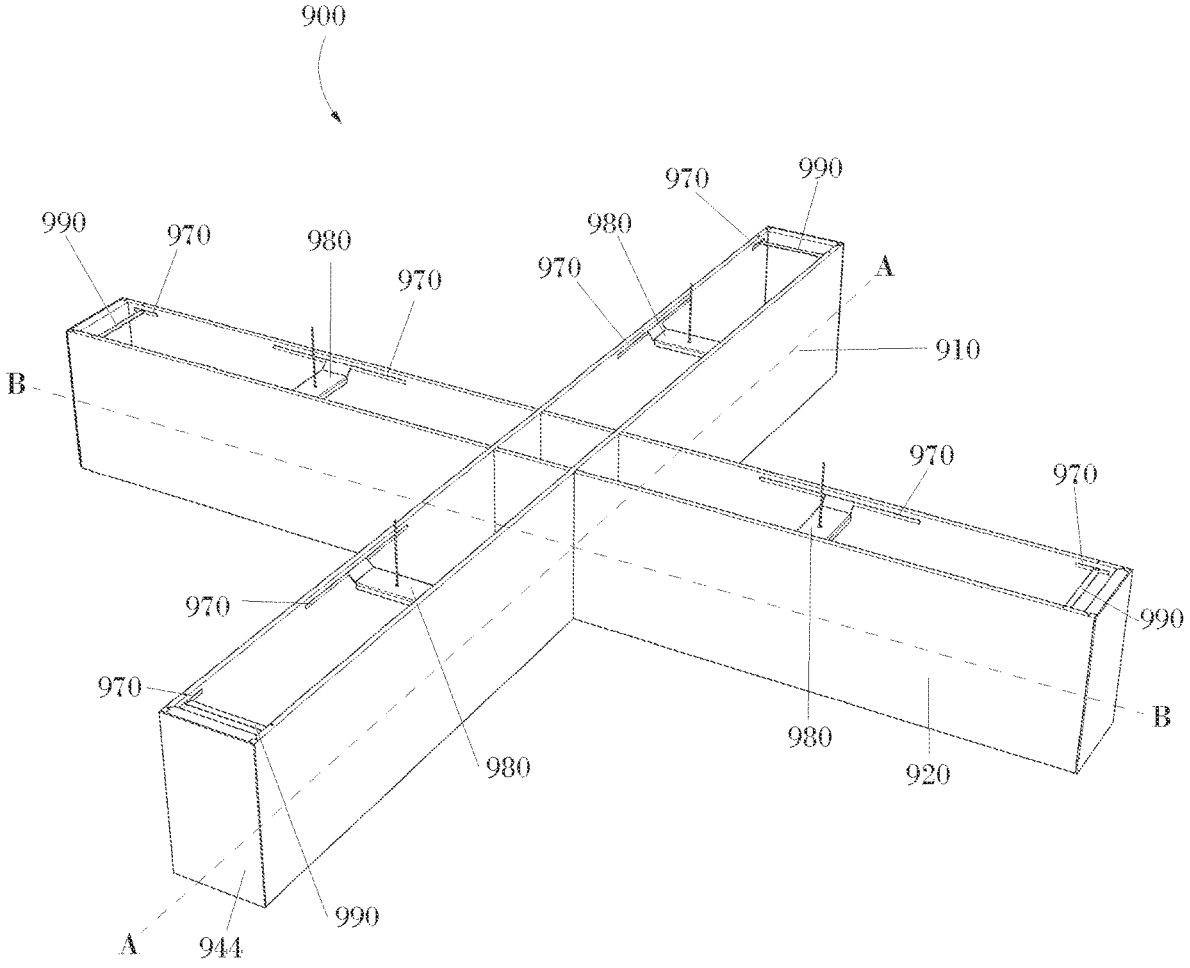
FIG. 37 is a top, front, right perspective view of an additional architectural fixture embodying the invention.
Figure 38:
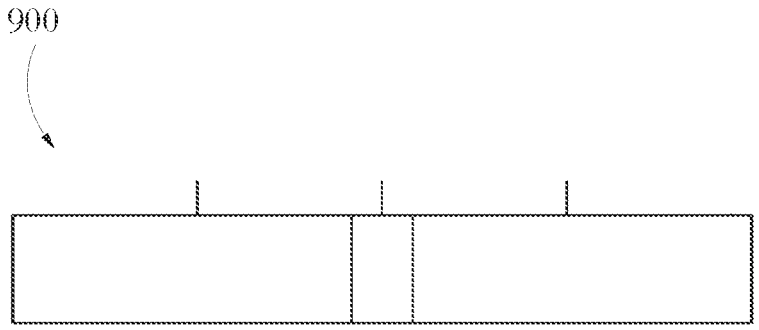
FIG. 38 is a front side elevation view of the beams of FIG. 37.
Figure 39:
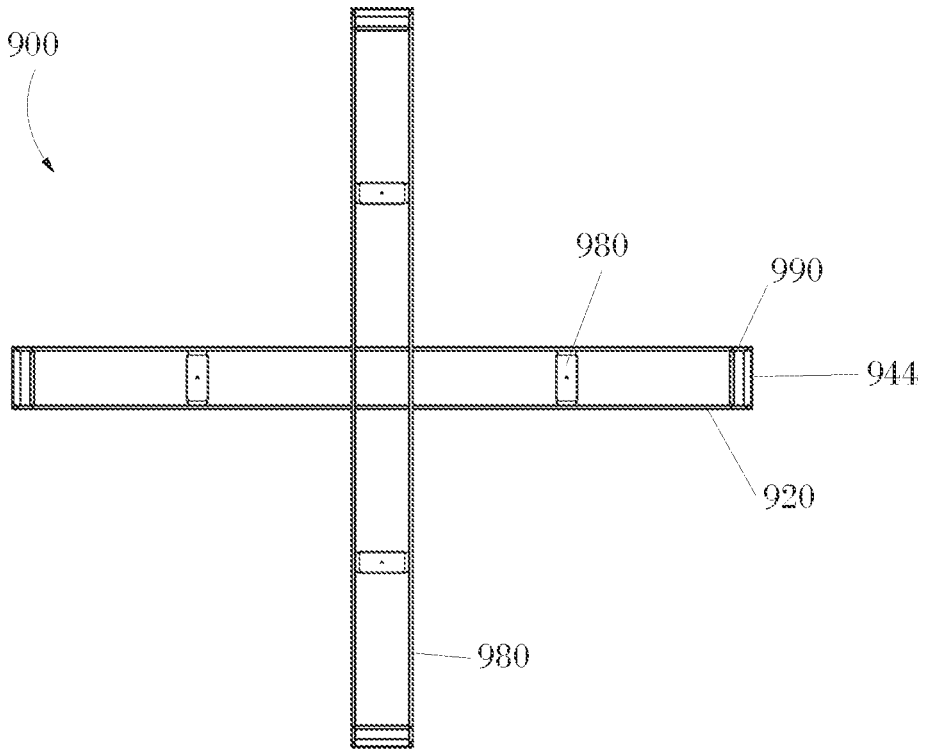
FIG. 39 is a top plan view of the beams of FIG. 37.

Referring now to FIGS. 37-39, an architectural fixture 900 is illustrated in accordance with an embodiment of the present invention. In this embodiment, there are two beams 910, 920 that intersect and are attached together via slots (not visible) on each of the beams 910, 920. The first beam 910 extends along a longitudinal axis A-A while the second beam 920 extends along a longitudinal axis B-B. In particular, for the beam 910 the slots extend from the bottom side upwards and for the beam 920 the slots extend from the top side downwards. In this embodiment, there are channels 970 on the inner surfaces of the sidewalls of the beams 910, 920 to receive attachment brackets 980 (like the attachment brackets 180A, 180B described above with reference to FIGS. 1-11). The channels 970 allows for adjustability, and quick, fastenerless connections of the attachment locations for the attachment brackets 980 and the securing elements 990. Connection keys 944 may be included as well as discussed previously in this disclosure.

Figure 40:
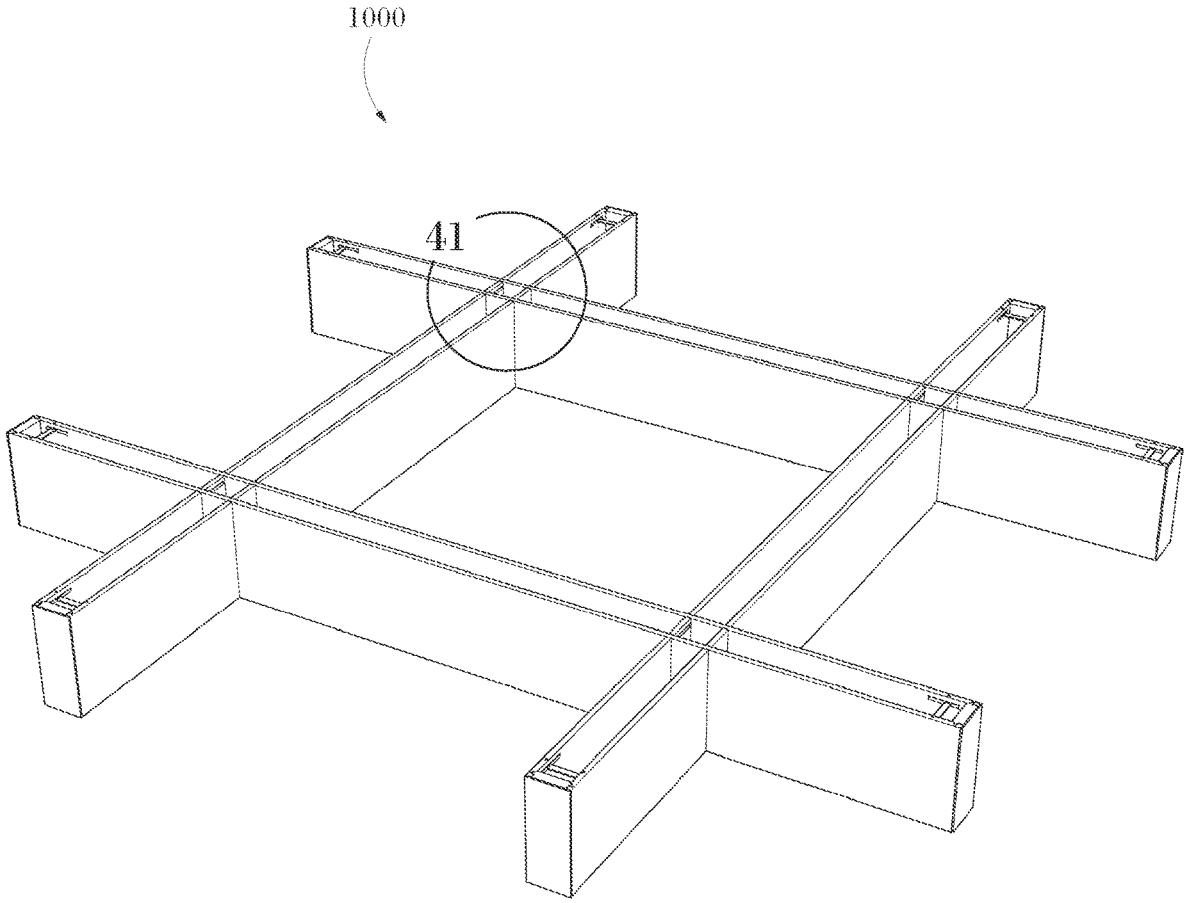
FIG. 40 is a top, front, right perspective view of an additional architectural fixture embodying the invention.
Figure 41:
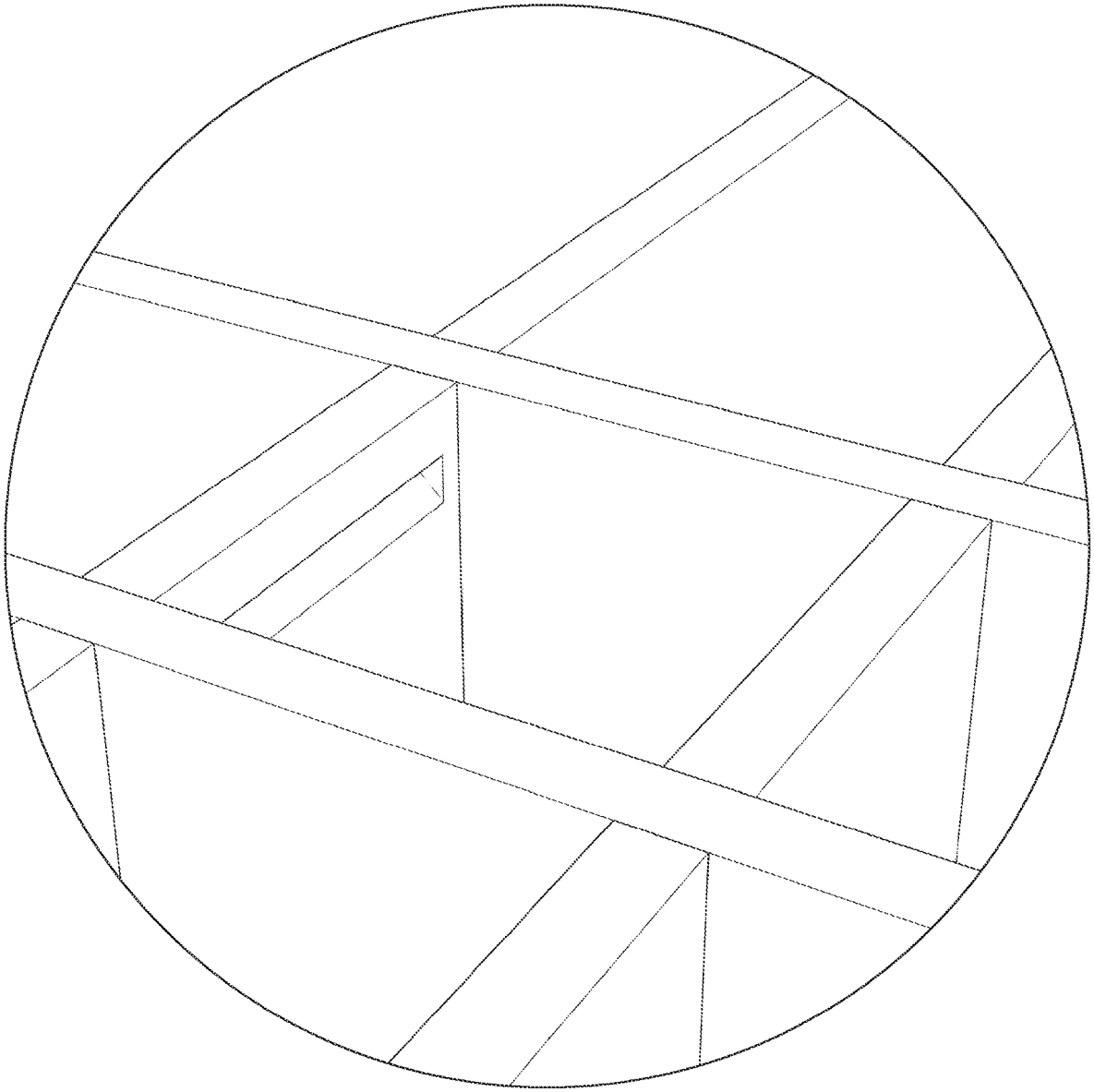
FIG. 41 is an enlarged section of FIG. 40 taken along line 41 of FIG. 40.
Figure 42:
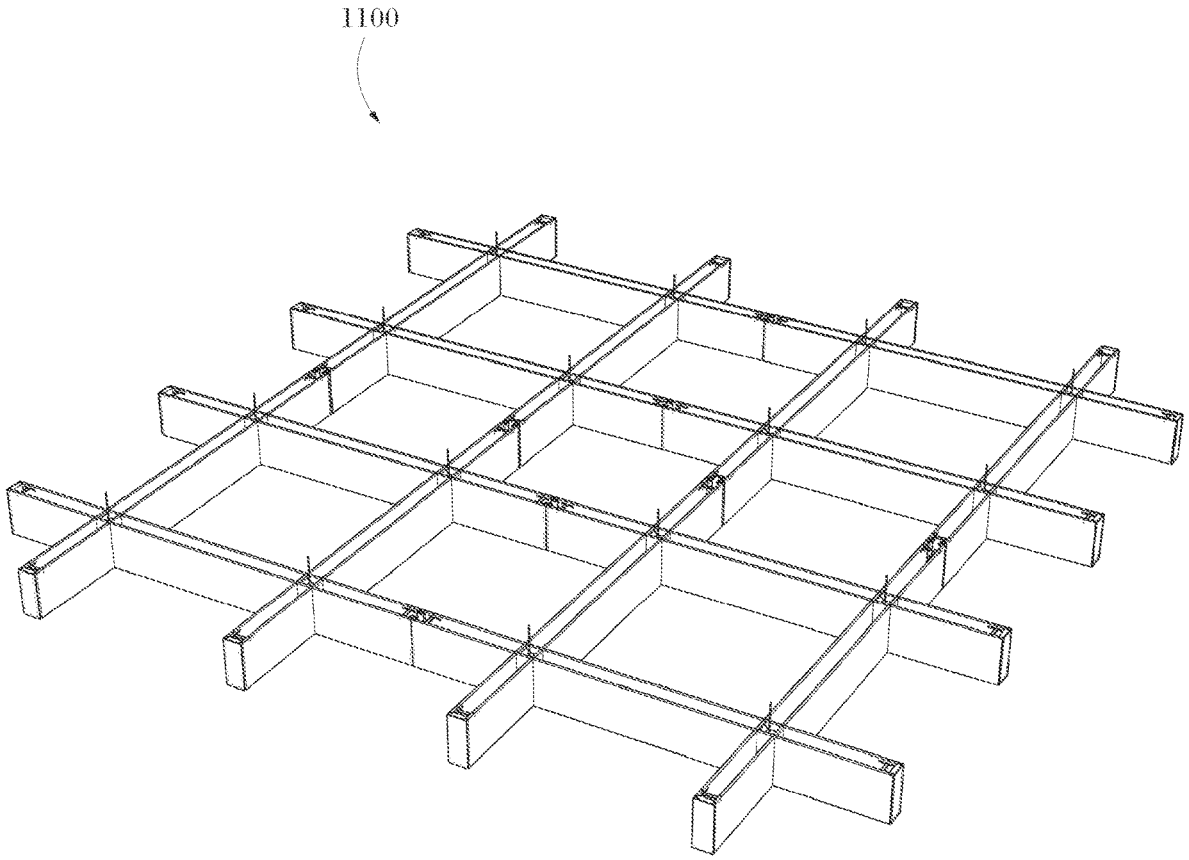
FIG. 42 is a top, front, right perspective view of an additional architectural fixture embodying the invention wherein the beams are configured to form a lattice.
Figure 43:
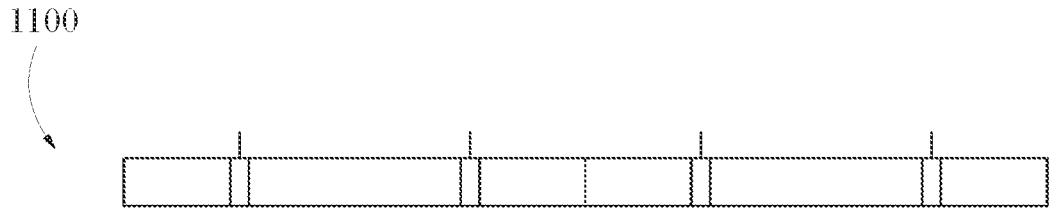
FIG. 43 is a front side elevation view of the beams of FIG. 42.

Referring to FIGS. 40 and 41, an architectural fixture 1000 is illustrated in accordance with an embodiment of the present invention. The architectural fixture 1000 includes channels on the inner surfaces of the beams for receiving attachment brackets and securing elements, as has been described above. Thus, FIGS. 40 and 41 illustrate a new arrangement for the beams relative to those described above, but the beams include the same features for attachment, hanging, maintaining in folded configuration, and the like which have been discussed herein.

Figure 44:
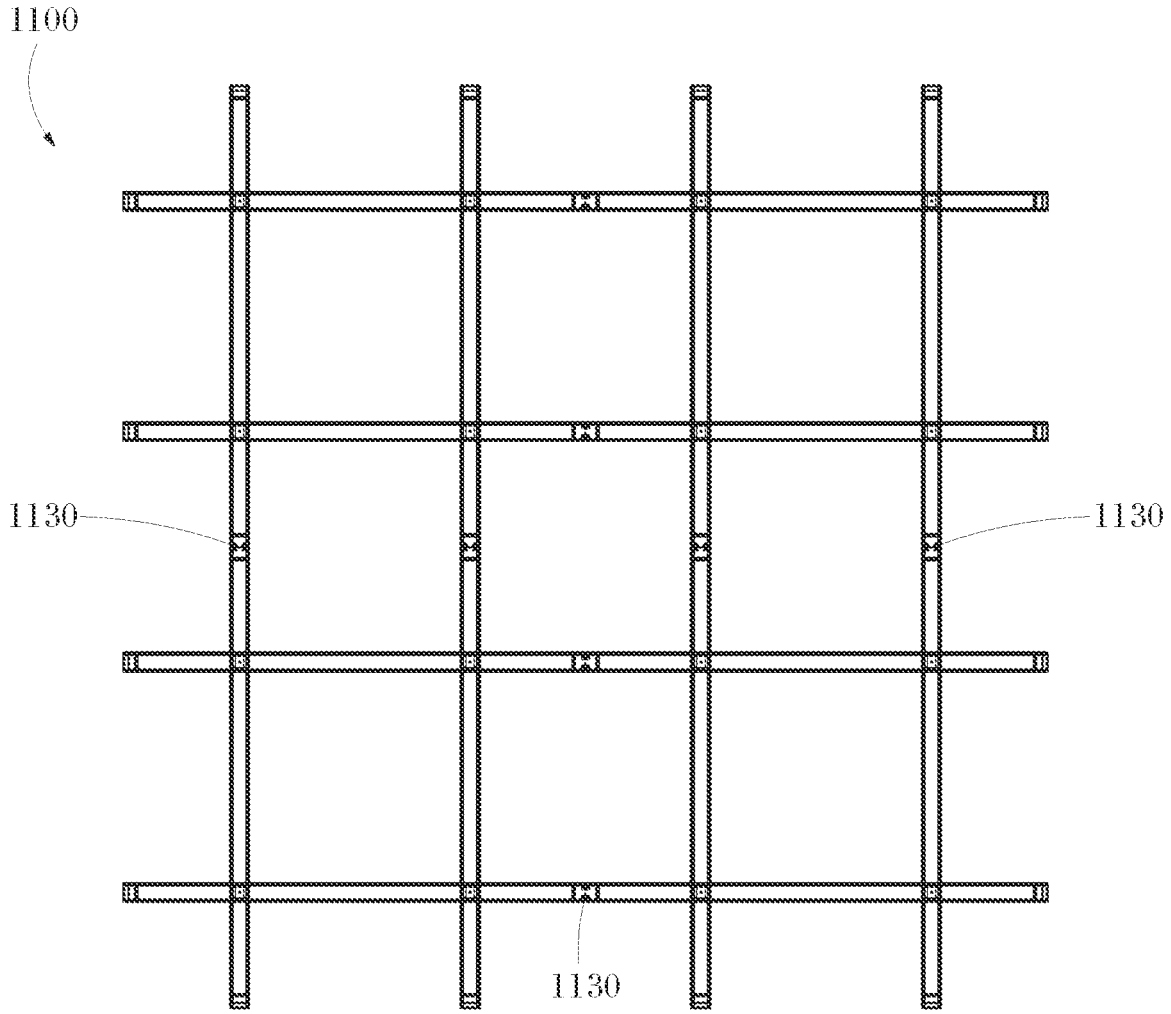
FIG. 44 is a top plan view of the beams of FIG. 42.
Figure 45:
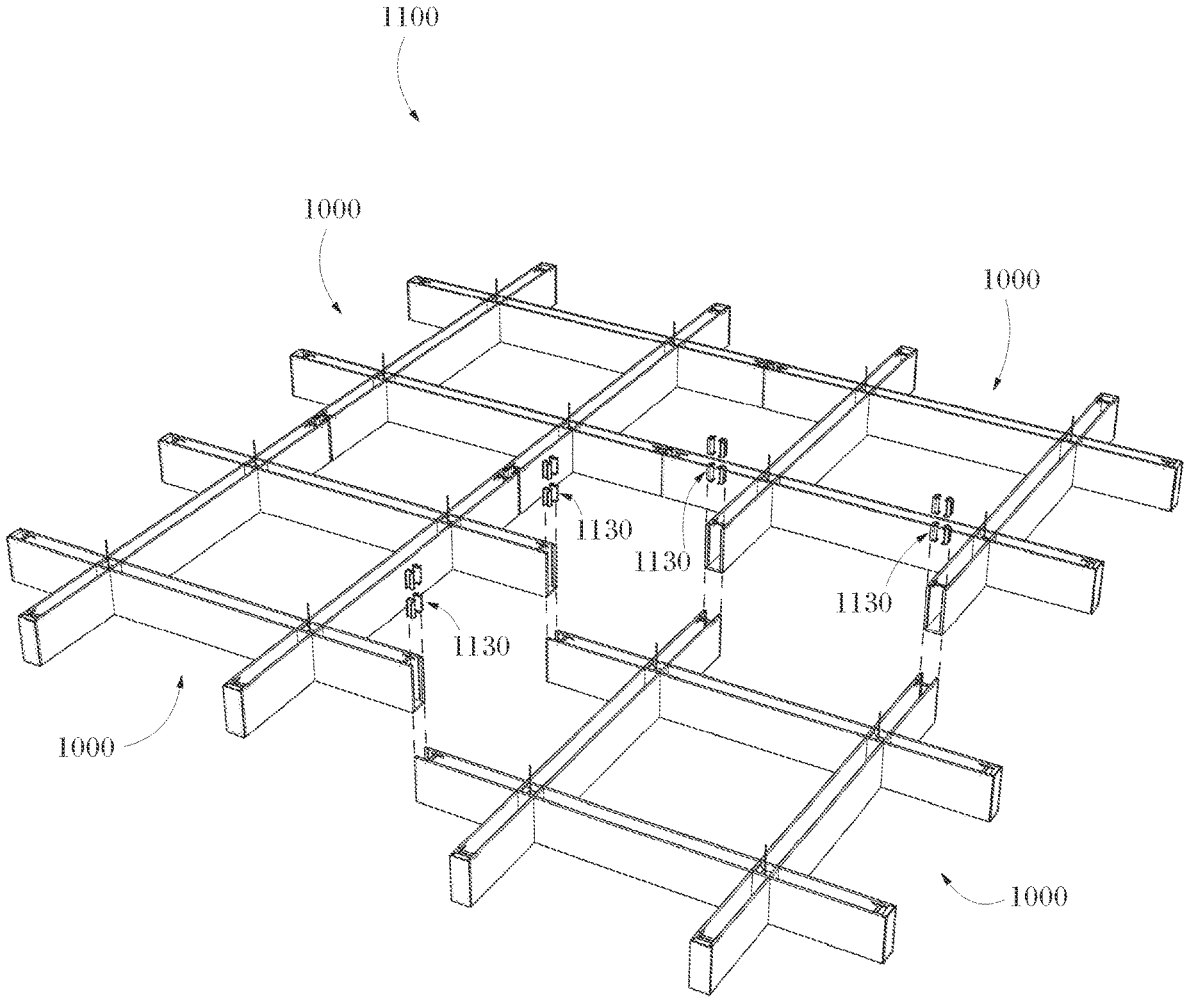
FIG. 45 is a top, front, right perspective view of the beams of FIG. 42 shown with dashed lines indicating movement for the beams to engage/disengage.

Referring to FIGS. 44 and 45, an architectural fixture 1100 is illustrated in accordance with an embodiment of the present invention. The architectural fixture 1100 formed by attaching several of the architectural fixtures 1000 of FIGS. 40 and 41 together. That is, the architectural fixtures 1000 are coupled together with joiner brackets 1130, which have the same structure and function in the same way as the joiner brackets 130 described above. That is, the joiner brackets 1130 slidably engage the notches in adjacently positioned beams to connect the beams together.

Figure 46:
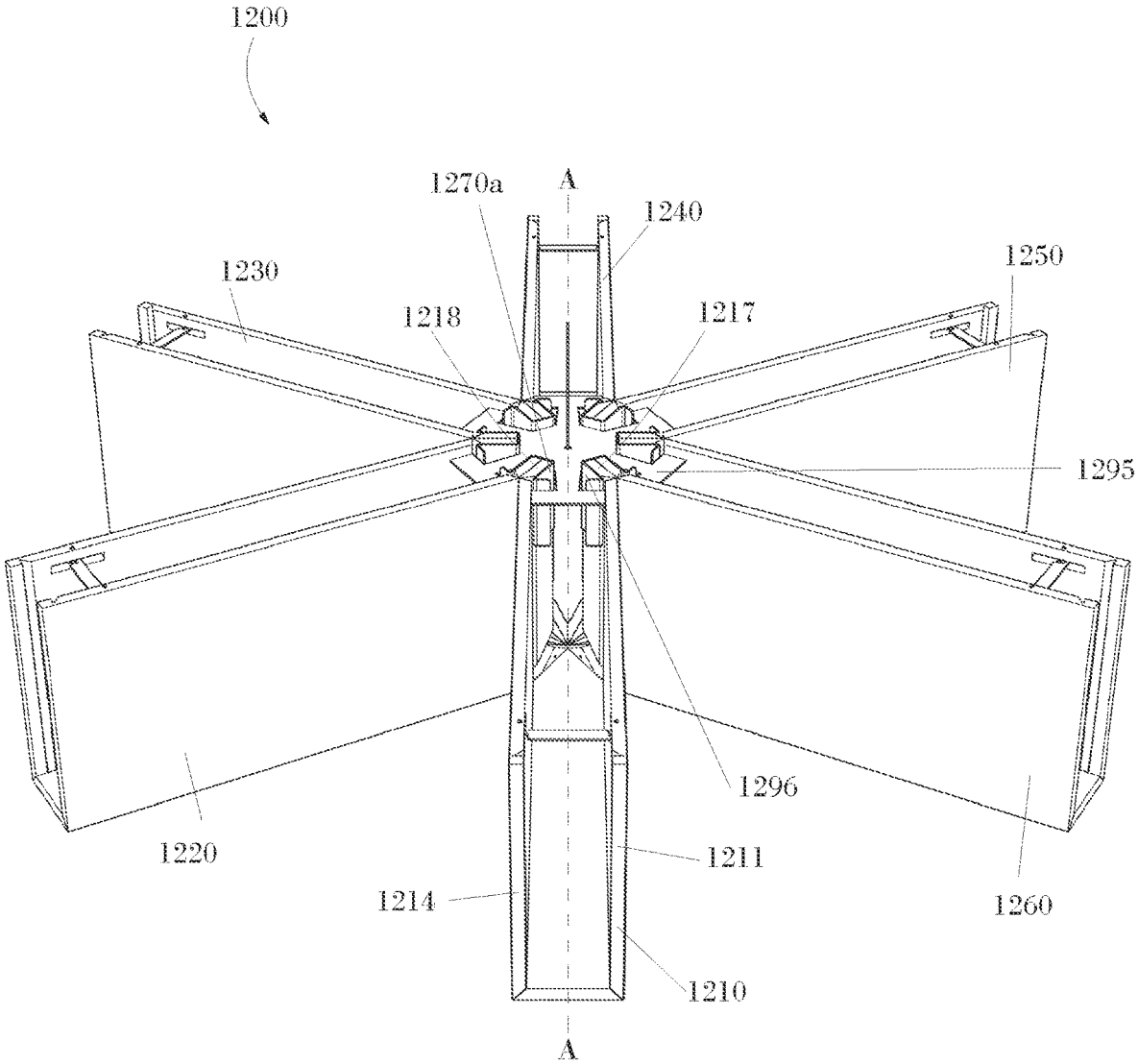
FIG. 46 is a top, front, right perspective view of an additional architectural fixture embodying the invention where in the beams are configured to form a star-like shape.
Figure 46A:
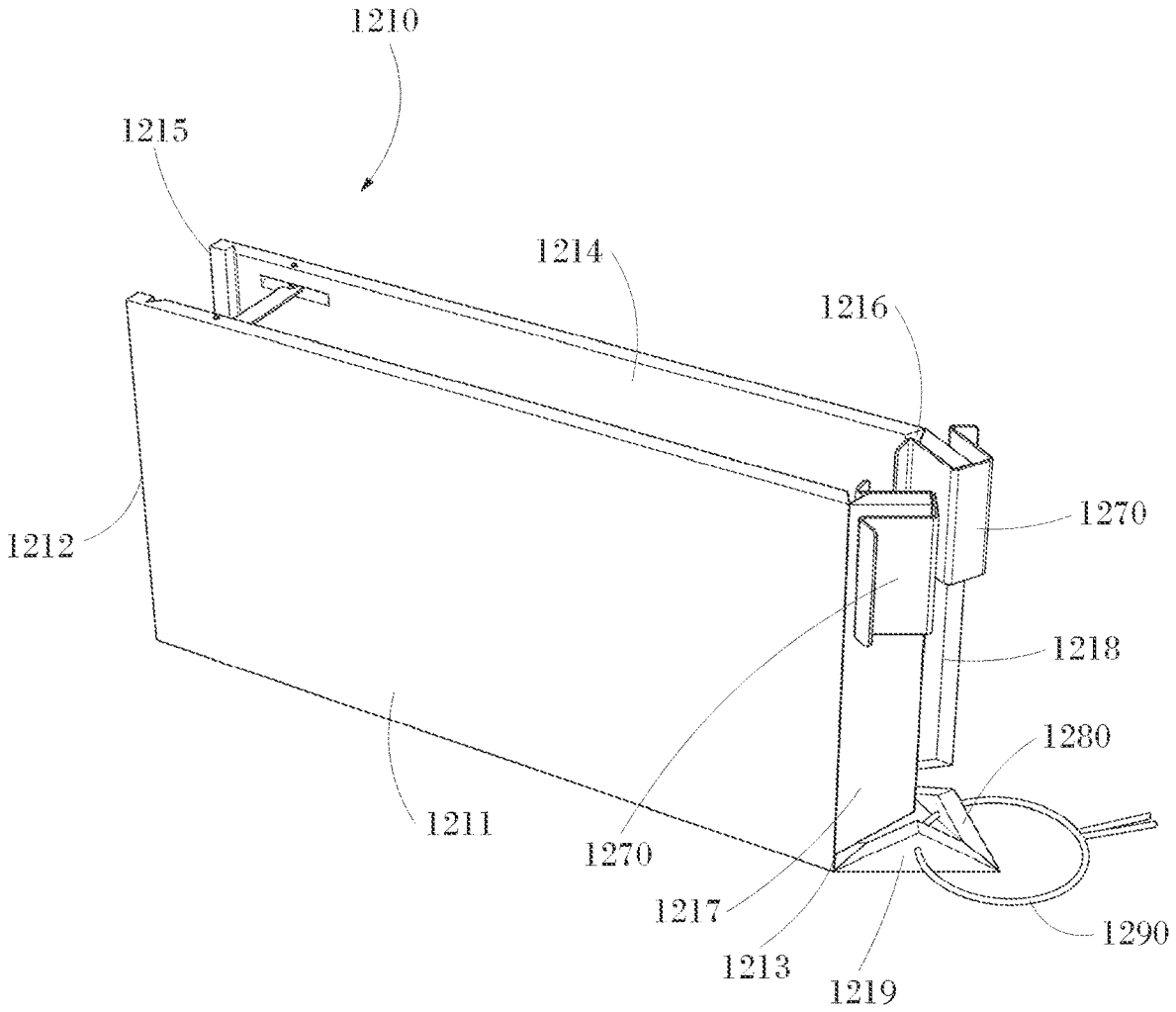
FIGS. 46A and 46B are partial views of the architectural fixture of FIG. 46.
Figure 46B:
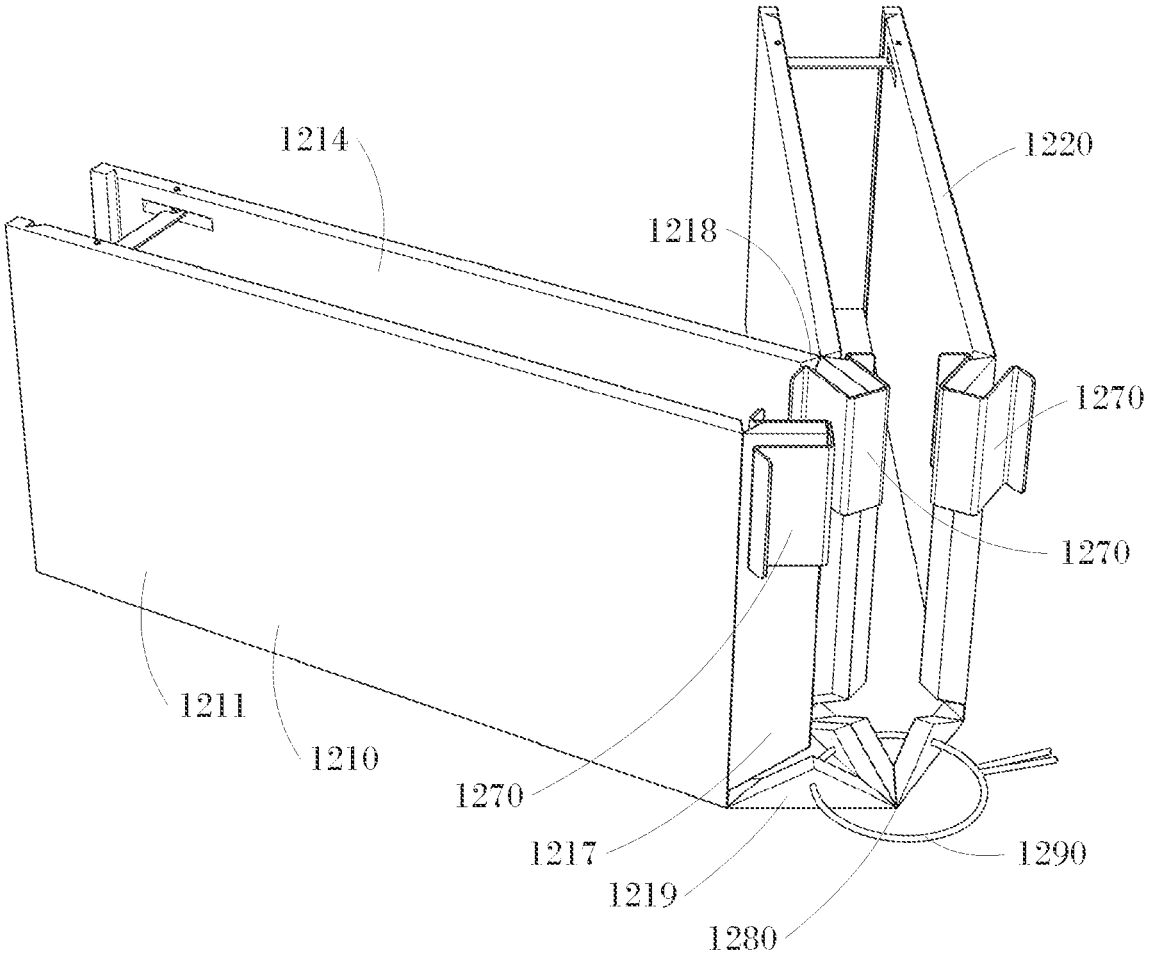
Figure 47:
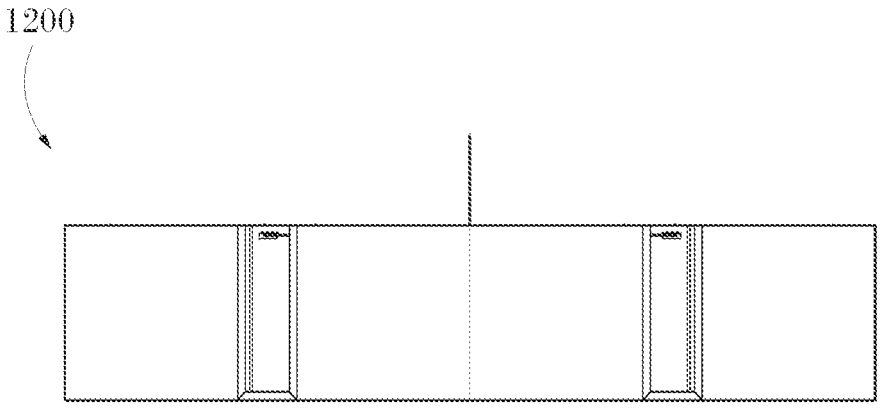
FIG. 47 is a front side elevation view of the beams of FIG. 46.
Figure 48:
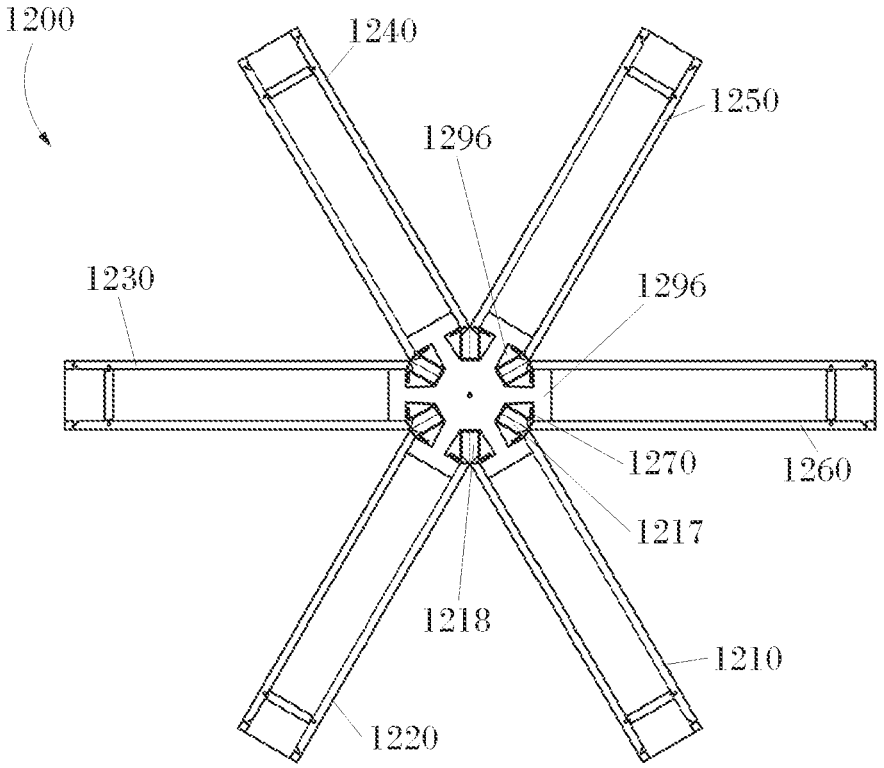
FIG. 48 is a top plan view of the beams of FIG. 46.
Figure 49:
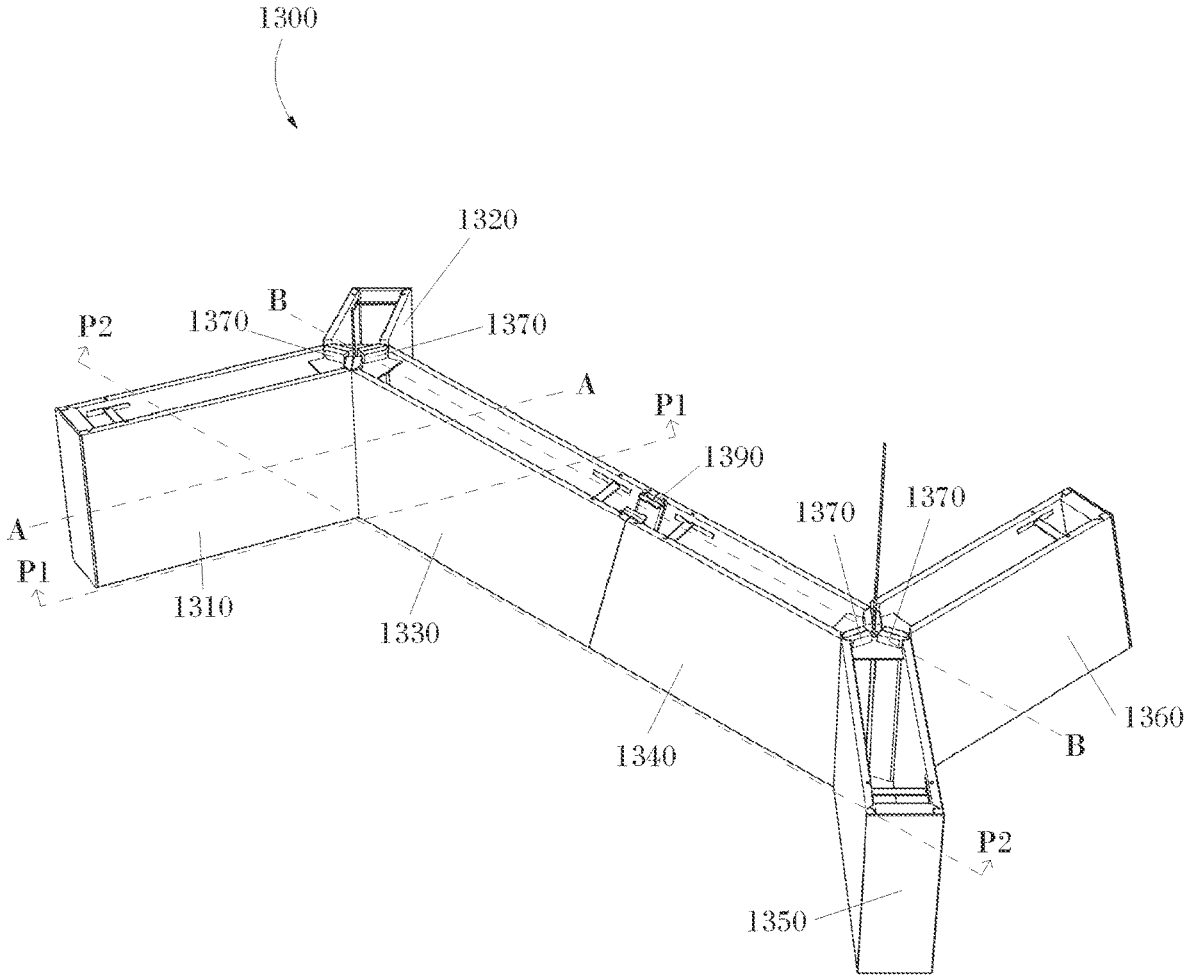
FIG. 49 is a top, front, right perspective view of an additional architectural fixture embodying the invention wherein the beams are disposed to form a continuous up and down three-dimensional movement configuration.
Figure 50:
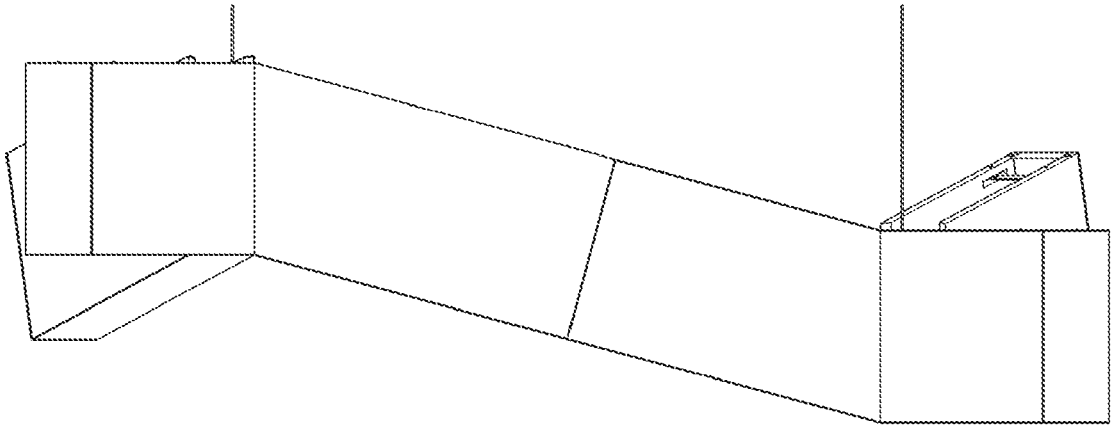
FIG. 50 is a front side elevation view of the beams of FIG. 49.

Referring to FIGS. 46-48, an architectural fixture 1200 is illustrated in accordance with an embodiment of the present invention. The architectural fixture 1200 comprises a plurality of beams 1210, 1220, 1230, 1240, 1250, 1260 that are attached together to form a star or asterisk-like shape. While there are six of the beams 1210, 1220, 1230, 1240, 1250, 1260 illustrated in the exemplified embodiment, the invention is not to be so limited and more or less than six beams could be used in this arrangement in other embodiments utilizing the attachment features described below. Moreover, it should be appreciated that several of the architectural fixtures 1200 may be coupled together using methods and techniques described herein to form a large fixture with triangular shaped cells defined between the beams.

The details of the architectural fixture 1200 will be described with reference to the beam 1210, but it should be understood that the other beams 1220, 1230, 1240, 1250, 1260 have an identical structure to the beam 1210. The beam 1210 extends along a longitudinal axis A-A. The beam 1210 a first sidewall 1211 that extends along the longitudinal axis A-A from a first end 1212 to a second end 1213 and a second sidewall 1214 that extends along the longitudinal axis A-A from a first end 1215 to a second end 1216. Furthermore, the beam 1210 comprises a first upper flange 1217 that extends from the second end 1213 of the first sidewall 1211 to a distal end and a second upper flange 1218 that extends from the second end 1215 of the second sidewall 1214 to a distal end. The first and second upper flanges 1217, 1218 may be connected to the first and second sidewalls 1211, 1214, respectively, by a living hinge in some embodiments, although this is not required in all embodiments. The first and second upper flanges 1217, 1218 extend from the first and second sidewalls 1211, 1214 towards one another in the exemplified embodiment.

The architectural fixture 1200 comprises brackets 1270 that hold one of the upper flanges of one of the beams and one of the upper flanges of an adjacently positioned beam. For example, FIG. 46 illustrates the bracket 1270*a* holding the second upper flange 1218 of the beam 1210 and one of the upper flanges of the beam 1220.

The beam 1210 (and the other beams as well) also comprises a first lower flange 1219 and a second lower flange 1280. In the exemplified embodiment, a retention device 1290 is pulled through the lower flanges of all of the beams 1210-1260 and pulled tight to lock all of the beams together in the desired arrangement. The retention device 1290 may be a zip tie or other device capable of coupling the lower flanges 1219 of the respective beams 1210, 1220, 1230, 1240, 1250, 1260.

In the exemplified embodiment, the architectural fixture 1200 comprises a central hub 1295 with a plurality of notches 1296 (the number of notches should equal the number of beams, and thus in the exemplified embodiment there are six of the notches 1296). One of the brackets 1270 is disposed within each of the notches 1296. The central hub 1295 may be omitted in some embodiments.

Referring now to FIGS. 49-51C, an architectural fixture 1300 will be described in accordance with yet another embodiment of the present invention. The architectural fixture 1300 uses similar techniques to that described above with reference to FIGS. 46-48 for achieving the coupling of the various beams together, although the beams are in a different configuration. In particular, in this embodiment the architectural fixture 1300 comprises six beams 1310, 1320, 1330, 1340, 1350, 1360. The first three beams 1310, 1320, 1330 are coupled together using brackets 1370 much like the brackets 1270 described above. Similarly, the second three beams 1340, 1350, 1360 are coupled together using brackets 1370 much like the brackets 1270 described above. Furthermore, the beam 1330 is coupled to the beam 1340 using joiner brackets 1390 which are identical to the joiner brackets 130 described above. That is, the joiner brackets 130 nest within notches in the inner surfaces of the beams 1330, 1340 adjacent to their ends to couple the beams 1330, 1340 together.

Each of the beams 1310, 1320, 1330, 1340, 1350, 1360 extends along a longitudinal axis. By way of example, a longitudinal axis A-A is illustrated as extending along the beam 1310 and a longitudinal axis B-B is illustrated as extending along the beam 1330. A first plane P1 lies along a bottom side of the beam 1310. A second plane P2 lies along a bottom side of the beam 1330. The beams 1310, 1320, 1330, 1350, 1360 are all angled with respect to each other. The beams 1330, 1340 are aligned with each other. The planes formed by the bottom sides of the beams 1310, 1320, 1330, 1350, 1360 are non-parallel to one another.

Figure 51:
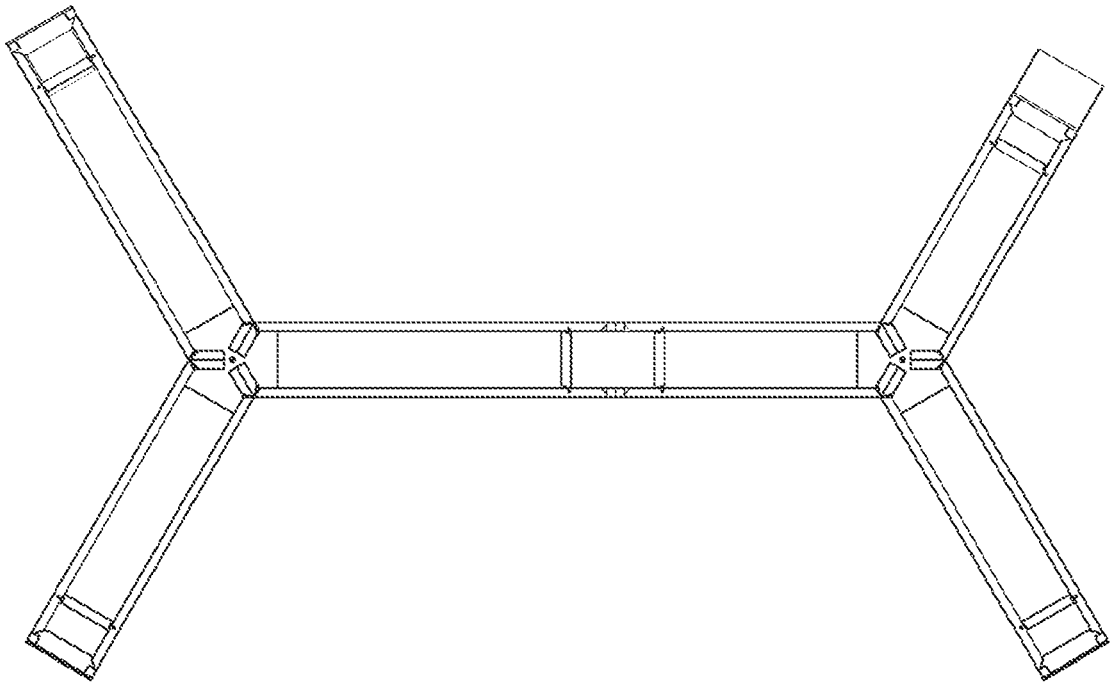
FIG. 51 is a top plan view of the beams of FIG. 49.
Figure 51A:
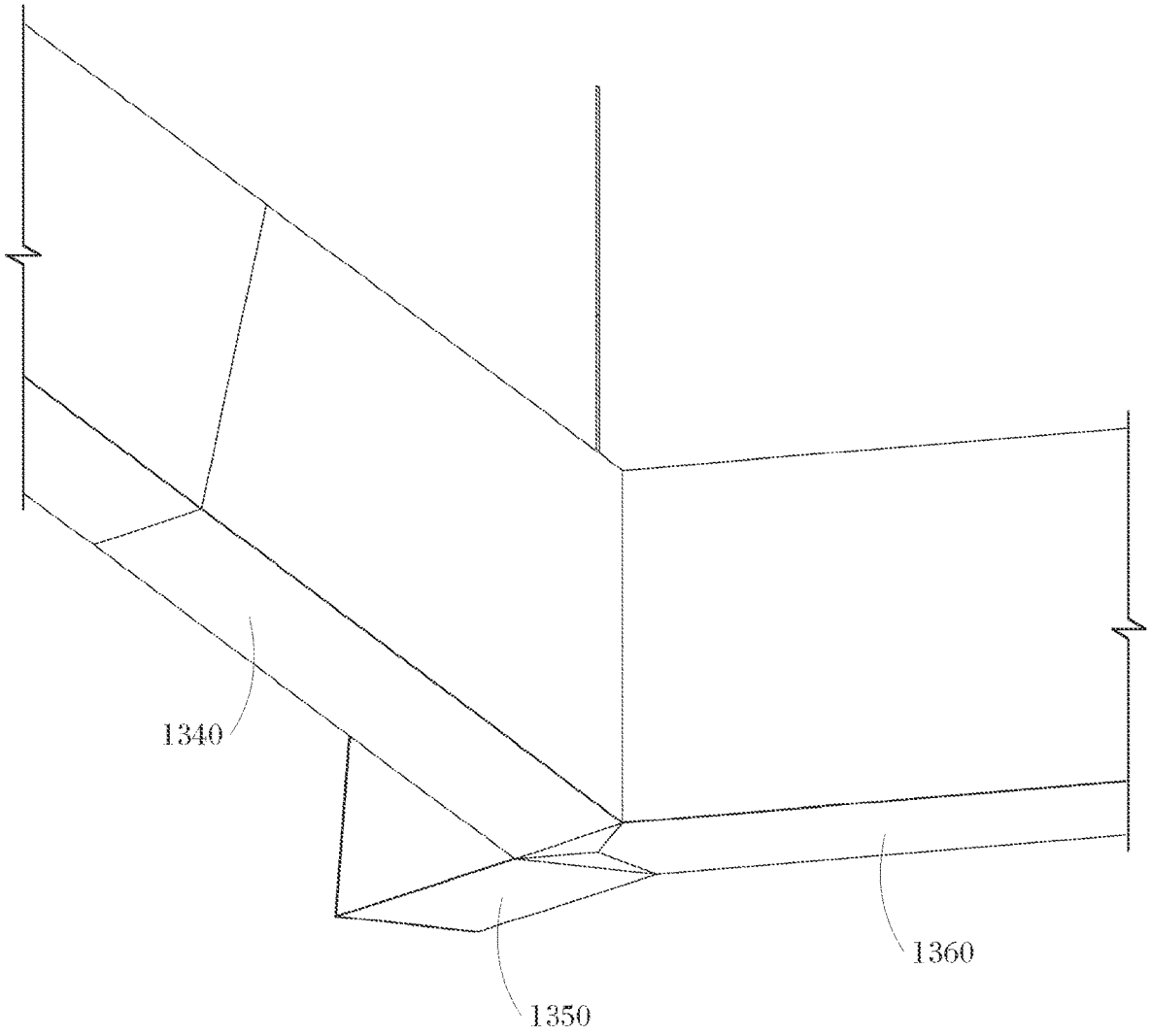
FIG. 51A is a bottom perspective view of a portion of the architectural fixture of FIG. 49.
Figure 51B:
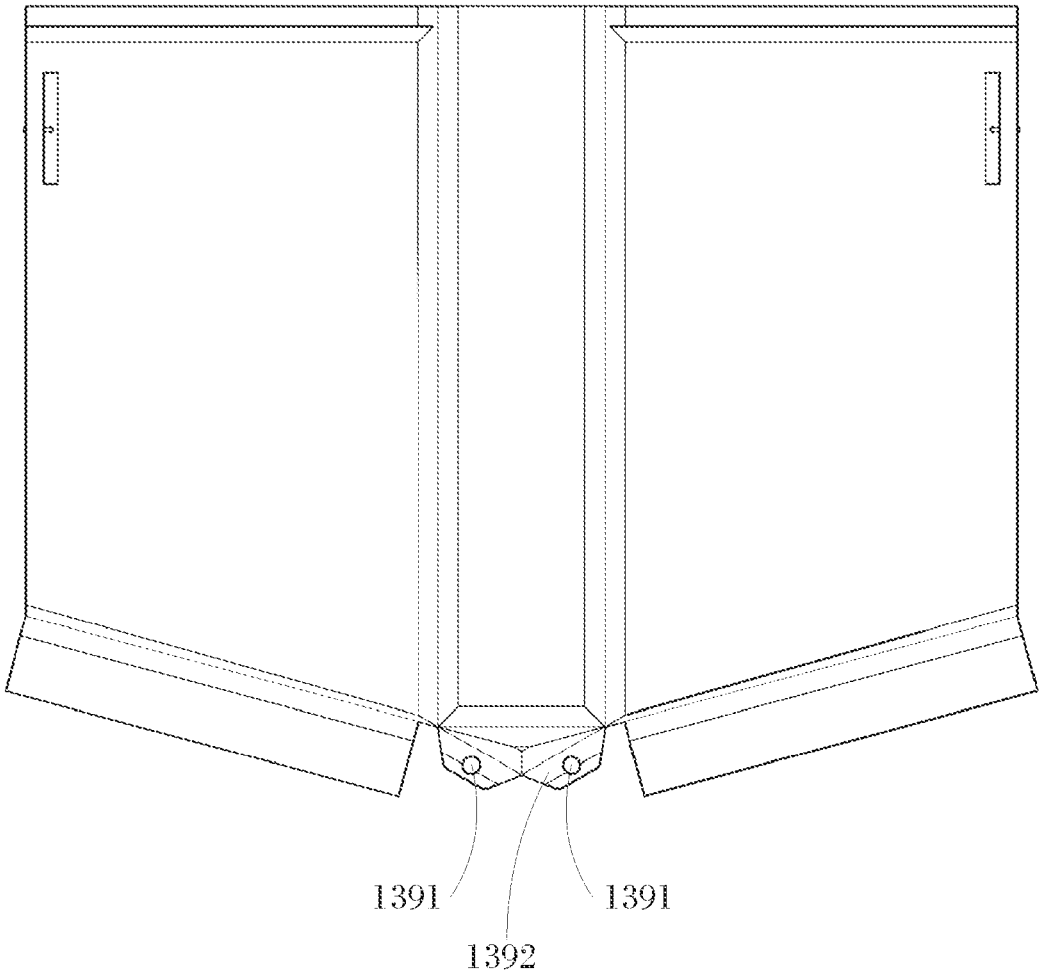
FIG. 51B is a view of one of the beams of the architectural fixture of FIG. 49 in an unfolded configuration.

In this embodiment, the beams 1310-1360 have bottom flanges that are articulatable to allow the faces of different angles to come together in a clean way. The bottom flanges may be attached together with a retention device as described above. FIG. 51A is a bottom view which illustrates the bottom flanges of the three beams 1340, 1350, 1360 interfacing in a clean manner. Furthermore, FIG. 51B illustrates one of the beams 1310-1360 in an unfolded configuration. There are holes 1391 in the bottom flanges 1392 which allow for the retention device to pass through. Moreover, the remaining lines indicated on the unfolded beam are fold lines (which would be crease lines, pre-weakened lines formed by cutting or thinning of the material, or the like), which should indicate the manner in which the beam is manipulated to alter it from its unfolded configuration to its folded configuration.

Figure 51C:
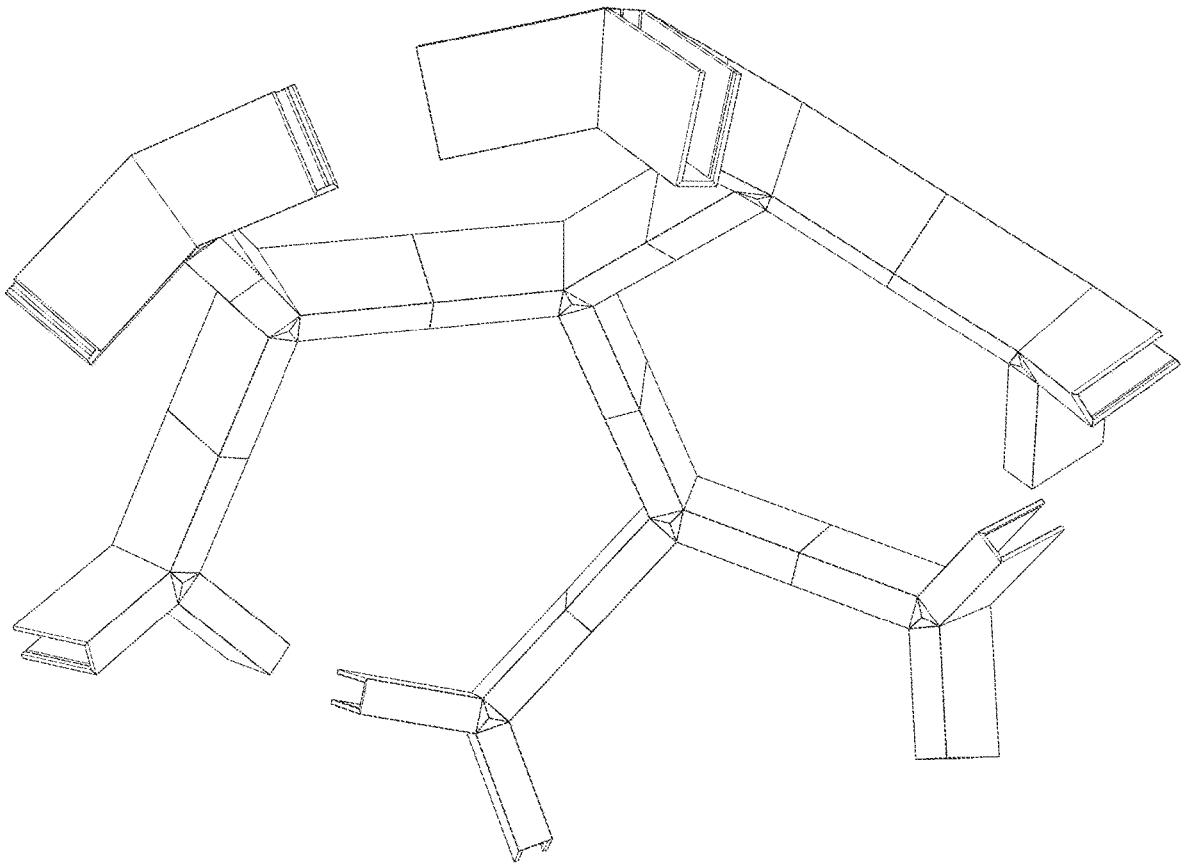
FIG. 51C is a three-dimensional architectural fixture system formed by connecting a plurality of the architectural fixtures of FIG. 49.

The architectural fixture 1300 and related embodiments allow a way to create a system of connected 3-way beams that can create an undulating three-dimensional surface out of a multitude of the 3-way beams. FIG. 51C is one such example of an undulating three-dimensional architectural fixture formed using the techniques described with regard to this particular embodiment.

Figure 52A:
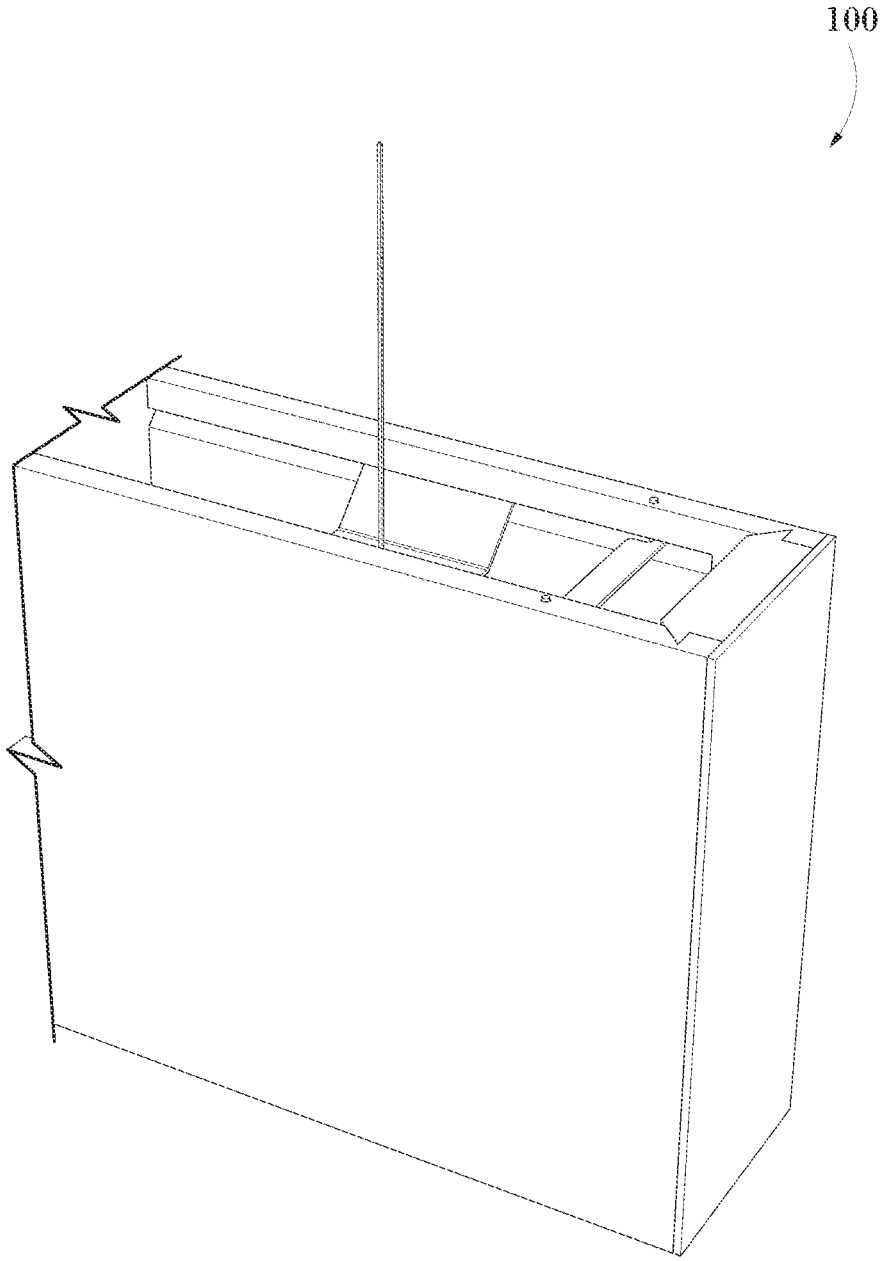
FIGS. 52A and 52B illustrate a top, front, left perspective view of a beam of an architectural fixture embodying the invention, with a beam, and an outwardly facing side of a connection key with an end cover flush with an end of the beam.
Figure 52B:
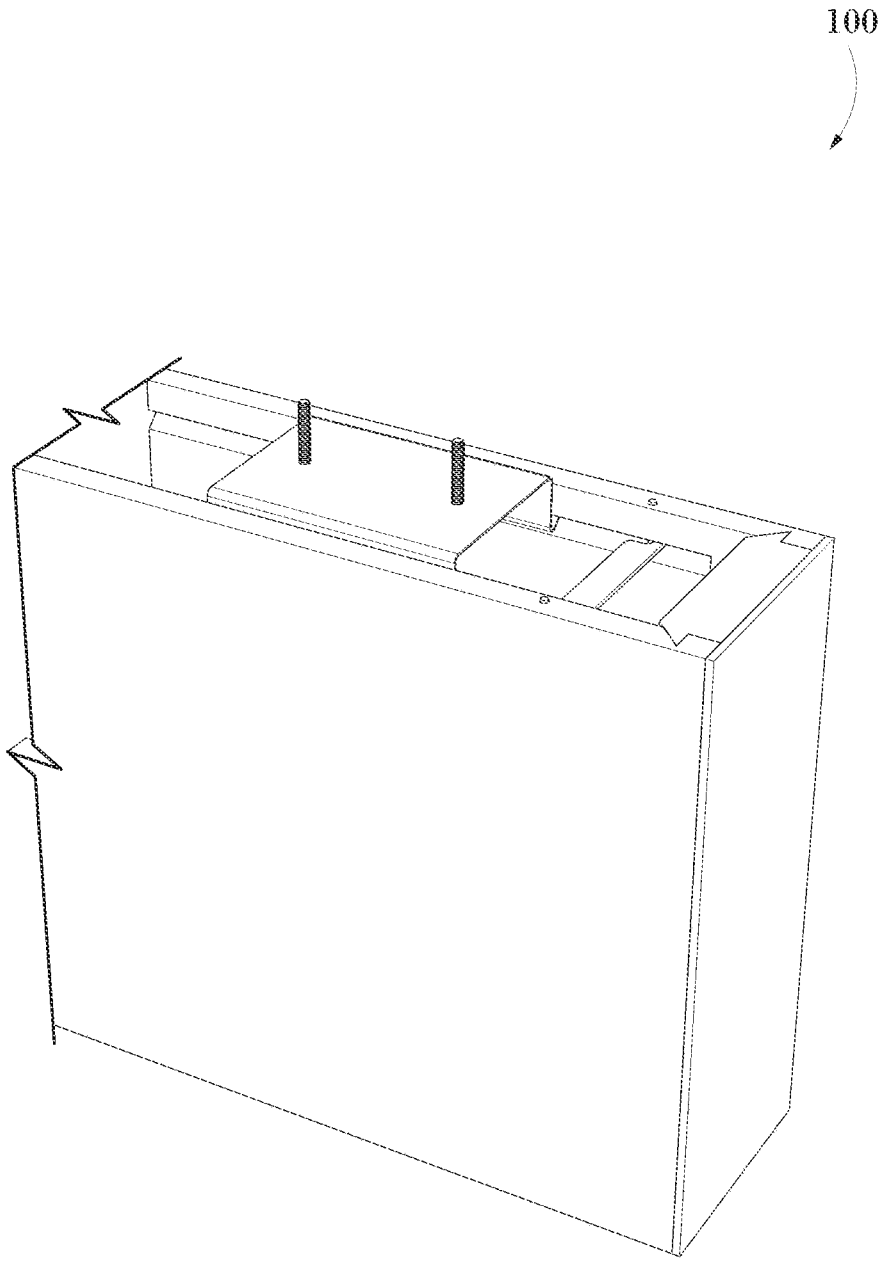
Figure 53:
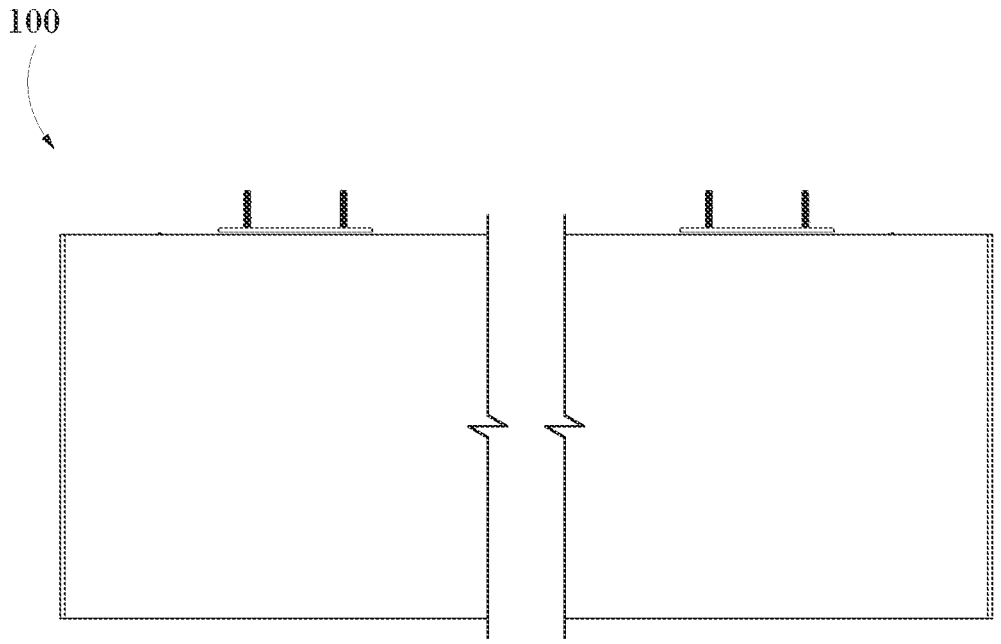
FIG. 53 is a front side elevation view of the beam of FIG. 52B.
Figure 54:
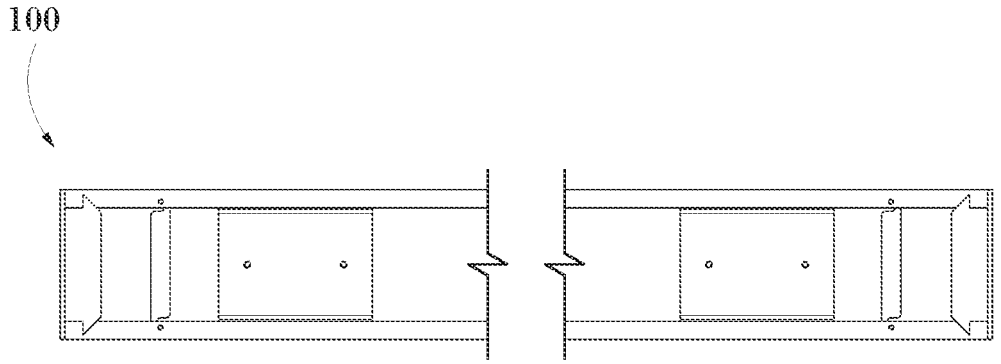
FIG. 54 is a top plan view of the beam of FIG. 52B.

FIG. 52A illustrates the architectural fixture 100 of FIG. 1 with an indication that the architectural fixture 100 may have any length. FIGS. 52B, 53, and 54 illustrates the architectural fixture 100 of FIG. 5 with an indication that the architectural fixture 100 may have any length.

The features described herein may be combined and mixed among the various embodiments. For example, although attachment brackets (such as 180A and 180B in FIGS. 1 and 5) are not shown in all embodiments, they could be incorporated into any and all of the embodiments disclosed herein for purposes of hanging the architectural fixtures from a support surface. Thus, any of the features described with reference to one of the embodiments may be incorporated into any of the other embodiments to optimize use, function, aesthetic, or the like.

The invention claimed is:

1. An architectural fixture assembly comprising:

a beam extending along a longitudinal axis, the beam comprising:

a bottom side;

a first sidewall extending from the bottom side to a distal end and having an outer surface, an inner surface, and a first channel formed into the inner surface, the first channel comprising a first floor and a first roof, the inner surface of the first sidewall having a first portion above the first roof of the first channel and a second portion below the first floor of the first channel, the first channel being recessed relative to the first and second portions of the inner surface of the first sidewall; and a second sidewall extending from the bottom side and having an outer surface, an inner surface, and a second channel formed into the inner surface, the second channel comprising a second floor and a second roof, the inner surface of the second sidewall having a first portion above the second roof of the second channel and a second portion below the second floor of the second channel, the second channel being recessed relative to the first and second portions of the inner surface of the second sidewall;

wherein the first and second sidewalls are configured to be folded relative to the bottom side between an unfolded configuration and a folded configuration;

a first fastener located within the first channel;

a second fastener located within the second channel; and a first securing element having a first securing feature that is configured to engage the first fastener within the first channel and a second securing feature that is configured to engage the second fastener within the second channel to maintain the beam in the folded configuration.

2. The architectural fixture assembly of claim 1 further comprising:

the first roof and the first floor of the first channel extending from the inner surface of the first sidewall towards the outer surface of the first sidewall;

the second roof and the second floor of the second channel extending from the inner surface of the second sidewall towards the outer surface of the second sidewall;

wherein the first fastener is oriented vertically between the first roof and the first floor of the first channel; and wherein the second fastener is oriented vertically between the second roof and the second floor of the second channel.

3. The architectural fixture assembly of claim 1 further comprising:

the first sidewall having a first distal end, the first fastener extending through the first distal end of the first sidewall and into and through the first channel, wherein the first fastener is not visible along the outer surface of the first sidewall; and the second sidewall having a second distal end, the second fastener extending through the second distal end of the second sidewall and into and through the second channel, wherein the second fastener is not visible along the outer surface of the second sidewall.

4. The architectural fixture assembly of claim 1 wherein the first securing element is a flat plate comprising a planar top surface, a planar bottom surface that is parallel to the planar top surface, a first side edge extending between the planar top and bottom surfaces, and a second side edge extending between the planar top and bottom surfaces, the first and second side edges facing in opposite directions, the first securing feature comprising a first recess in the first side edge that is configured to receive the first fastener and the second securing feature comprising a second recess in the second side edge that is configured to receive the second fastener.

5. The architectural fixture assembly of claim 1 further comprising a first attachment bracket configured to engage the first channel and the second channel, the first attachment bracket being a distinct component from the first securing element, the first attachment bracket being configured to be mounted to a ceiling or a wall to hang the beam from the ceiling or the wall.

6. The architectural fixture assembly of claim 5 wherein the first attachment bracket comprises a central portion, a first arm portion extending from a first side of the central portion, and a second arm portion extending from a second side of the central portion, the first and second arm portions configured to nest within the first and second channels of the beam, respectively.

7. The architectural fixture assembly of claim 5 further comprising:

the first securing element located adjacent to a first end of the beam and a second securing element located adjacent to a second end of the beam that is opposite the first end of the beam; and wherein the first attachment bracket is located axially in between the first and second securing elements.

8. The architectural fixture assembly of claim 6 further comprising the central portion of the first attachment bracket comprising an aperture that is configured to receive either a rod or a cable that is affixed to the ceiling to hang the beam from the ceiling or fasteners for mounting the first attachment bracket directly to the wall or the ceiling.

9. The architectural fixture assembly of claim 1 further comprising:

the first sidewall extending from the bottom side to a first distal end, the first portion of the inner surface of the first sidewall extending from the first roof of the first channel to the first distal end of the first sidewall, and the second portion of the inner surface of the first sidewall extending from the first floor of the first channel to an upper surface of the bottom side; and the second sidewall extending from the bottom side to a second distal end, the first portion of the inner surface of the second sidewall extending from the second roof of the second channel to the second distal end of the second sidewall, and the second portion of the inner surface of the second sidewall extending from the second floor of the second channel to the upper surface of the bottom side.

10. The architectural fixture assembly of claim 1 wherein the bottom side and the first and second sidewalls of the beam define a cavity, and wherein the beam comprises a connection key at a first end of the beam, the connection key forming a boundary of the cavity along the longitudinal axis.

11. The architectural fixture assembly of claim 1 further comprising:

a first notch in the inner surface of the first sidewall at a first end of the first sidewall;

a second beam extending along a second longitudinal axis, the second beam comprising:

a bottom side;

a first sidewall extending from the bottom side;

a second sidewall extending from the bottom side; and a second notch formed into the inner surface of the first sidewall of the second beam at a second end of the first sidewall;

a joiner bracket engaging the first notch of the beam and the second notch of the second beam, the joiner bracket securing the first end of the first sidewall of the beam to the second end of the first sidewall of the second beam.

12. The architectural fixture assembly of claim 1 further comprising:

a second beam extending along a second longitudinal axis, the second beam comprising:

a bottom side;

a first sidewall extending from the bottom side; and a second sidewall that extends from the bottom side; and wherein the beam comprises a first monolithic, unitary sheet that comprises the bottom side, the first sidewall, and the second sidewall of the beam; and wherein the second beam comprises a second monolithic, unitary sheet that comprises the bottom side, the first sidewall, and the second sidewall of the second beam.

13. The architectural fixture assembly of claim 12 wherein the second beam is coupled to the beam such that the second longitudinal axis of the second beam is oriented at an angle to the longitudinal axis of the beam.

14. An architectural fixture assembly comprising:

a first beam extending along a first longitudinal axis, the first beam comprising:

a bottom side;

a first sidewall extending from the bottom side, the first sidewall having an outer surface and an inner surface;

a second sidewall extending from the bottom side;

a first slot extending through the first sidewall from the outer surface to the inner surface;

a second slot extending through the first sidewall from the outer surface to the inner surface;

a third slot extending through the first sidewall from the outer surface to the inner surface, the third slot located between the first and second slots;

a second beam and a third beam each comprising:

a bottom side;

a first sidewall extending from the bottom side; and a second sidewall extending from the bottom side;

wherein a portion of the first sidewall of the second beam is received in the first slot of the first beam and a portion of the second sidewall of the second beam is received in the third slot of the first beam to couple the second beam to the first beam, the second beam comprising a second longitudinal axis that is oblique to the first longitudinal axis of the first beam; and wherein a portion of the first sidewall of the third beam is received in the second slot of the first beam and a portion of the second sidewall of the third beam is received in the third slot of the first beam to couple the third beam to the first beam, the third beam comprising a third longitudinal axis that is oblique to the first longitudinal axis of the first beam.

15. The architectural fixture assembly of claim 14 wherein the first slot extends through the first sidewall of the first beam at a first oblique angle relative to the longitudinal axis and the third slot extends through the first sidewall of the first beam at a second oblique angle relative to the first longitudinal axis, and wherein the third longitudinal axis is perpendicular to the second longitudinal axis.

16. The architectural fixture according to claim 1 further comprising:

the first fastener extending along a first axis that is perpendicular to the bottom side of the beam, the first fastener not being visible along the outer surface of the first sidewall; and the second fastener extending along a second axis that is perpendicular to the bottom side of the beam, the second fastener not being visible along the outer surface of the second sidewall.

17. The architectural fixture according to claim 14 further comprising:

the first slot having a first width, the second slot having a second width, and the third slot having a third width, the third width being greater than the first and second widths.

18. The architectural fixture according to claim 14 further comprising:

the second longitudinal axis of the second beam being orthogonal to the third longitudinal axis of the third beam.

19. The architectural fixture according to claim 14 further comprising:

the first beam defining a first cavity, the second beam defining a second cavity, and the third beam defining a third cavity;

wherein end portions of each of the first and second sidewalls of each of the second and third beams are located within the first cavity of the first beam;

wherein the end portion of the second sidewall of the second beam is located within the third cavity of the third beam; and wherein the end portion of the second sidewall of the third beam is located within the second cavity of the second beam.

20. An architectural fixture assembly comprising:

a first beam extending along a first longitudinal axis and comprising a bottom side and first and second sidewalls extending from the bottom side, the first sidewall comprising a first slot, a second slot, and a third slot located between the first and second slots;

a second beam extending along a second longitudinal axis and comprising a bottom side and first and second sidewalls extending from the bottom side, the second beam coupled to the first beam via engagement between the second beam and the first and third slots of the first beam such that the second longitudinal axis is oblique to the first longitudinal axis; and a third beam extending along a third longitudinal axis and comprising a bottom side and first and second sidewalls extending from the bottom side, the third beam coupled to the first beam via engagement between the third beam and the second and third slots of the first beam such that the third longitudinal axis is oblique to the first longitudinal axis.

* * * * *